US006460433B1

(12) United States Patent
Ackeret et al.

(10) Patent No.: US 6,460,433 B1
(45) Date of Patent: Oct. 8, 2002

(54) MULTIPURPOSE HAND DEVICE

(75) Inventors: Peter Ackeret, Kusnacht; Pierre-Alain Jeandupeux, Delémont, both of (CH); Yves Wira, Winkel (FR); Rolf Nussbaumer, Liesberg Dorf; Claude Kottelat, Coux, both of (CH)

(73) Assignee: C-Tech AG, Landquart (CH)

( * ) Notice: Subject to any disclaimer, the term of this patent is extended or adjusted under 35 U.S.C. 154(b) by 0 days.

(21) Appl. No.: 09/529,437

(22) PCT Filed: Oct. 16, 1998

(86) PCT No.: PCT/EP98/06568

§ 371 (c)(1),
(2), (4) Date: Nov. 27, 2000

(87) PCT Pub. No.: WO99/20438

PCT Pub. Date: Apr. 29, 1999

(30) Foreign Application Priority Data

Oct. 16, 1997 (DE) ..... 197 45 799

(51) Int. Cl.[7] ..... B25B 23/00
(52) U.S. Cl. ..... 81/440; 7/128; 7/118
(58) Field of Search ..... 30/158–161; 7/118, 7/158, 127, 128; 81/440

(56) References Cited

U.S. PATENT DOCUMENTS

| | | | |
|---|---|---|---|
| 400,987 | A | 4/1889 | Wilzin |
| 492,084 | A | 2/1893 | Brigham |
| 533,219 | A | 1/1895 | Hardy |
| 551,052 | A | 12/1895 | Shonnard et al. |
| 563,305 | A | 7/1896 | Paffrath |
| 616,689 | A | 12/1898 | Ruettgers |
| 689,513 | A | 12/1901 | Papendell |
| 698,080 | A | 4/1902 | Treas |
| 749,230 | A | 1/1904 | Severance |
| 1,234,345 | A | 7/1917 | Keeran |

(List continued on next page.)

FOREIGN PATENT DOCUMENTS

| | | | |
|---|---|---|---|
| DE | P.A. 190352-3458 | | 6/1958 |
| DE | 26 25 749 | A1 | 12/1977 |
| DE | 3538596 | | 5/1987 |
| DE | 4021645 | A1 | 2/1991 |
| DE | 41 10 688 | A1 | 9/1991 |
| DE | 195 27 859 | A1 | 1/1997 |
| EP | 0 306 678 | A2 | 3/1989 |
| EP | 0 783 938 | A2 | 7/1997 |
| GB | 19327 | | 9/1896 |

(List continued on next page.)

OTHER PUBLICATIONS

Brochure, "Wenger. The Genuine Swiss Army Knife", 27 pages.
Brochure, "Wenger. The Genuine Swiss Army Knife™", 16 pages.
Six Photographs Showing Top, Bottom, Left–Side, Right–Side, Front, and Rear views of "MoMA PLUS" Device.
PCT International Search Report for PCT/EP98/06568.
U.S. patent application Ser. No. 09/011,246; filed Dec. 7, 1998; inventor: Ackeret; title: "Multipurpose Hand–Held Implement of the Pocket Knife Type".
U.S. patent application Ser. No. 09/355,252; filed Jul. 23, 1999; inventor: Ackeret; title: "Multi–Purpose Hand–Held Implement".

*Primary Examiner*—James G. Smith
(74) *Attorney, Agent, or Firm*—Brinks-Hofer Gilson & Lione

(57) ABSTRACT

The invention relates to a multipurpose hand device especially comprising utensils. A lift and/or release mechanism (88, 89) is assigned to said utensils (81), enabling them to be placed in a slightly raised position so that they can be grasped easily or locked in a swing-out position.

115 Claims, 33 Drawing Sheets

U.S. PATENT DOCUMENTS

| | | | |
|---|---|---|---|
| 1,412,373 | A | 4/1922 | Shields |
| 1,431,835 | A | 10/1922 | Neft |
| 1,451,607 | A | 4/1923 | Bates |
| 1,603,914 | A | 10/1926 | Hermann |
| 1,647,405 | A | 11/1927 | Giesen |
| 1,965,291 | A | 7/1934 | Kowald |
| 2,199,430 | A | 5/1940 | Greve |
| 2,250,290 | A | 7/1941 | Berg |
| 2,264,322 | A | 12/1941 | Maynard |
| 2,316,246 | A | 4/1943 | Hyatt |
| 2,416,277 | A | 2/1947 | Siegel |
| 2,486,500 | A | 11/1949 | Shocket |
| 2,601,999 | A | 7/1952 | Sly |
| 2,726,393 | A | 12/1955 | Vogel |
| 2,808,646 | A | 10/1957 | Lohr, Jr. et al. |
| 3,640,443 | A | 2/1972 | Itagaki |
| 3,907,190 | A | 9/1975 | Mitsuhashi |
| 3,951,325 | A | 4/1976 | Mitsuhashi |
| 4,002,281 | A | 1/1977 | Hsu |
| 4,114,793 | A | 9/1978 | Hsu |
| 4,240,572 | A | 12/1980 | Mitsuhashi |
| 4,288,018 | A | 9/1981 | Taniguchi |
| 4,491,261 | A | 1/1985 | MItsuhashi |
| 4,640,451 | A | 2/1987 | Steiner et al. |
| 4,719,700 | A | 1/1988 | Taylor, Jr. |
| 4,727,610 | A | 3/1988 | Lin |
| 4,729,170 | A | 3/1988 | Hartmeister |
| 4,779,785 | A | 10/1988 | Amagaya |
| 4,783,867 | A | 11/1988 | Tsao |
| 4,794,692 | A | 1/1989 | Wang |
| 4,811,486 | A | 3/1989 | Cunningham |
| 5,027,994 | A | 7/1991 | Lee |
| 5,114,257 | A | 5/1992 | Hsu |
| 5,184,765 | A | 2/1993 | Orozco |
| 5,331,741 | A | 7/1994 | Taylor, Jr. |
| 5,584,124 | A | 12/1996 | Marthaler et al. |
| 5,655,697 | A | 8/1997 | Yeh |
| 5,896,665 | A | 4/1999 | Harris |

FOREIGN PATENT DOCUMENTS

| | | |
|---|---|---|
| GB | 10067 | 4/1897 |
| GB | 140515 | 12/1918 |
| GB | 2 186 227 A | 8/1987 |
| GB | 2196896 A | 4/1988 |
| JP | 41-22884 | 11/1941 |
| JP | 53-71379 | 6/1978 |
| JP | 53-71380 | 6/1978 |
| JP | 2-19484 | 2/1990 |
| JP | 08112781 A | 5/1996 |
| WO | WO 84/01739 | 5/1984 |
| WO | WO 86/01449 | 3/1986 |
| WO | WO 94/17963 | 8/1994 |
| WO | WO 95/1113 | 4/1995 |
| WO | WO 97/04924 | 7/1996 |
| WO | WO 98/32570 | 7/1998 |

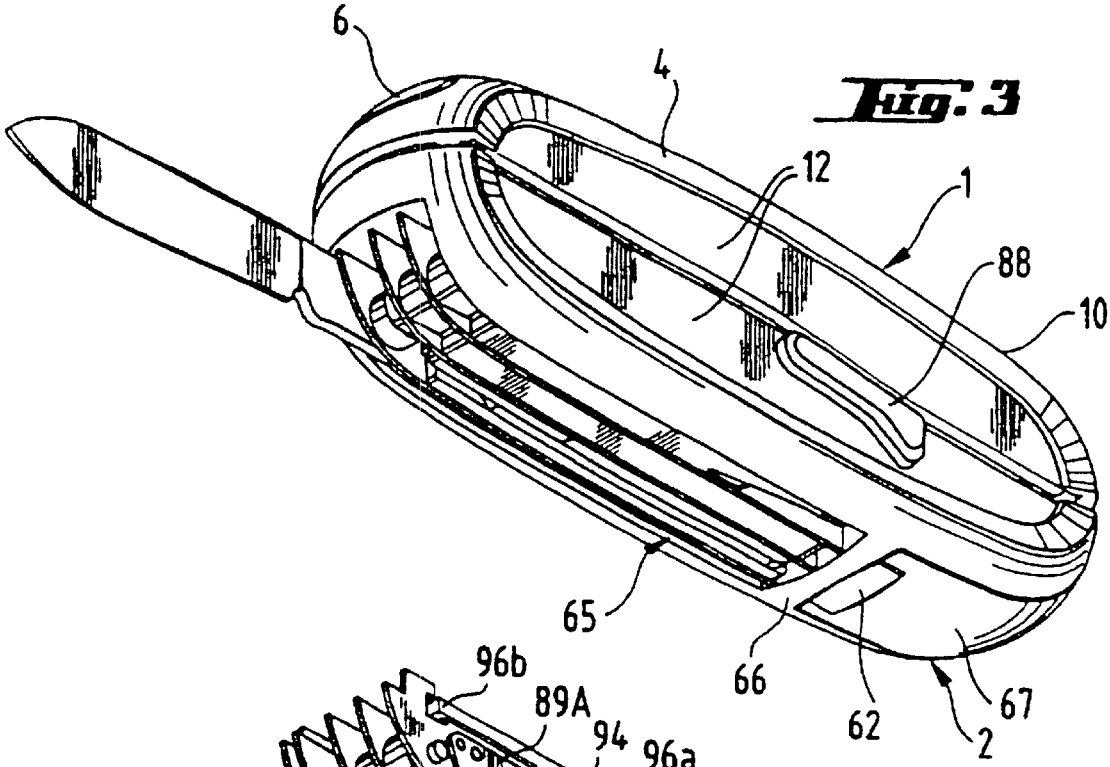
Fig. 3
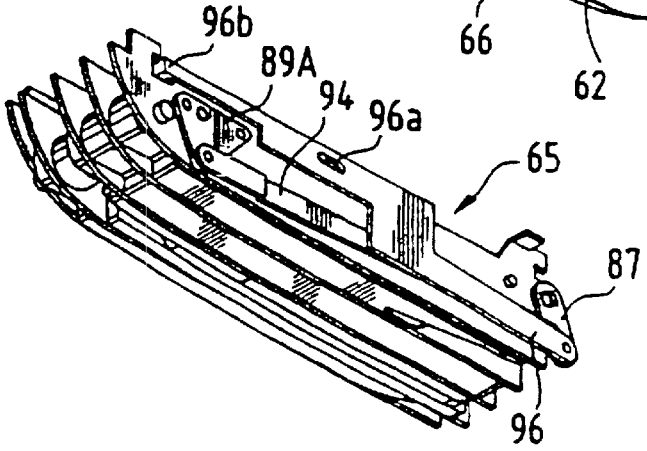
Fig. 4
Fig. 5
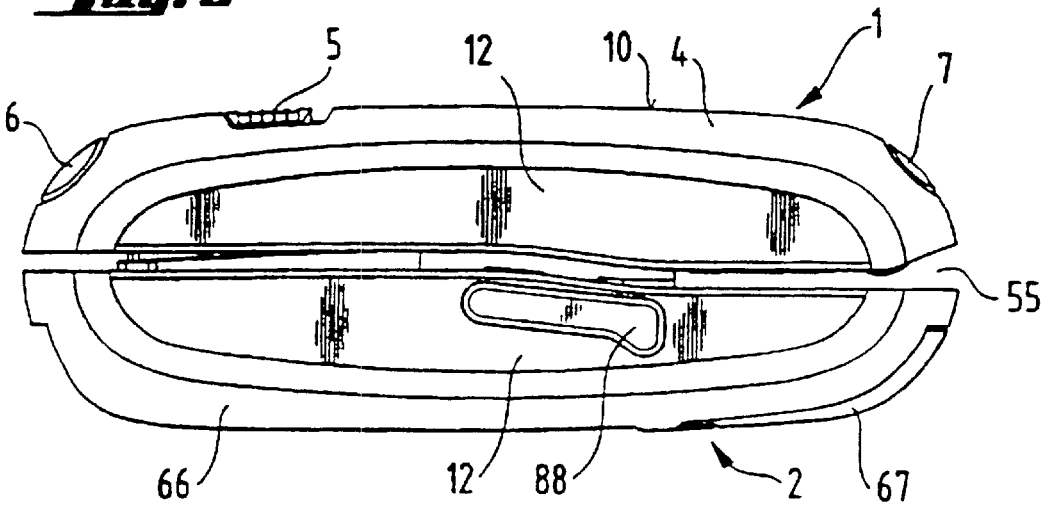

1
8
9
4
17
12
12
18
31
88
88
2
66
65

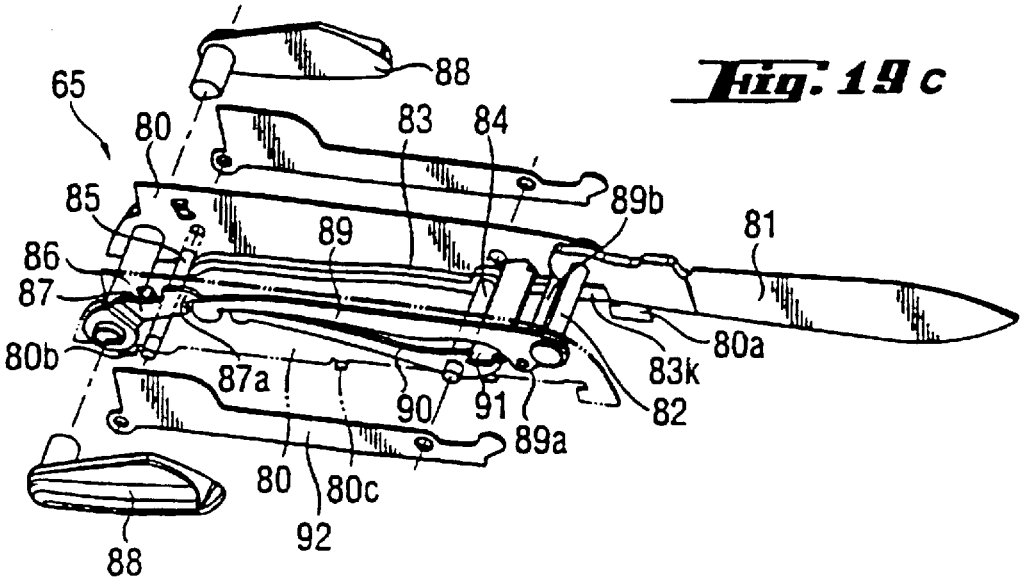
Fig. 19c
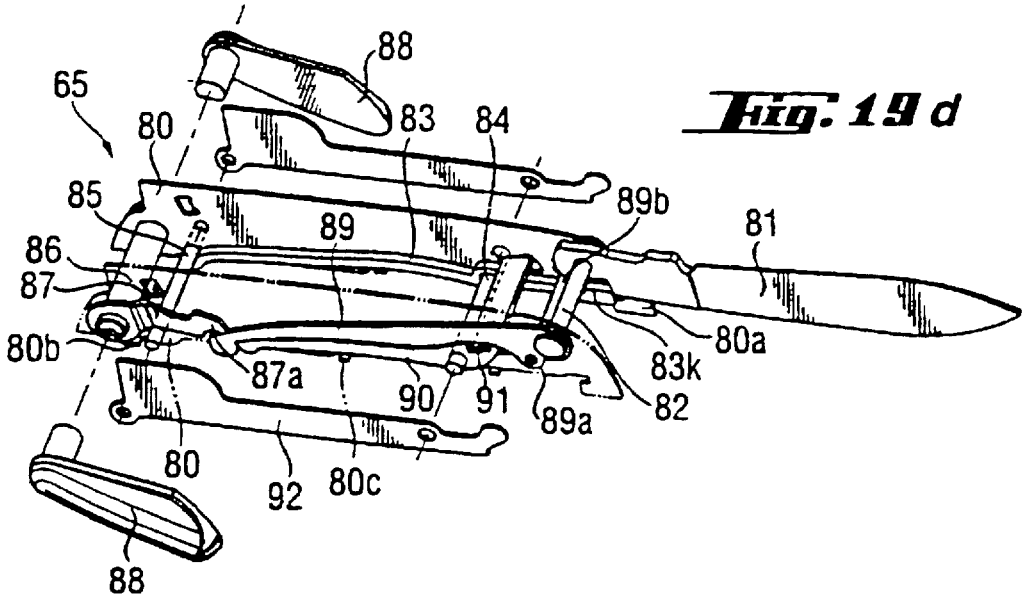
Fig. 19d
Fig. 20b
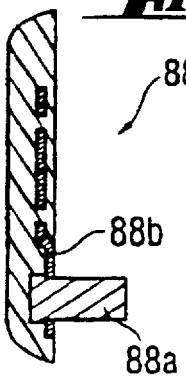
Fig. 20a
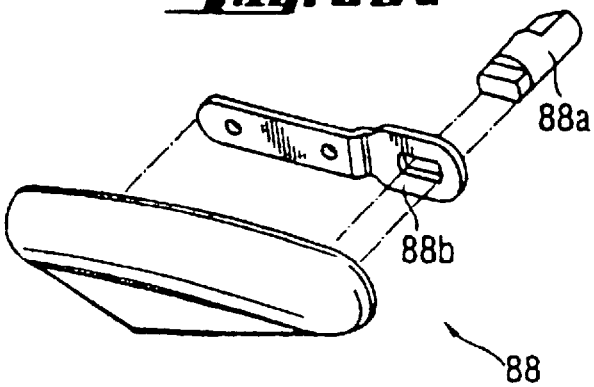

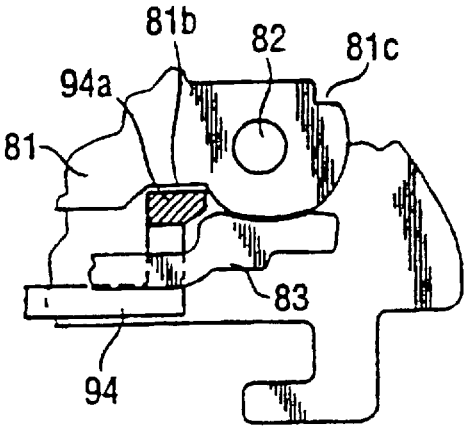
Fig. 22a
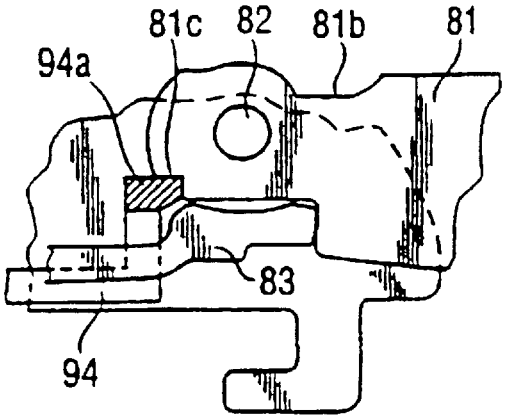
Fig. 22c
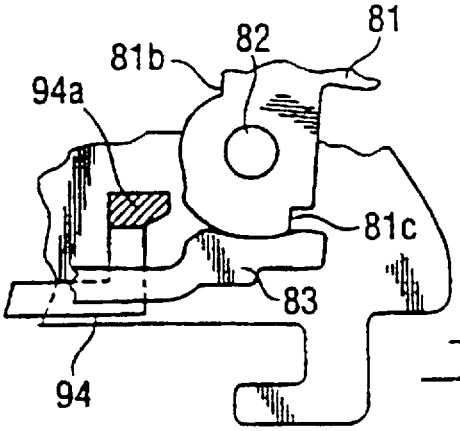
Fig. 22b
Fig. 28
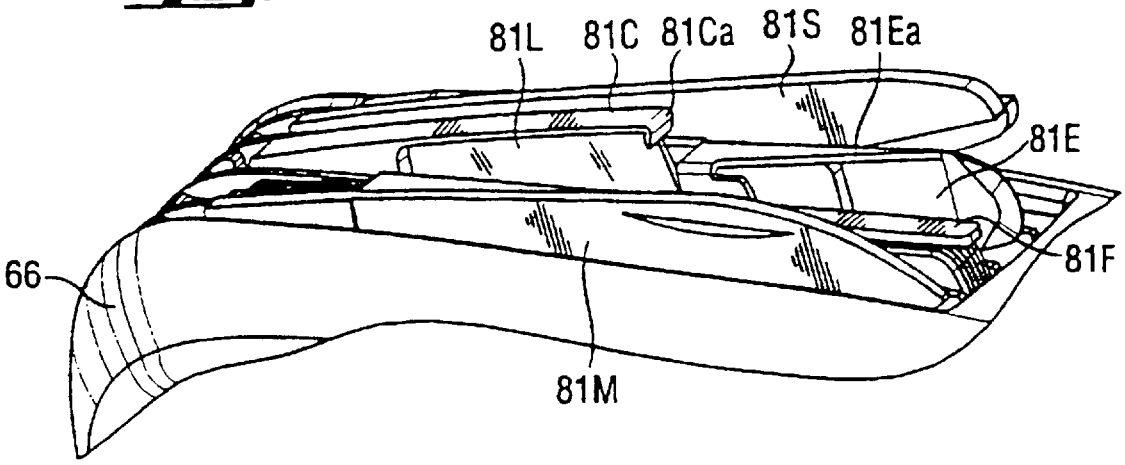

Fig. 23a
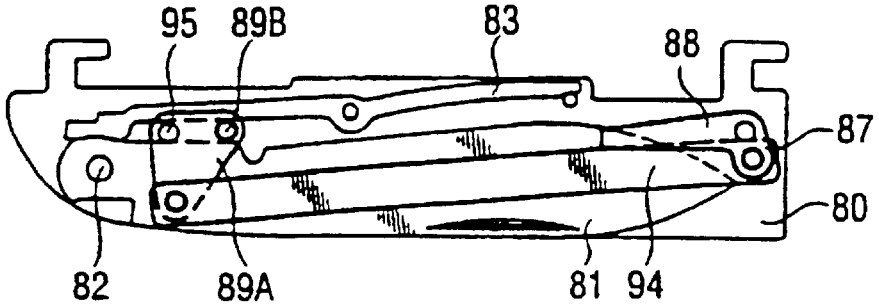
Fig. 23b
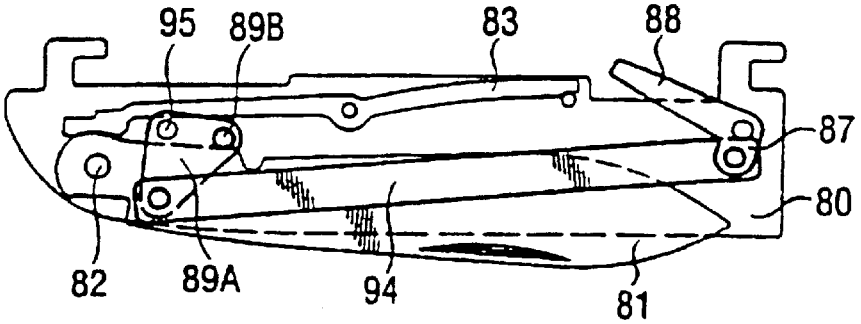
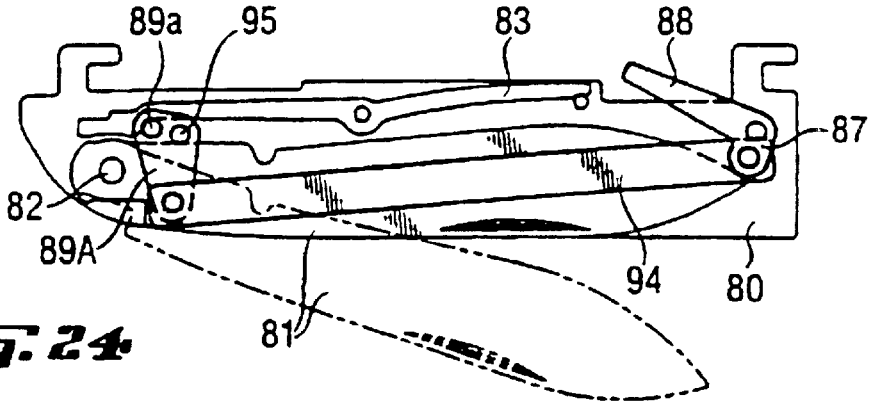
Fig. 24
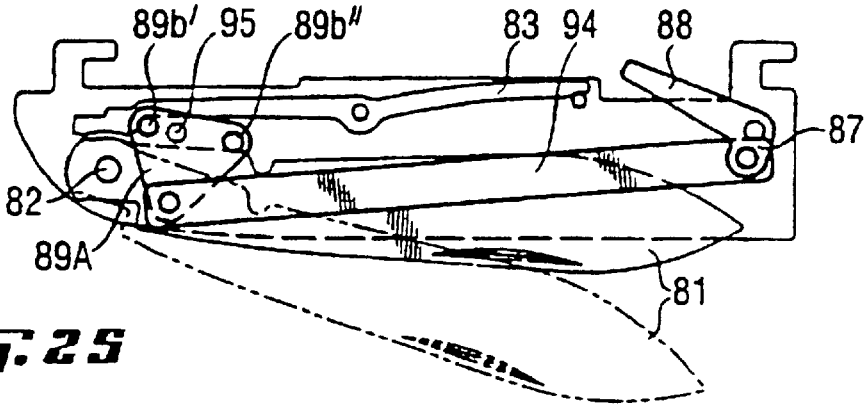
Fig. 25

Fig. 40b
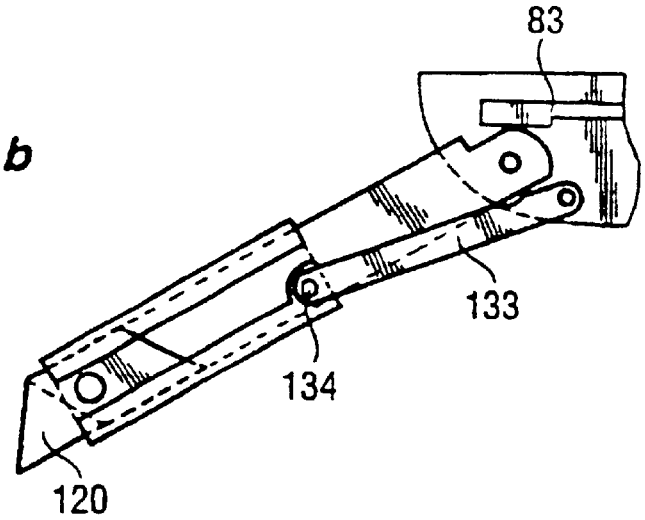
Fig. 41a
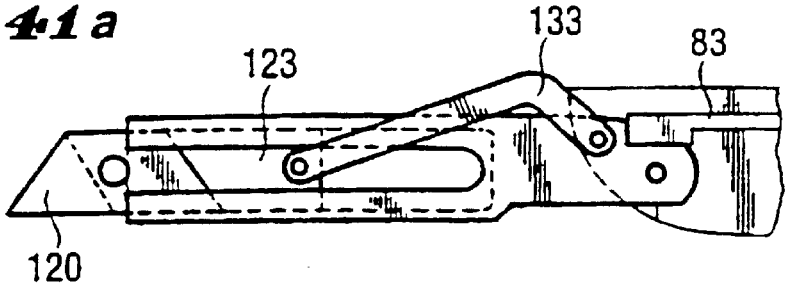
Fig. 41b
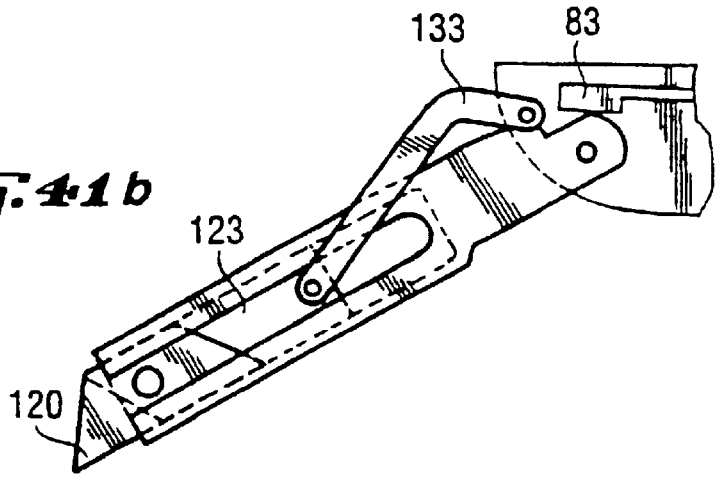
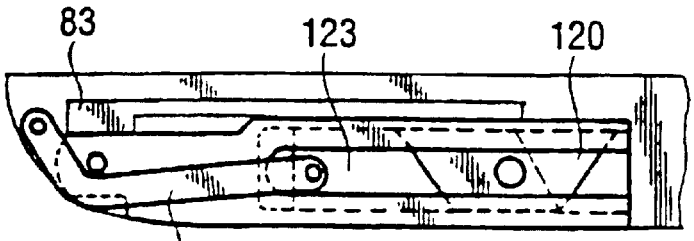
Fig. 41c

Fig. 51 a
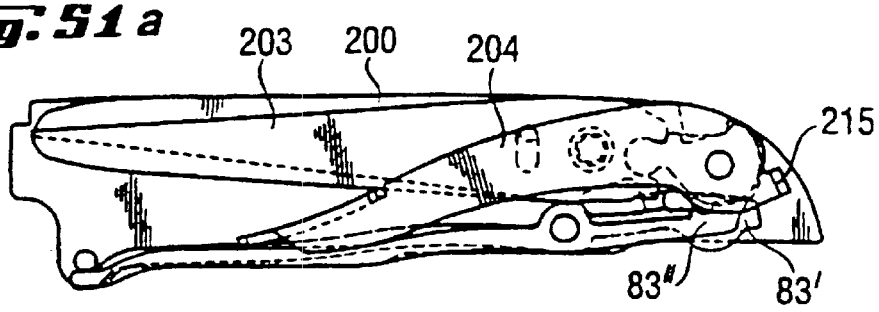
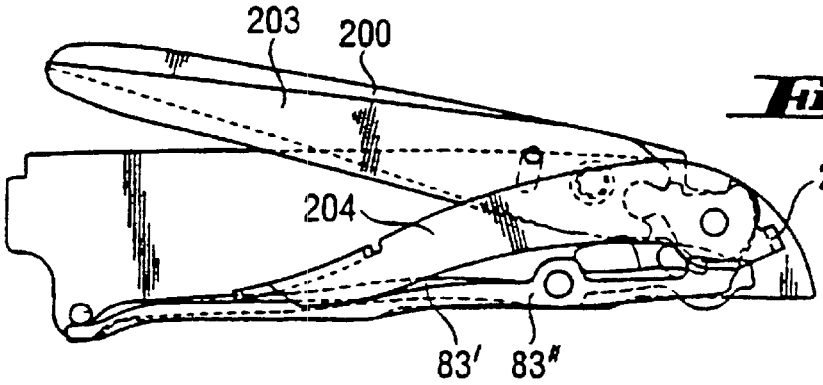
Fig. 51 b
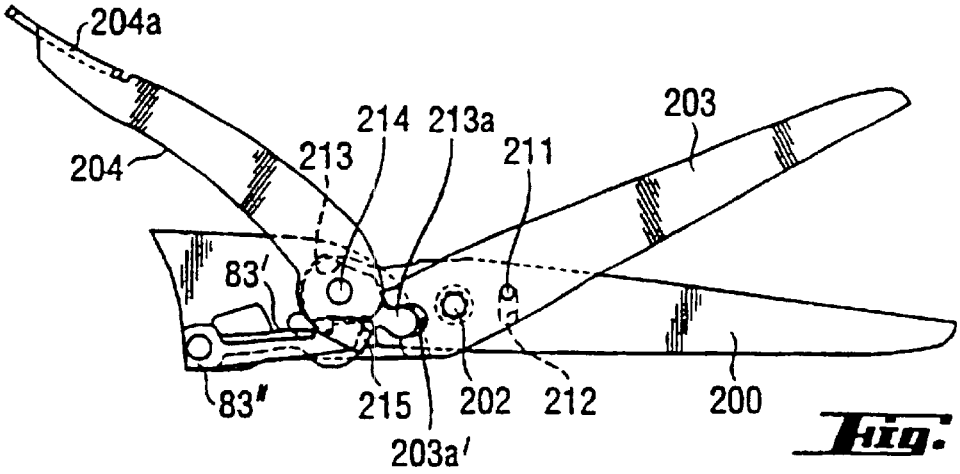
Fig. 51 c
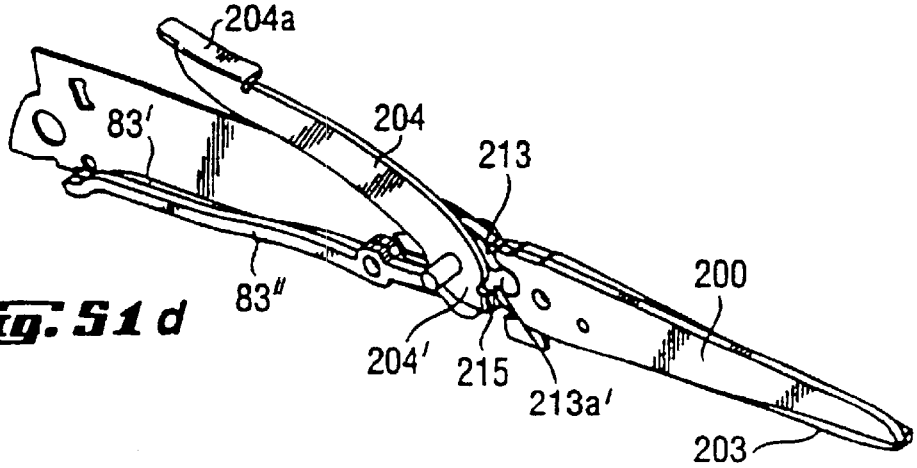
Fig. 51 d 311
306
310
305
309
313
304
308
303
300
307
301

312

302

MULTIPURPOSE HAND DEVICE

The invention relates to a multipurpose handheld implement.

WO 98/32570 has disclosed a multipurpose handheld implement which comprises two members which are moveably—preferably in an articulated manner—connected to one another and, in a closed position, can be locked to one another in such a manner that this locking can be released manually, in which closed position, together with substantially congruent contours, they form an elongate, essentially closed-off cuboidal body, the two members having base surfaces which face towards one another. Both members may contain functional elements of a stapler and/or hole puncher. Furthermore, the multipurpose handheld implement may have further utensils such as those which are generally required for office work, such as for example a pair of scissors, a staple remover, a knife, a cutter, a magnifying lens, a ruler, etc. In an operating position, there is a distance between the members which is such that, if a stapler or hole puncher is present, it is possible to insert paper which is to be stapled and/or punched. One member may comprise a staple magazine and a staple driver of a stapling mechanism, while the other may comprise a stapler anvil. Alternatively, or in addition, the second member comprises a hole-puncher mechanism, the actuating lever of which is arranged in the first member.

Two basic designs are provided for this multipurpose handheld implement, namely an "integrated" variant and a "modular" variant. In the integrated variant, all the parts are installed successively in an order which is determined by the most expedient working sequence. In the modular variant, a stapler module and/or a hole-puncher module and a utensils module are each prefitted, joined and provided with covers.

FIG. 1 shows a perspective view of an implement 800 as described in WO 98/32570, including a stapler and hole-puncher mechanism, in the portable state, i.e. closed with all the utensils in the folded-in position. Utensils in the form of tools such as knife 802, scissors 804 and staple remover 806 can be folded out of a receiving space, which is provided in the bottom member of the multipurpose handheld implement, about a common pivot pin 808. The receiving space for the utensils is covered by a cover 812 which is substantially flush with the outer contour of the multipurpose handheld implement. Normally, only one tool is folded out, and for ease of handling the cover 812 is then closed. In FIG. 2, the cover 812 is open, the knife 802 is folded out and the staple remover 806 is shown in a position in which it is pivoted through only 90°. Springs (not shown) may be provided for the purpose of keeping the utensils preloaded in their storage position or their use position. This multipurpose handheld implement may be modified in such a way that the cover 812 pivots about an axis which is parallel to the longitudinal axis of the implement. A spring preloads the cover into the open position, and a lock secures it in the closed position. The cover 812 could also be omitted or could be designed as a sliding cover, for example in the form of a shutter.

The object of the invention is to provide a multipurpose handheld implement whose design and handling is simplified and/or functionality is improved.

Subjects of the invention are defined in the independent claims.

Further refinements, objects and advantages of the invention are given in the following description and the dependent claims.

The invention is explained in more detail below with reference to exemplary embodiments illustrated in the appended drawings, in which:

FIG. 3 shows a perspective view of one embodiment of a multipurpose handheld implement according to the invention with a utensil which has been folded out.

FIG. 4 shows a utensil module for the multipurpose handheld implement in accordance with FIG. 3.

FIG. 5 shows a side view of the multipurpose handheld implement in accordance with FIG. 3.

FIG. 7 shows an exploded view of the multipurpose handheld implement shown in FIG. 3.

Figures 11, 12A:
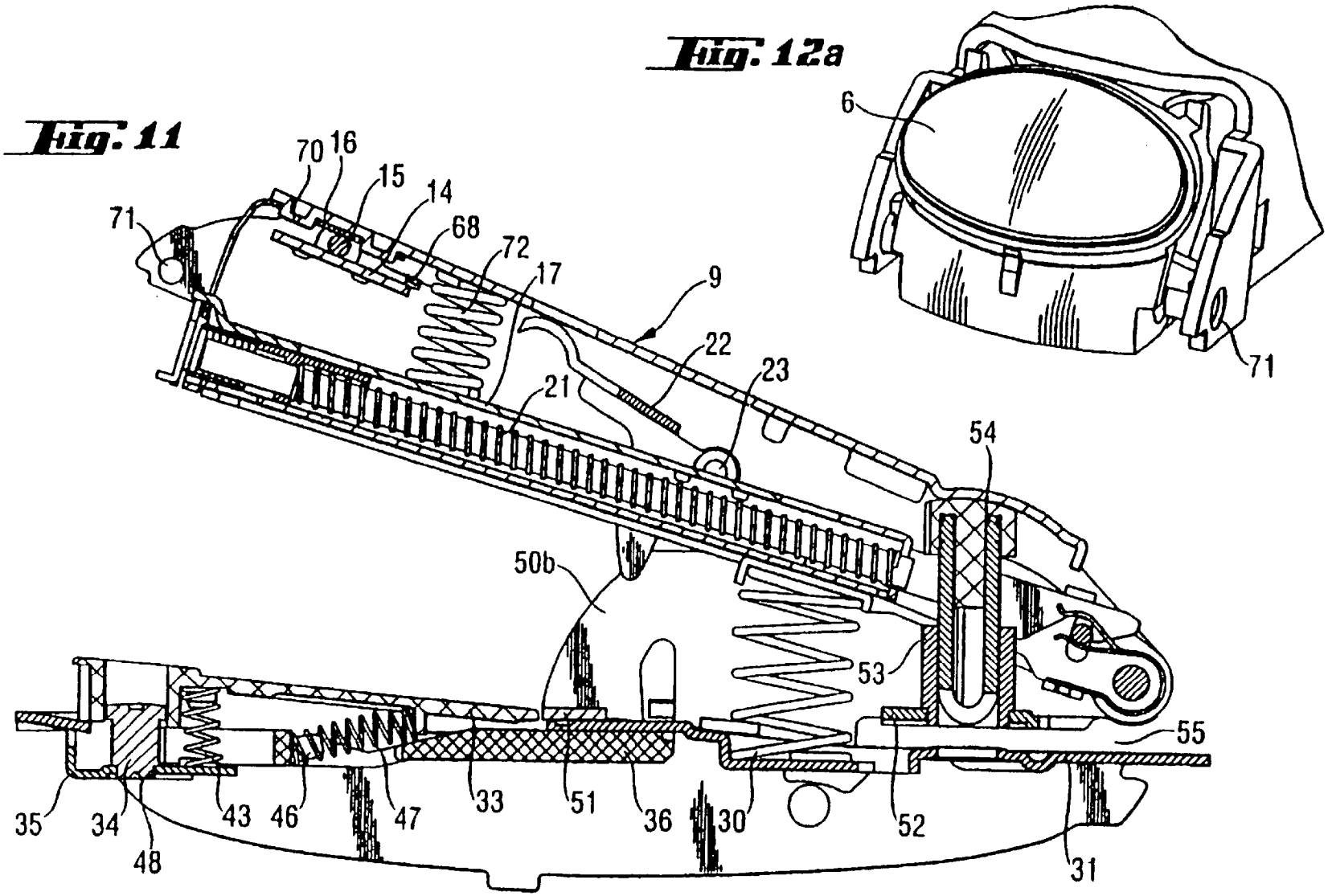
FIG. 11 shows the multipurpose handheld implement from FIG. 10 with its stapler moved into the operating position.

FIG. 12*a* shows a perspective view of one embodiment of a stapler release button.

Figure 12:
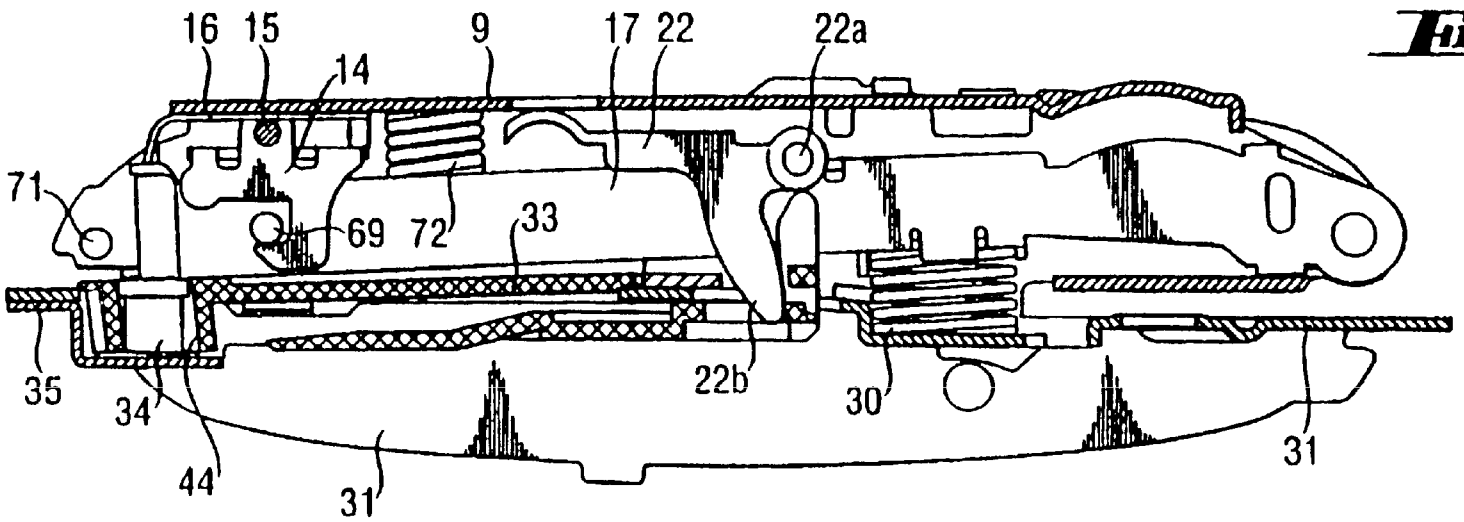
FIGS. 12 and 13 show excerpts, partially in section, of the multipurpose handheld implement from FIG. 9 in side view, with different parts illustrated compared to FIG. 9, and in plan view.
Figure 13:
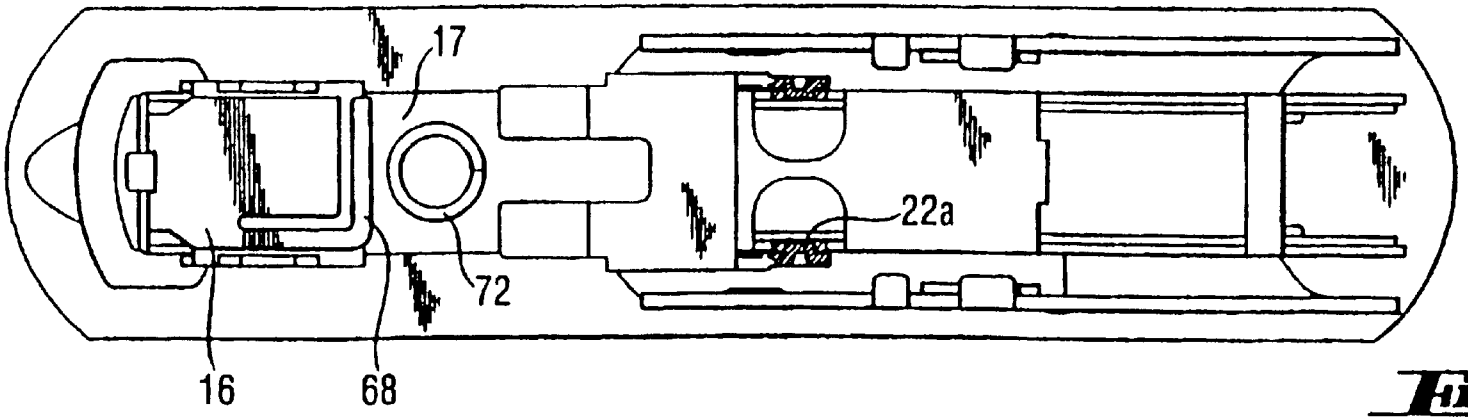
Figure 14:
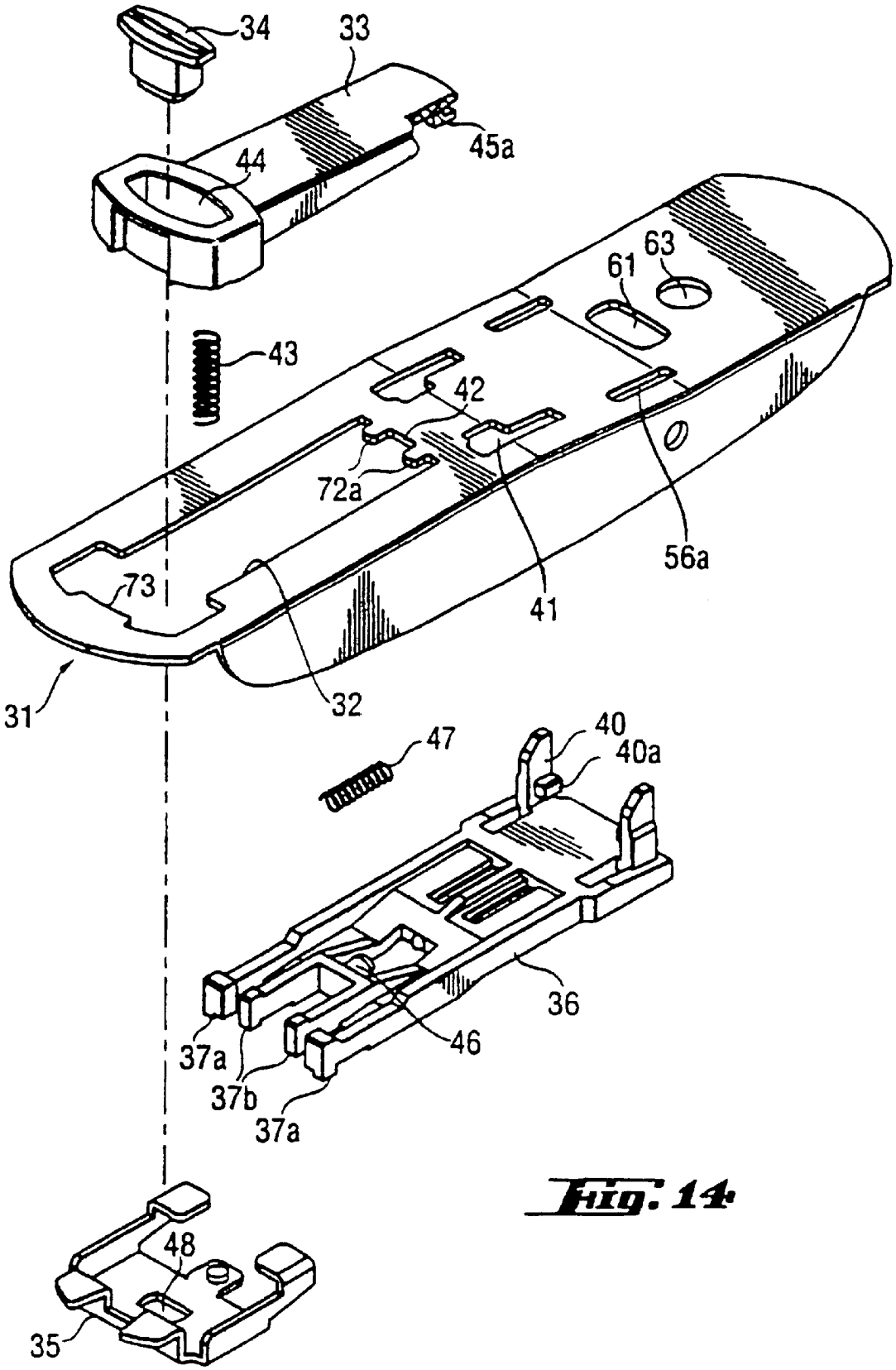

FIG. 14 shows an exploded view of parts of a flat-clinch mechanism, which together are accommodated in one member of the multipurpose handheld implement in the embodiment shown in FIGS. 9 to 13.

Figure 15A:
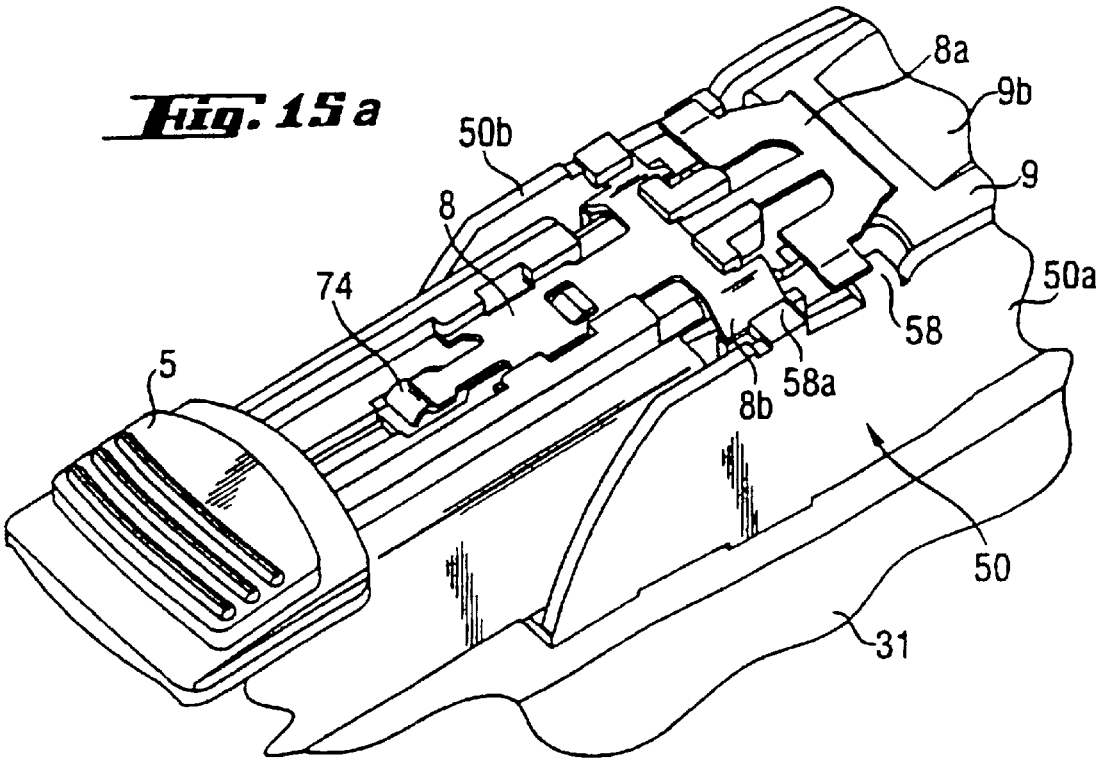
Figure 15B:
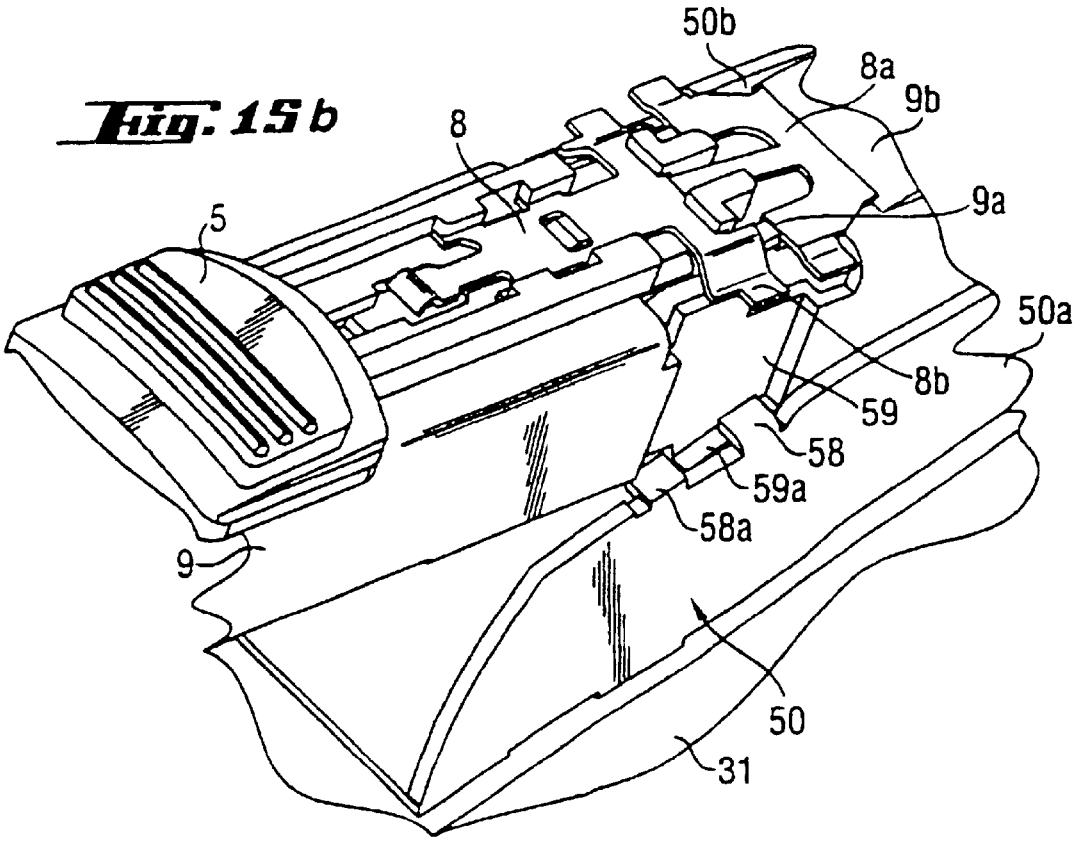

FIGS. 15*a* and *b* show perspective views of an excerpt relating to the member locking arrangement for the multipurpose handheld implement in the embodiments shown in FIGS. 9 to 13.

Figure 16A:
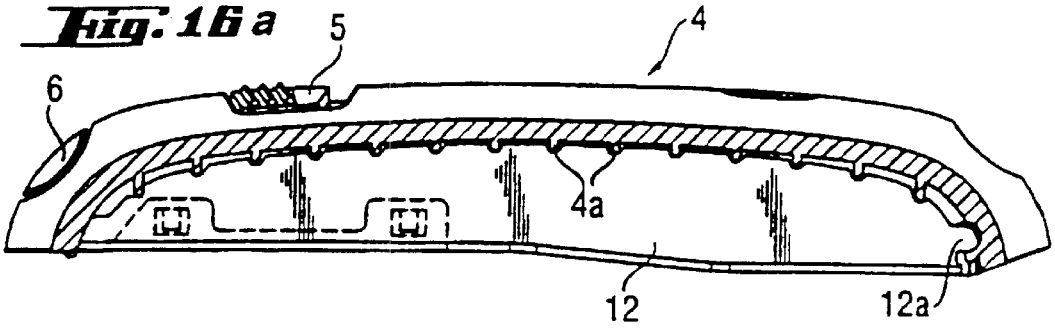
Figure 16B:
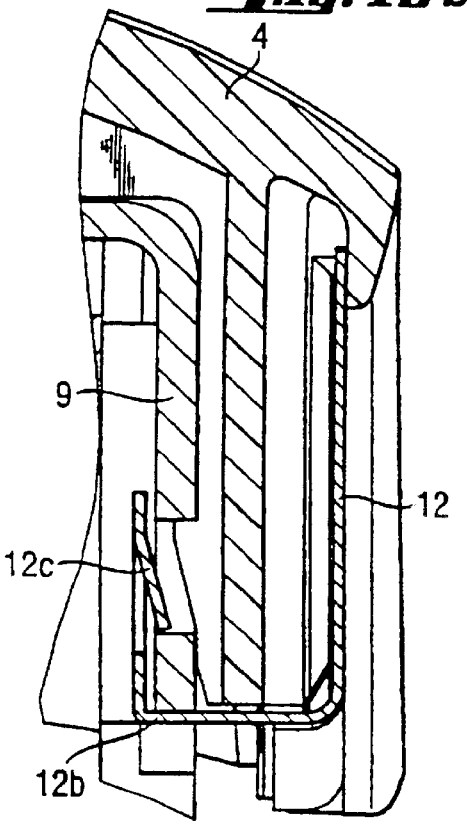

FIGS. 16*a* and *b* show an outer casing for a member of the multipurpose handheld implement.

Figure 17B:
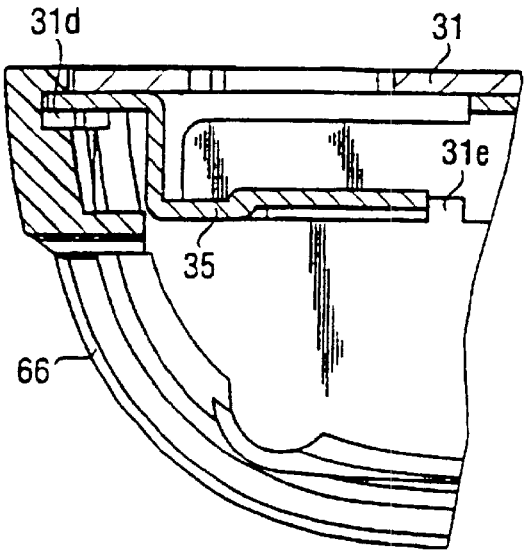
Figure 17A:
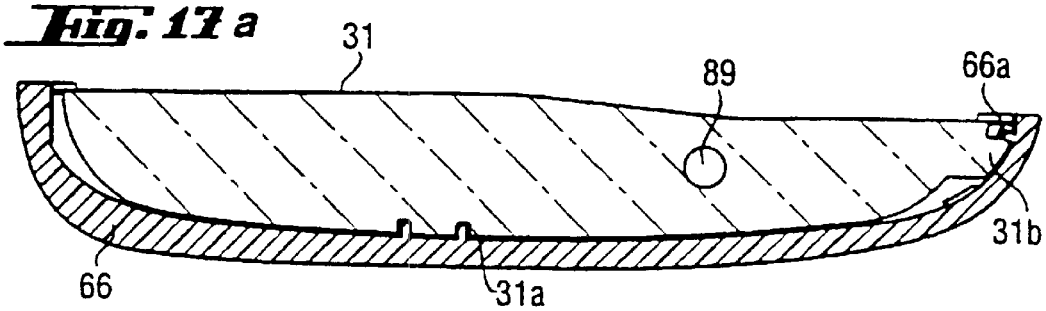

FIGS. 17*a* and *b* show an embodiment relating to a connection between an outer casing and another member of the multipurpose handheld implement.

Figure 18B:
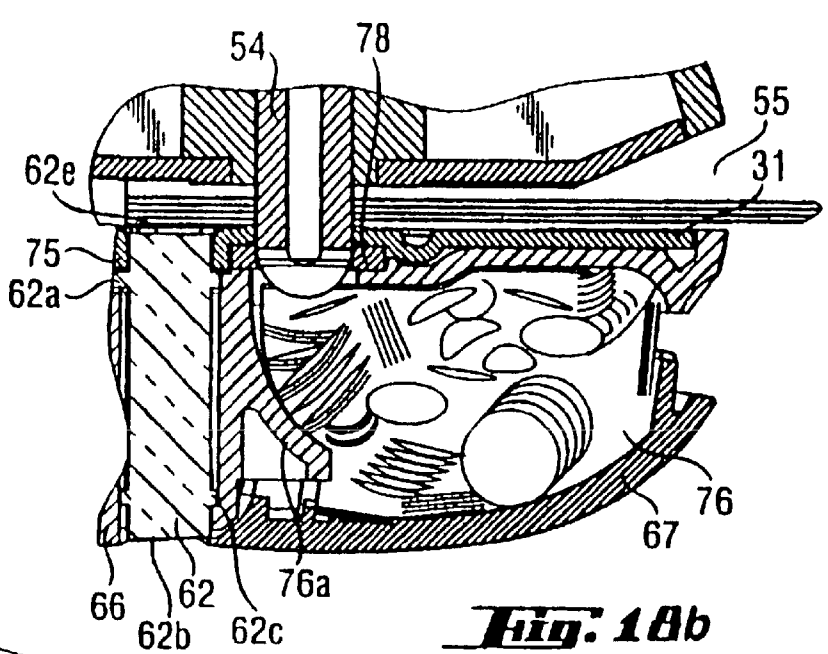
Figure 18A:
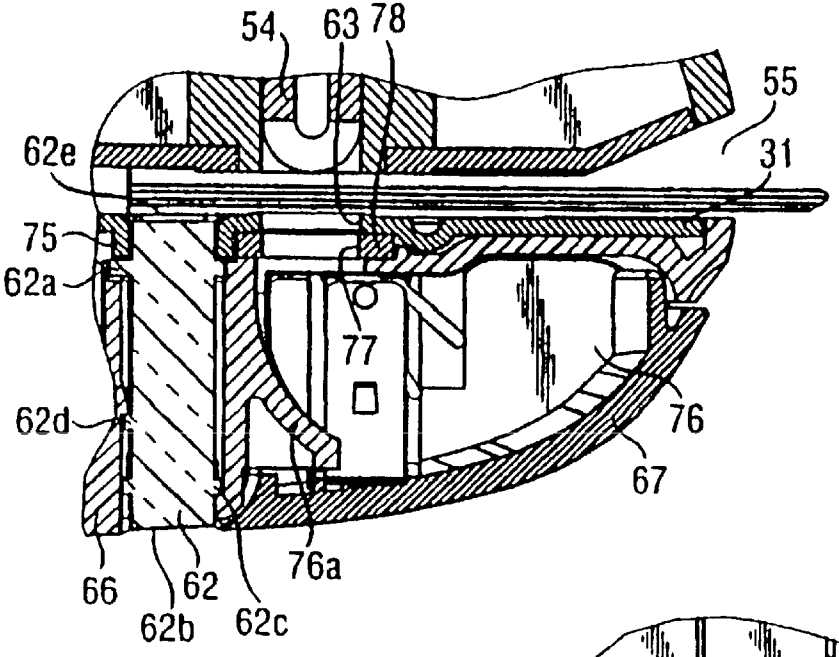
Figure 18C:
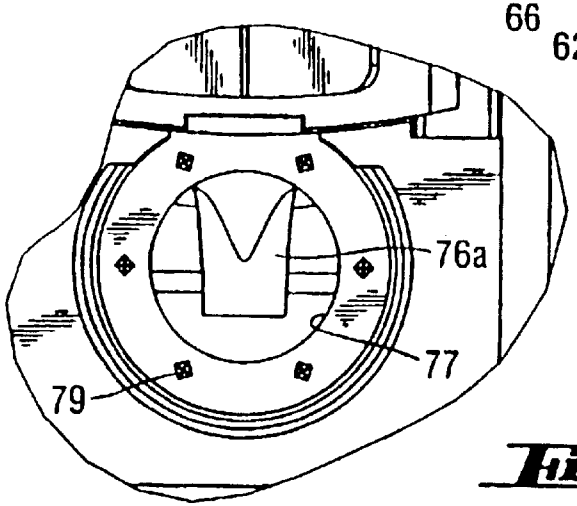

FIGS. 18*a* to *c* show a sectional view of an arrangement of a light guide and a retaining ring for a confetti compartment of a hole puncher of the multipurpose handheld implement.

Figure 19A:
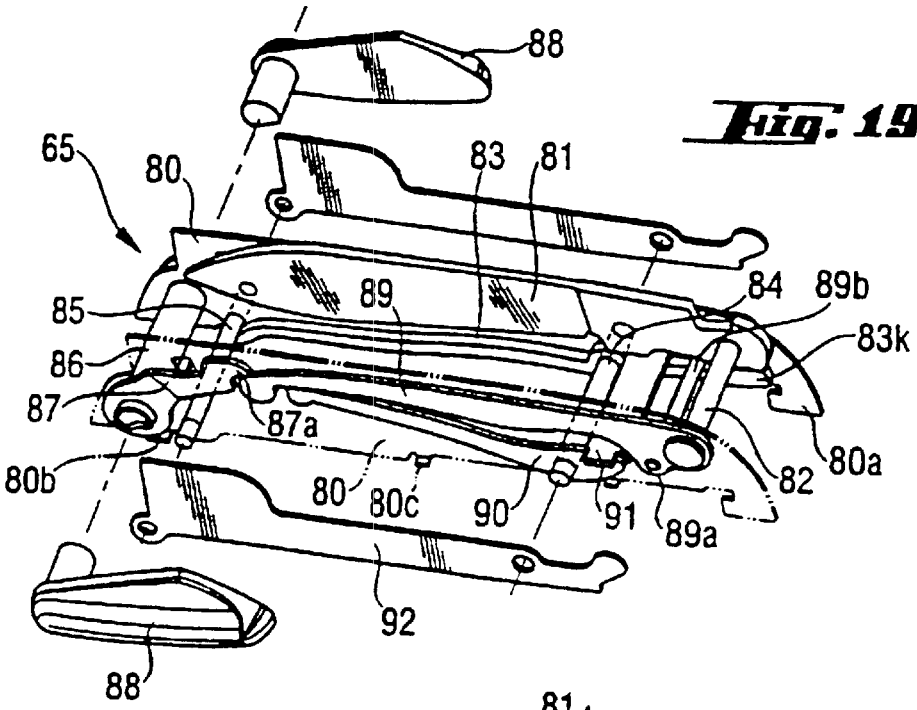
Figure 19E:
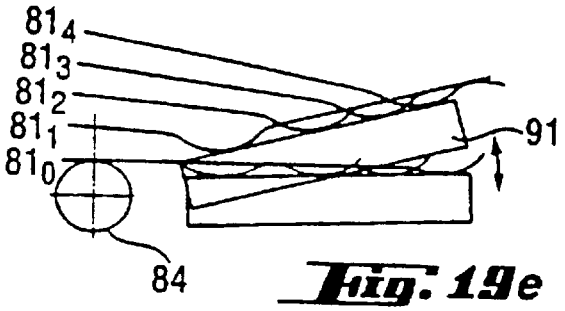

FIGS. 19*a* to *d* show a utensil module with lifting and unblocking device for the utensils for the multipurpose handheld implement in various positions, and FIG. 19*e* shows a particular design of utensils for this module.

FIGS. 20*a* and *b* show a detail from FIGS. 19*a* to *d*.

FIGS. 21*a* to *d* show an alternative embodiment to that shown in FIGS. 19*a* to *d*.

FIGS. 22*a* to *c* show a further alternative embodiment to that shown in FIGS. 19*a* to *d*.

FIGS. 23*a* and *b* show a further embodiment of a lifting device for utensils, in two positions.

FIGS. 24 and 25 each show a further embodiment of an unblocking or a combined lifting and unblocking device for utensils, in two positions.

Figure 26A:
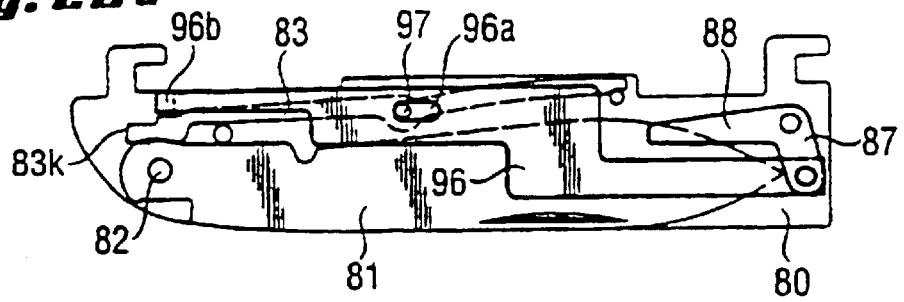
Figure 26B:
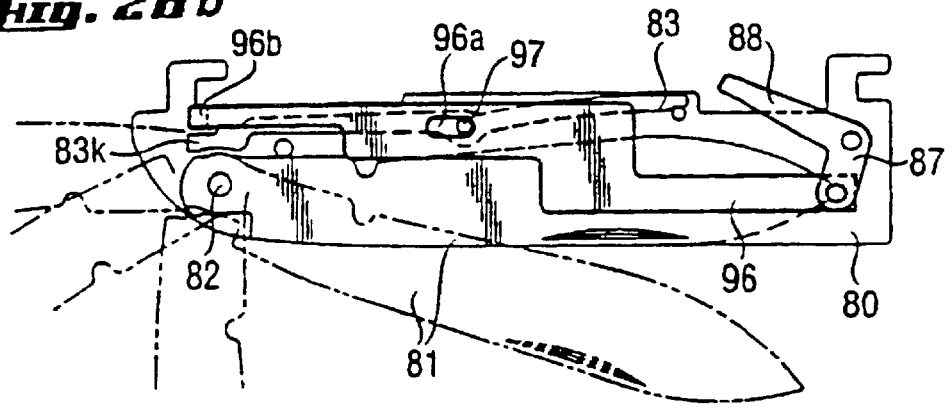
Figure 26C:
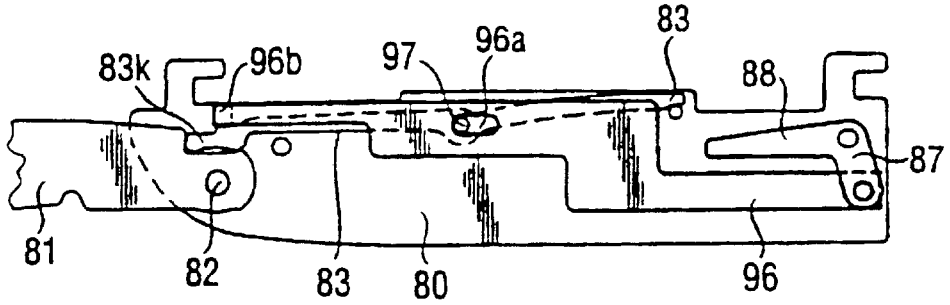

FIGS. 26*a* to *c* show an embodiment of an unblocking device for utensils, in a plurality of positions.

Figure 27:
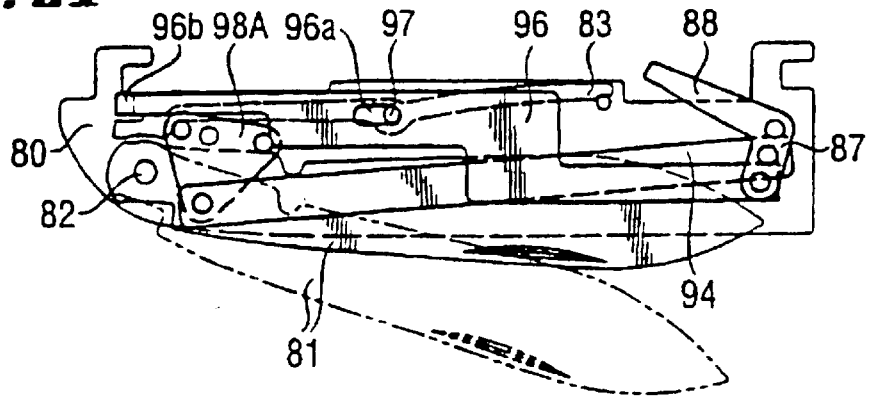

FIG. 27 shows a device in accordance with FIG. 26 with an additional lifting device for utensils.

FIG. 28 shows a perspective view of parts of a multipurpose handheld implement with lifted utensils.

FIGS. 29*a* to *d* show four different arrangements of utensils in a multipurpose handheld implement.

FIGS. 30*a* to 30*d* show a folding ruler as a fold-out utensil, in various positions and partially in section.

Figure 30A:
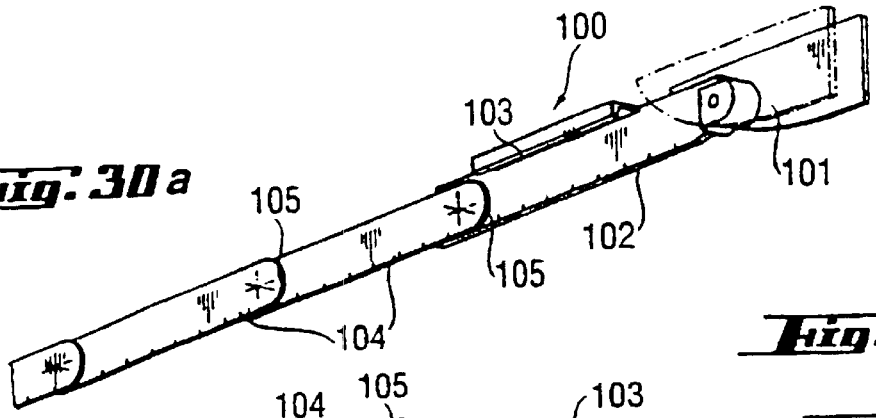
Figure 30B:
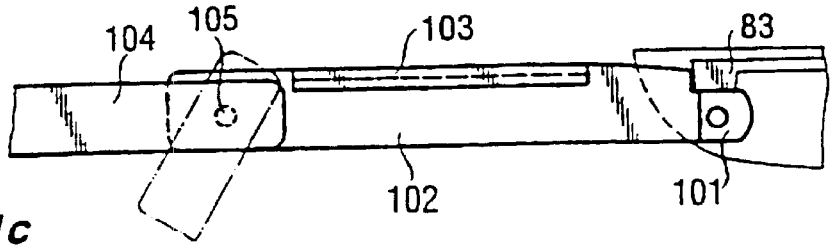
Figure 30C:
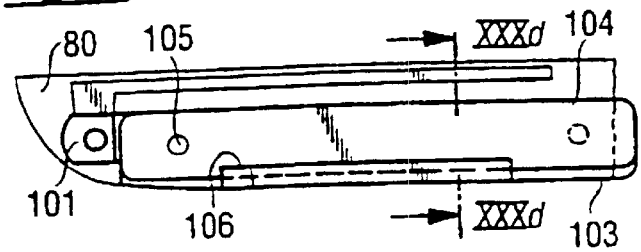
Figure 30D:
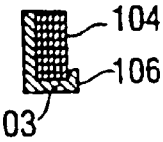
Figure 31B:
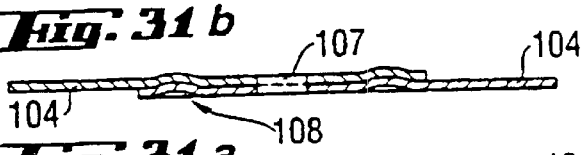
Figure 31A:
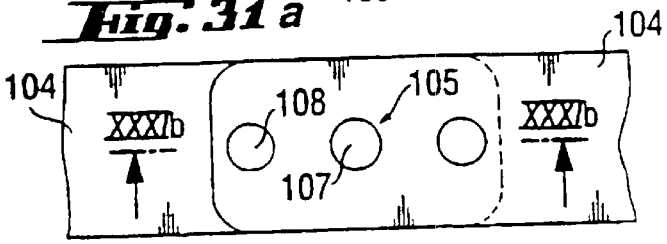
Figure 33B:
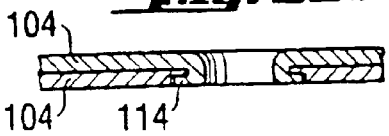
Figure 32B:
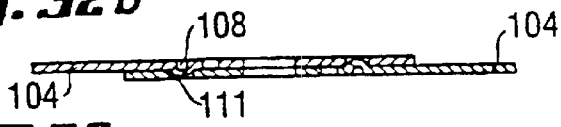

FIGS. 31*a, b*, 32*a, b*, 33*a, b* and 34*a, b* show linkage and catch formations for a folding ruler in accordance with FIGS. 30*a* to 30*d*.

Figure 35A:
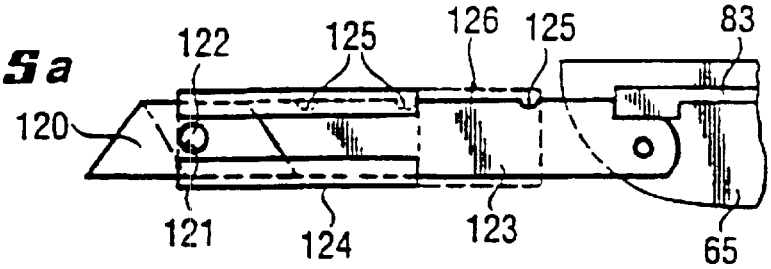

FIGS. 35*a, b*, 36*a, b*, 37*a, b*, 38*a, b*, 39*a, b*, 40*a, b, c* and 41*a, b, c* show various embodiments of a cutter as a fold-out utensil in various positions.

Figure 42A:
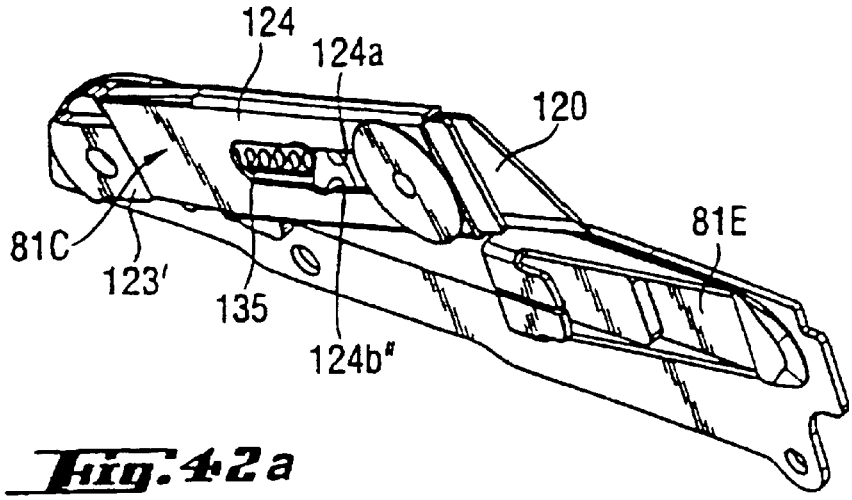

FIGS. 42*a, b* and *c* show a further embodiment of a cutter in perspective form, in exploded form and as an excerpt in section.

FIGS. 43*a* to 43*e* show a staple remover as a fold-out utensil, in various positions.

FIGS. 44*a* to 44*e* show nested fold-out utensils, in various positions.

FIGS. 45*a* to 45*f* and 46*a* and *b* each show a combined fold-out utensil, in various positions.

Figure 47:
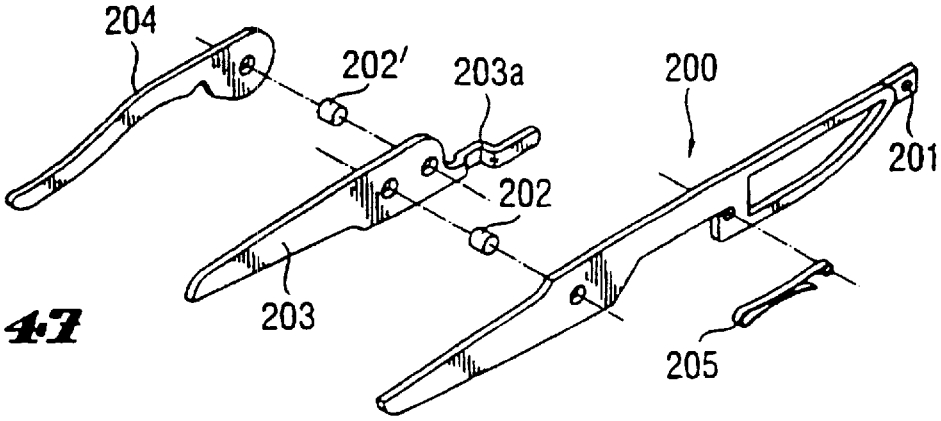

FIG. 47 shows an exploded view of a pair of scissors as a fold-out utensil.

FIGS. 47*a* to *c*, 48*a* to *c*, 49*a* to *c* and 50*a* to *c* each show an embodiment of a pair of scissors which can be folded out, in each case in three different positions.

FIGS. 51*a* to *d* shows [sic] an additional embodiment of a pair of scissors which can be folded out, in various positions.

FIGS. 52*a* to *e* shows [sic] a laser pointer as a fold-out utensil in various positions and in a perspective view.

Figure 1:
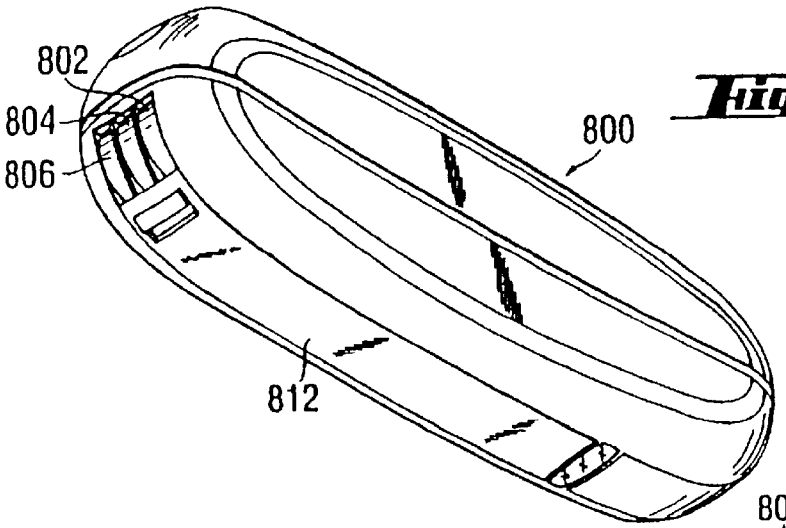
FIG. 1 shows a perspective view of a first embodiment of a multipurpose handheld implement in accordance with WO 98/32570.
Figure 2:
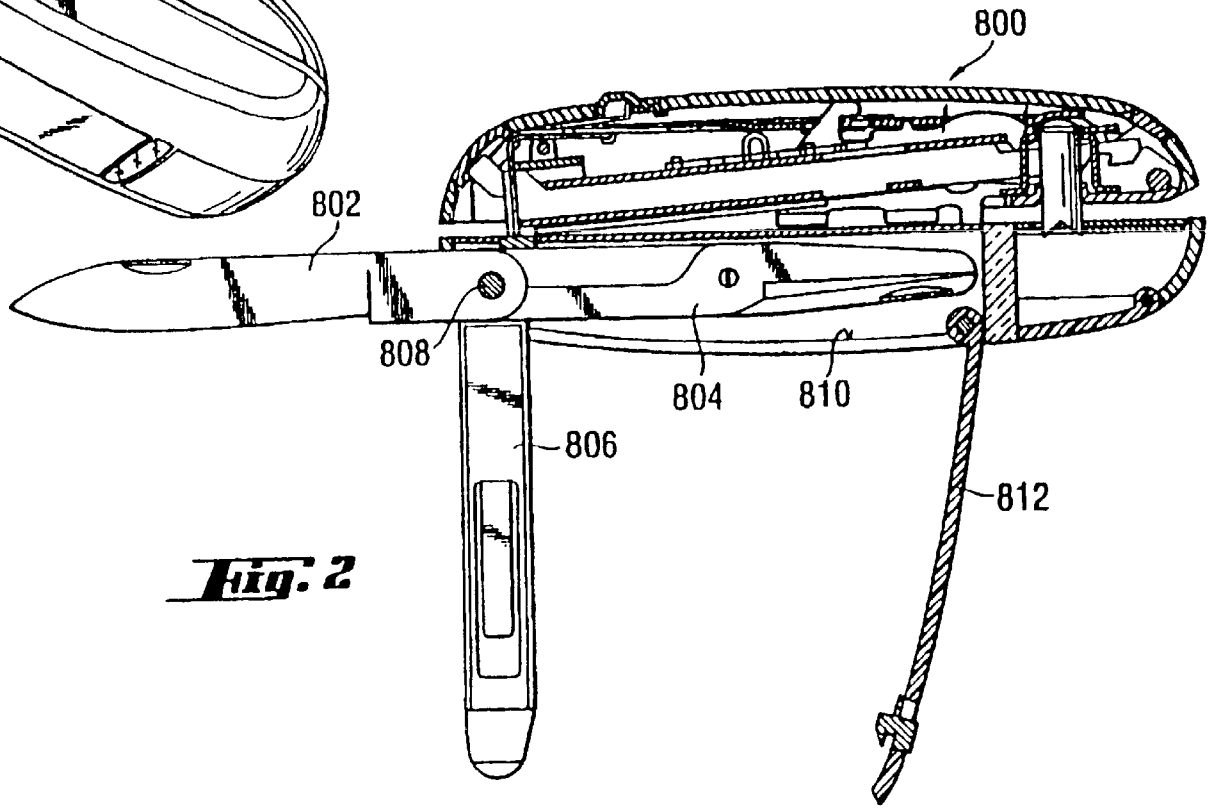
FIG. 2 shows a longitudinal section through the multipurpose handheld implement shown in FIG. 1.
Figure 6:
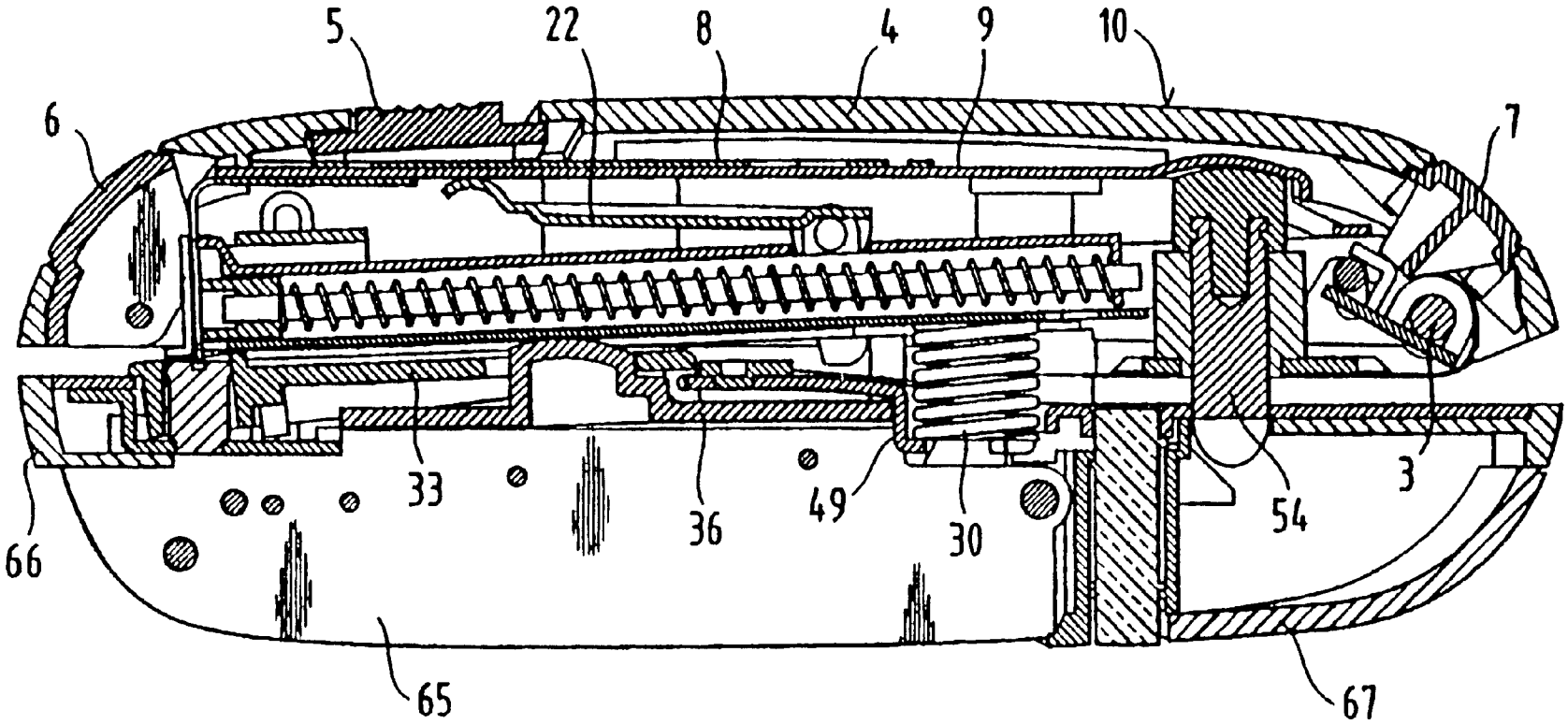
FIG. 6 shows a longitudinal section through the implement from FIG. 3.
Figure 1:
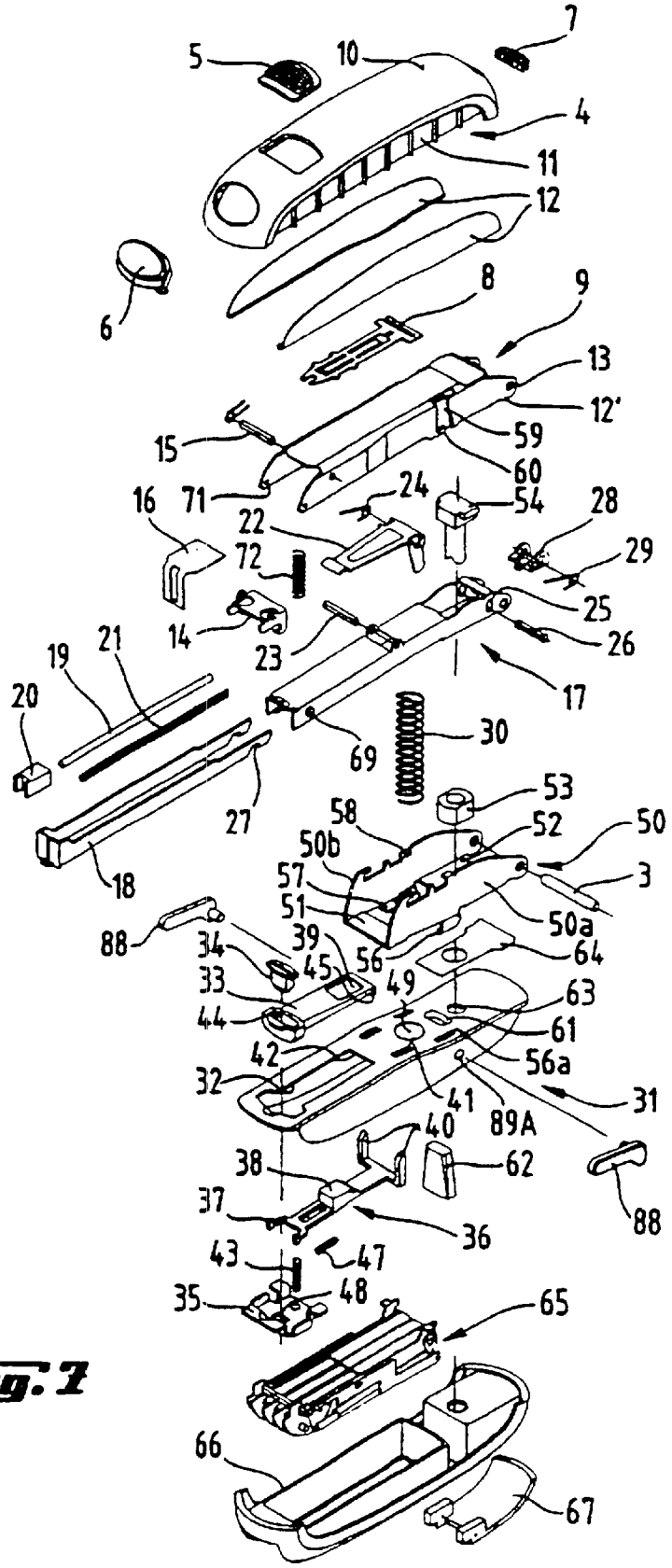

A first exemplary embodiment of a multipurpose handheld implement which is of modular structure and has a stapler/hole puncher assembly and a utensil module which is inserted into the latter as a separate assembly is illustrated in FIGS. 3 to 8; the multipurpose handheld implement may moreover be of corresponding structure to that shown in FIGS. 1 and 2.

In this arrangement, two members 1 and 2 are provided, which are articulatedly connected to one another by means of a principal pin 3, so that they can move between two relative positions, a closed position and an open position.

Member 1 has an outer shell 4 made from a plastics material, in which cutouts are provided for an opening button 5, a stapler release button 6 and a staple magazine button 7 to pass through. The opening button 5 interacts with a leaf spring 8 which is guided in a longitudinally displaceable manner on a top part 9 and keeps the two members 1, 2 locked in their closed position. The outer shell 4 has a curved covering surface 10 and planar side walls 11 which are slightly set back and are covered by screens 12. The top part 9 has lugs 12' with bearing holes 13 through which the principal pin 3 passes in the fitted state. A locking hook 14 for the stapler release button 6 is mounted on the top part 9 by means of a peg 15, in front of which a staple driver 16 is attached. The top part 9, the cross section of which is in the form of an inverted U, contains a staple channel part 17, which can likewise pivot about the principal pin 3 and in which a staple magazine 18 is guided in a longitudinally displaceable manner. The top part of the stapling mechanism is completed by a bar 19, a pressure-exerting member 20 and a compression spring 21. The detailed structure is described in WO 98/32570. On the staple channel part 17, a blocking release lever 22 of a "flat-clinch mechanism" is mounted in such a manner that it can pivot about a pin 23 and is preloaded into a blocking position by a spring 24. Finally, the staple channel part 17 also has aligned slots 25 in which a lock-release peg 26 is displaceably guided. The lock-release peg 26 engages in a latch 27 of the staple magazine 18 and can be displaced into its release position by a tilting lever 28, which is normally held in a locking position by a spring 29, when the staple magazine button 7 is pressed. The tilting lever 28 is also mounted on the principal pin 3.

The member 1 described above is supported on the member 2 illustrated at the bottom by way of the staple channel part 17 and a principal spring 30.

The member 2 comprises a bottom part 31, which is angled off in the form of an inverted U and also has a height offset between the stapler side and the hole-puncher side. On the stapler side, there is an aperture 32 for receiving a stapler platform 33 and an anvil 34. Beneath the aperture 32 there is a support plate 35 on which the anvil 34 is supported. The fork-shaped front end 37 of a blocking slide 36 projects into the space between the support plate 35 and the bottom part 31. A release button 38 projects through a corresponding aperture 39 in the stapler platform 33. Finally, actuating arms 40 of the blocking slide 36 extend upwards, through apertures 41 in the bottom part 31, into the path of the blocking-release lever 22 when the latter is diverted.

The structure of the "flat-clinch arrangement" in the member 2 is illustrated and described in more detail in WO 98/32570. With such an arrangement, the stapler platform 33 ensures that when a staple is ejected from the staple magazine 18 of the staple channel part 17, its legs initially penetrate through the material to be stapled without coming into contact with the anvil 34; only when the blocking-release lever 22, which senses the relative angle between the top part 9 and staple magazine 18, has displaced the blocking slide 36 inwards does the fork-shaped end 37 of this slide deviate inwards, thus allowing the stapler platform 33 to tilt downwards, allowing the staple to come into contact with the anvil 34.

The tilting link of the stapler platform 33 is defined by an inner end of the stapler platform 33, which end is designed as a fork 45 and is pushed over the inner transverse edge 42 of the aperture 32. This allows longitudinal displacement of the stapler platform 33 during tilting. The stapler platform 33 has an oval passage opening 44 matched to the outer contour of a bead-like thickened head of the anvil 34. The result is linear contact between the head and the inner wall of the passage opening 44, making it possible to minimize a gap between the two parts over the entire pivoting travel and thus to minimize the risk of a staple becoming jammed between the two. The stapler platform 33 is pressed upwards in the opposite direction to the support plate 35 by a spring 43. The upper limit position is defined by the presence of stops in the passage opening 44 which abut at the underside of the head. A compression spring 47 is clamped between a lower extension (not shown in the drawings) of the stapler platform 33 and a shoulder of the blocking slide 36, which spring on the one hand holds the inner wall of the passage opening 44 against the head and holds the stapler platform 33 in engagement with the transverse edge 42, and, on the other hand, presses the blocking slide 36 into its blocking position. During assembly, the anvil 34 is fitted through the passage opening 44 and riveted in an aperture 48 in the support plate 35.

The U-base of the bottom part 31 has a first planar section with the aperture 32, a second planar section, which is lower than and parallel to the first planar section, and an inclined section which connects the two planar sections and in which there is a recess 49 in which the principal spring 30 is positioned and supported.

A bearing block 50 is attached to the U-base of the bottom part 31. The bearing block 50 is a stamped and bent part with a U-shaped contour. The U-base of the bearing block 50 comprises an inner transverse web 51, a central aperture, through which the principal spring 30 also extends, and an outer transverse web 52 with a smaller aperture into which a guide bush 53 for a punching ram 54 is inserted. The two transverse webs 51, 52 of the bearing block 50 lie in a common plane, so that a gap 55 for the introduction of papers which are to be hole-punched is formed between the second planar section of the bottom part 31 and the outer transverse web 52. The contour of the bottom edge of the U-limbs of the bearing block 50 follows the inclination of the inclined section of the bottom part 31 but has a double hook 56 on both sides. Above the double hooks 56, the contour of the bearing block 50 forms a stop for positioning papers which are to be hole-punched. During fitting, the double hooks 56 are each pushed through a slot 56*a* in the bottom part 31, and then the bearing block 50 is pushed outwards until the double hooks 56 engage beneath the second planar section of the bottom part 31. In this position, the inner transverse web 51 and the attachment clips 57 are joined to the bottom part 31, for example by spotwelding.

Clips 58 which are angled off inwards are formed integrally on the top free edges of the U-limbs of the bearing block 50, and the top part 9 has lateral recesses 59, into each of which an integrally formed stop 60 projects. The clips 58 form mating stops for the stops 60 and thus limit the opening angle between the members 1, 2.

The lower planar section of the bottom part 31 also has an aperture 61 into which a light guide 62, which is intended as a positioning aid for the hole puncher, projects, as well as the receiving die 63, which interacts with the punching ram 54. The punching ram 54 is preloaded towards the top part 9, so that even when the stapler is activated, i.e. the staple channel is lowered, it does not project into the gap 55. A thin covering sheet 64 covers the gap 55 for papers which are to be hole-punched at the top.

Finally, the member 2 also contains the utensil module 65 and a bottom outer shell 66 made from plastic, having a cover 67, for a compartment which is formed in the outer shell 66 and is intended to receive waste cuttings which have been punched by means of the punching ram 54, known as confetti.

Figure 8:
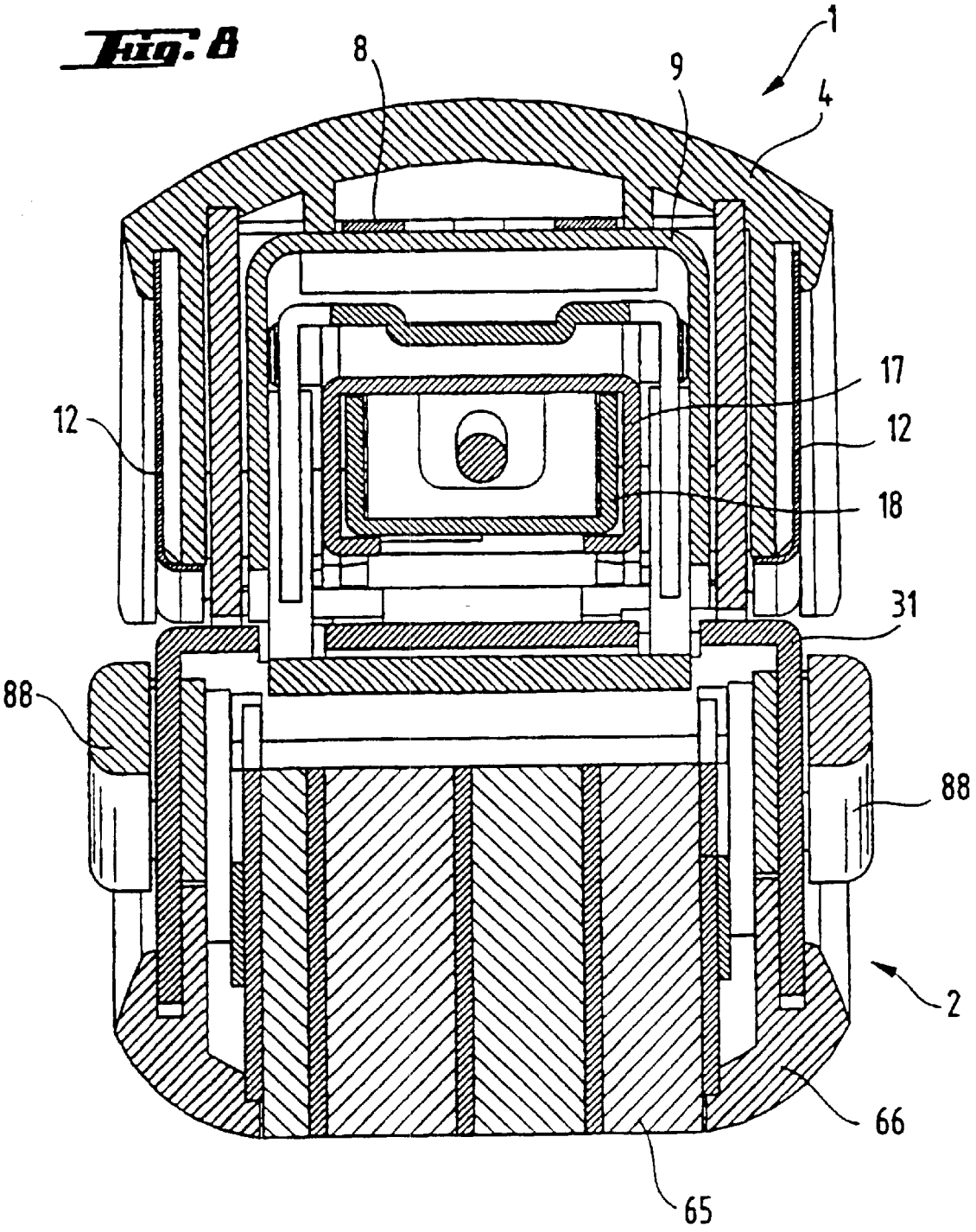
FIG. 8 shows a cross section through the multipurpose handheld implement shown in FIG. 3.
Figure 9:
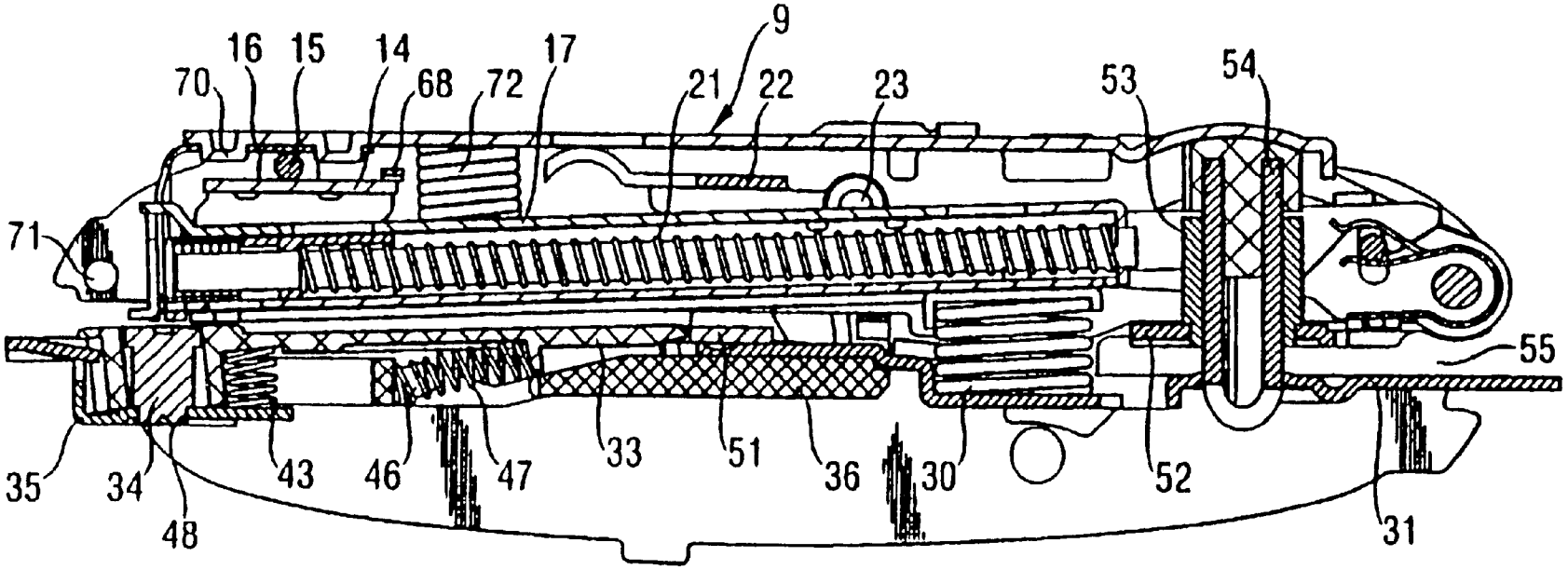
FIG. 9 shows an excerpt, partially in section, of a side view of a multipurpose handheld implement, which has been modified in a number of details with respect to the embodiment shown in FIGS. 3 to 8, in the closed state.

As can be seen from FIG. 8, free spaces, in which additional functional parts of the module are located, are provided between the outer walls of the utensil module 65 and the inner sides of the U-limbs of the bottom part 31. The plastic shell 66 engages around the free edges of the U-limbs of the bottom part 31 and the free edges of the outer walls of the utensil module and covers the free spaces with respect to the outside. Where utensils are to be folded out of the utensil module 65, the outer shell 66 is cut out in such a manner that it has straight, parallel side edges around the cutout, defining a plane for the multipurpose handheld implement to be put down on.

With regard to the structure and method of operation, thus far it is also possible to refer to WO 98/32570.

Figure 10:
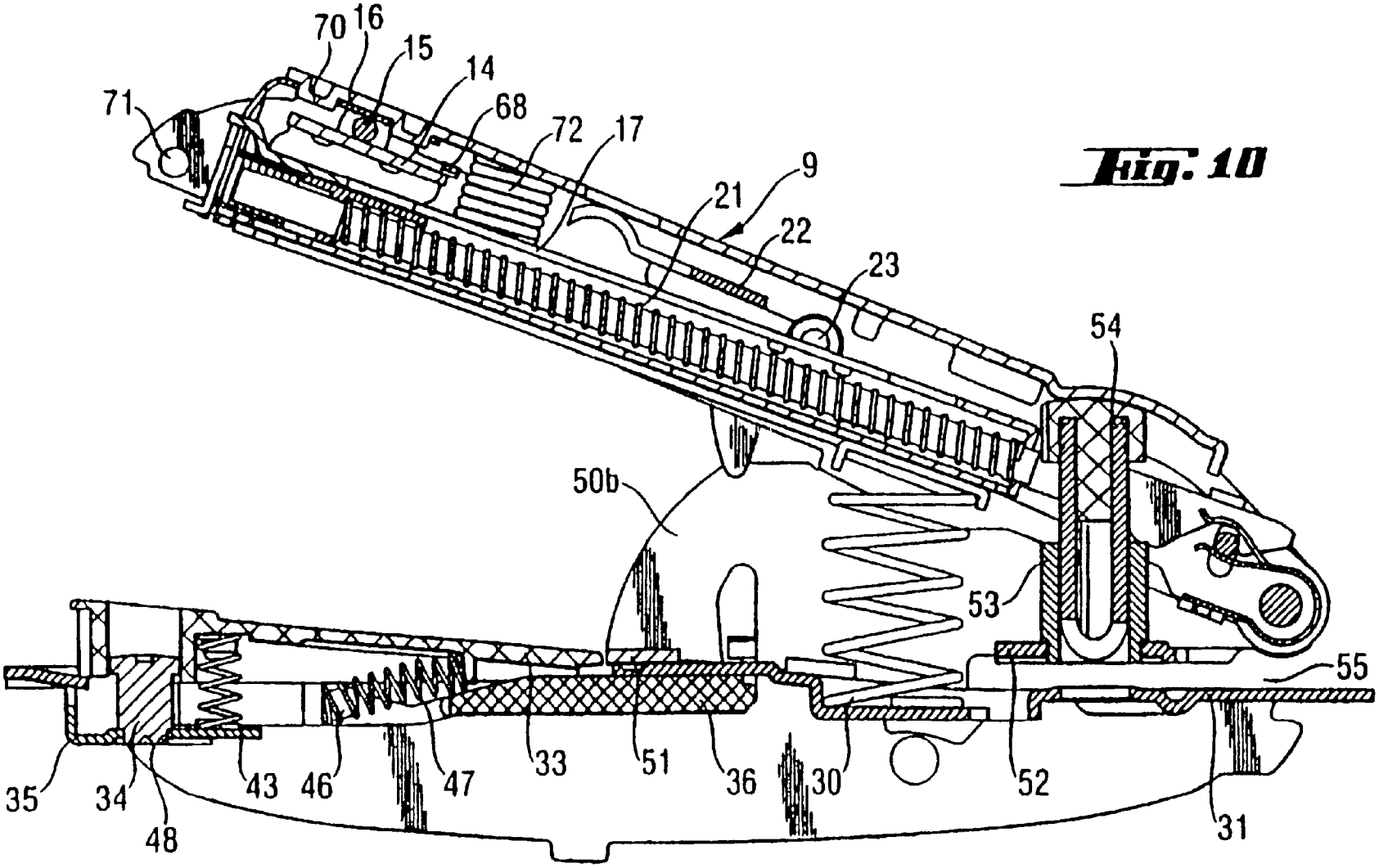
FIG. 10 shows the multipurpose handheld implement from FIG. 9 in the open state.

In the embodiment shown in FIGS. 9 to 13, the locking hook 14, as can be seen in particular from FIGS. 12, 13, is mounted on the top part 9 in such a manner that it can pivot about the pin 15 and is preloaded into engagement with locking peg 69, which is formed on the side of the staple channel part 17, by means of a spring tongue 68. In this way, the staple channel part 17 is preloaded into its locked position. The spring tongue 68 is a punched-free part of the staple driver 16. The latter, as can be seen from FIGS. 10, 11, is held and positioned by means of recesses on the top part 9, which accommodate corresponding pegs 70 formed integrally on the top part 9 (FIGS. 10, 11). To activate the stapler, the stapler release button 6 is actuated and, by way of integrally moulded journals, latched into openings 71 and thus articulatedly attached to the top part 9 and pivots the locking hook 14 out of engagement with the locking peg 69, counter to the force of the spring tongue 68, so that the staple channel part 17 is pivoted out of its upper, inactive position, under the action of a stapler spring 72 which is supported on the top part 9, into its operating position (FIG. 11). As a result, the staple driver 16 also moves into its operating position.

In the embodiment illustrated in FIGS. 9 to 13, it is furthermore possible for the blocking-release lever 22 to be articulated loosely without additional spring preloading, since at the end of its travel it in any case reaches the correct position, and furthermore may be mounted on the staple channel part 17 by way of bearing pegs 22*a* which are formed integrally and resiliently and allow it to snap onto the staple channel part 17. These measures simplify construction and assembly.

In the embodiment illustrated in FIGS. 9 to 13, it is furthermore possible for the blocking-release lever 22, in front of the bearing pegs 22*a* which are arranged relatively close to the principal spring 30, to have relatively long side limbs 22*b* which serve to actuate the blocking slide 36, are rounded and, if appropriate, are curved slightly towards the bearing pegs 22*a*. The two side walls 50*a*, 50*b* of the bearing block 50, which in this case is expediently connected to the bottom part 31, for example by spot welding, interact, by way of their end edges facing towards the stapler release button 6, with the long side limbs 22*b*, in order, in the open position of the members 1, 2 (FIGS. 10, 11), to form two rounded, overlapping guard edges with a guard angle which is obtuse in both positions shown in FIGS. 10, 11 for paper to be stapled which has been inserted too far, irrespective of whether or not the stapler is activated, so that there is no possibility of this paper becoming jammed, trapped or cut anywhere between the bearing block 50 and the top part 9 or the staple magazine 18.

As shown in FIG. 14, the stapler platform 33 is preloaded into the upper position, which is delimited by the head of the anvil 34, under preloading from the spring 43. On the side which is remote from the anvil 34, the stapler platform 33, on its underside, is articulatedly mounted, by way of hook-like extensions 45*a* in a longitudinal fork 72*a* on the transverse edge 42 of the bottom part 31, the compression spring 47 forcing the stapler platform 33 towards the transverse edge 42. In the area of its side limbs, the support plate 35 is expediently bent over from the outside inwards, in order to form corresponding guide tabs which offer sufficient space to form a stable double fork 37*a*, 37*b*, which is received by the support plate 35, on the blocking slide 36. In this case, a slightly upwardly directed peg 46 is arranged on the rear side of the base limb of the middle fork 37*b*, and the spring 47 by means of which the blocking slide 36 is pressed forwards is fitted onto this peg 46. The actuating arms 40 of the blocking slide 36 extend through the corresponding apertures 41 in the bottom part 31 and have guide projections 40*a* which can be fitted from below through front extensions of the apertures 41 and suspend the barrier slide 36 from the bottom part 31 at its rear end.

As shown in FIGS. 15*a, b*, the side walls 50*a*, 50*b* of the bearing block 50, on the top side, in addition to the pair of opposite clips 58, are provided with an additional pair of clips 58*a* which are arranged at a distance from the first pair of clips 58, are opposite one another, are closer to the opening button 5 and serve to lock the multipurpose handheld implement in its closed position. In this case, the leaf spring 8, which can be adjusted by actuating the opening button 5, is provided with an extension 8*a* which, when the multipurpose handheld implement is closed, runs onto the clips 58 and is thus lifted, counter to its spring preloading directed towards the bearing block 50 over the blocking projections 9*a* and can thus be displaced towards the opening button 5. Moreover, the leaf spring 8 is guided on the top side of the top part 9, is positioned by means of a positioning catch 74, which latches on the inside of the outer shell 4, and has locking clips 8*b* which, in the closed and locked state of the multipurpose handheld implement, engage beneath the clips 58*a* and thus secure the locking. The lateral recesses 59 in the top part 9 are provided, on the bottom side, with a stop 59*a* for the clips 58, so that the extent to which the members 1, 2 can be opened is limited accordingly. In the unlocked state, the extension 8*a* when the implement is being opened, bears against shallow barrier projections 9*b* on the top side of the top part 9 (and prevents displacement of the opening button 5), while the locking clips 8*b* are free with respect to the clips 58*a*. When the implement is being closed, the extension 8*a* is lifted by the clips 58, so that the extension 8*a* is lifted over the blocking projections 9*a* and the locking clips can be pushed back under the clips 58*a* (FIG. 15*a*).

FIGS. 16*a, b* show an embodiment of an outer shell 4 for the multipurpose handheld implement having a screen 12 which, on one side, at the end remote from the stapler release button 6, has an extension 12*a* which is in the shape of a sector of a circle, for suspending in a corresponding recess in the outer shell 4 and, on the other side, at a distance therefrom, has a clip 12*b* which is bent over inwards through 90° twice, this clip having an opened-out spring tongue 12*c* which latches in a corresponding recess in the top part 9. In the area in which it is surrounded on the outside by the outer shell 4, the screen 12 may additionally have a series of recesses which accommodate corresponding protrusions 4*a* on the outer shell 4 to provide security against torsion. Furthermore, as illustrated in FIG. 7, ribs which support the screen 12 may be provided on the outer shell 4.

FIGS. 17*a, b* show an embodiment illustrating how the outer shell 66 is fixed to the bottom part 31. At the front end of the bottom part 31, the support plate 35 projects beyond the end-side edge of the bottom part 31. The resultant protrusions engage in recesses 31*d* in the outer shell 66 and hold the latter in place. The protrusions are covered by the top edge of the recess 31*d*.

At its rear end, the outer shell 66 is snapped onto projections 31*b* which are arranged on the side walls of the bottom part 31 and is held in place by means of protrusions 66*a*. Additional centring recesses 31*a* and/or centring protrusions, which interact with corresponding protrusions or recesses in the outer shell 66 and centre the outer shell 66 in the longitudinal direction, may be provided on the side walls of the bottom part 31.

As can be seen from FIG. 18*a*, the light guide 62 is supported, by way of a rib 62*a*, on the underside of the bottom part 31 and, by way of ribs 62*c*, on the outer shell 66. Guide ribs 62*d* serve as an assembly aid and secure the light guide 62 in the outer shell 66 before the latter is snapped onto the bottom part 31. The light guide may have an outer side 62*b* which is curved in the form of a convergent lens and may be designed to taper towards the inner side 62*e*, in order to achieve a magnifying effect. Irrespective of this, it is expedient if the inner side 62*e* is set back with respect to the bottom surface, delimiting the gap 55, of the central section of the bottom part 31, so that the inner side 62*e* is not made dirty by paper pushed in for punching, for example by wet ink or the like situated on the paper.

The embodiment illustrated in FIGS. 18*a* to *c* of a confetti compartment 76 which can be closed by means of the cover 67, forms part of the outer shell 66 and, next to the bottom part 31, is provided with a passage opening 77 for confetti, which opening is concentric with the receiving die 63, comprises a retaining ring 78, which is clamped in between the bottom part 31 and the adjacent covering wall of the confetti compartment 76 and surrounds the receiving die 63 in such a manner that, during hole-punching, the punching ram 54 penetrates just into the retaining ring 78. The retaining ring 78 prevents confetti from being able to build up in the area of the receiving die 63 and thus block the punched material when it is being pulled out. This is important if the multipurpose handheld implement comprising the hole puncher is generally used by the user in such a manner that the confetti is conveyed upwards into the confetti compartment 76. Irrespective of the above, this solution prevents confetti from being able to fall out of the confetti compartment 76 through the receiving die 63 after the punching operation. Subsequent confetti presses confetti which is held in the area of the retaining ring 78 further into the confetti compartment 76.

The retaining ring 78 may have an internal diameter which is close to the diameter of the receiving die 63 and, if appropriate, may be formed on the outer shell 66 and have retaining elements in the form of ribs, roughened structures or the like. It may be designed and fitted as an extension of the receiving die 63 or as a separate part, as illustrated. A retaining ring 78 made from a soft, bristly material, for example a felt ring, whose tiny hairs securely retain the confetti, is particularly expedient. A retaining ring 78 made from a flexible material could also have a hole diameter which is slightly smaller than the receiving die 73. The retaining ring may also be designed with a slight conical taper towards the confetti compartment 76.

The retaining ring 78 may also be formed in the form of a coil spring.

The retaining ring 78 made from felt or the like is expediently pushed onto the lowered punching pin during assembly, for centring purposes, while it may be fixed and held to the confetti compartment 76 or to the bottom part 31 by means of small securing teeth 79 which are distributed over its circumference.

The confetti compartment 76 is provided with a diverter rib 76*a* which diverts confetti into the interior of the confetti compartment 76, so that there is no build-up and the cover 67 only opens when the confetti compartment 76 is completely full. If the confetti compartment 76 is suitably full, the lid 67 initially opens into a first position, in which the confetti cannot fall out but the user is made aware that the confetti compartment 76 needs to be emptied. If the filling level is higher still, the cover 67 opens or is opened by the user in order to adopt a further open position in which the confetti can be emptied.

One embodiment of the utensil module 65 with a lifting and unblocking device for utensils 81 is illustrated in FIGS. 19*a* to *d*. The utensil module 65 comprises two planar, congruent outer walls 80, each with two assembly hooks 80*a*, 80*b*, by means of which the utensil module 65 is suspended from the support plate 35 or the double hooks 56 of the bearing block 50. Lateral extensions 80*c* are used to centre the utensil module 65 in the bottom part 31. If appropriate, intermediate walls may be provided in order to form individual compartments for in each case one utensil 81. The utensils 81 can be folded out about a rotation pin 82 arranged between the two outer walls 80. In addition leaf springs 83 are provided, the heads 88*k* of which bear against the foot of the corresponding utensil 81 and preload and fix the utensil either in the folded-in position (FIG. 19*a*) or in the folded-out position (FIG. 19*c*). The leaf springs 83 are articulatedly mounted, in the form of two armed levers, by means of a pin 84 which extends between the outer walls 80, adjacent to the heads 88*k* of the leaf springs 83, and, at the end remote from their heads 88*k*, are supported on a pin 85 which extends between the outer walls 80.

It is true that to this extent, there is a similarity to a pocket-knife, but in the latter the utensils project beyond the side walls in the folded-in state and can therefore be taken hold of, while in the present multipurpose handheld implement the utensils 81 are fully recessed in the folded-in state, which is advantageous for the use of stapler and hole puncher but means that the utensils 81 are difficult or impossible to reach. Therefore, an opening and unblocking mechanism is advantageously provided for the utensils 81.

An insertion spindle 86, which can rotate with respect to the utensil module 65, has an internal cross section which is not round, and, on the one hand, on each side bears an inner actuating lever 87, which is rotatably connected therewith and, on the other hand, an outer actuating lever 88, which is rotatably connected therewith by insertion, extends between the outer walls 80, next to the pin 85. To allow the outer actuating levers 88 to be inserted with a press fit into the insertion spindle 86 and to be actuated from the outside, the side walls of the bottom part 31 are provided with corresponding openings 89A (cf., for example, FIG. 7)

The inner actuating levers 87 are supported, by way of their hook-shaped noses 87*a*, on unblocking levers 89, which are mounted on the rotation pin 82, are located on and bear against the outer sides of the corresponding outer walls 80, have an extension 89*a* and are connected to one another by way of an unblocking pin 89*b*. The latter extends between the two unblocking levers 89 on the outer sides of the utensil module 65, in order to be able to act on all the leaf springs 83 collectively and move them outwards.

Furthermore, on each side a two-armed lifting lever 90 is provided next to the associated unblocking levers 89, outside the respective outer wall 80, which lifting levers can rotate about the pin 84 and are connected to one another by way of a lifting plate 91 in the area of the limbs directed towards the extension 89*a*. In this case, in the position illustrated in FIG. 19*a* the shanks of the utensils 81 press on the lifting plate 91 and thus press the other free end of the lifting lever 90 against the unblocking lever 89.

The unit is held together from the outside by means of attached plates 92 which, for example, are riveted to the pins 84, 85.

Figure 19B:
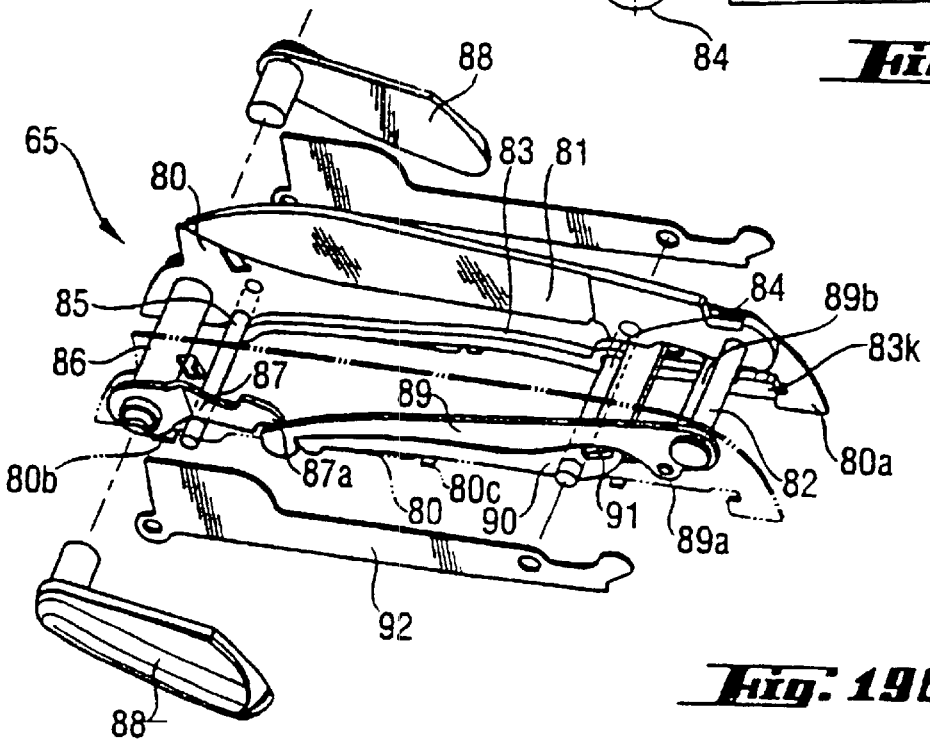
Figure 21D:
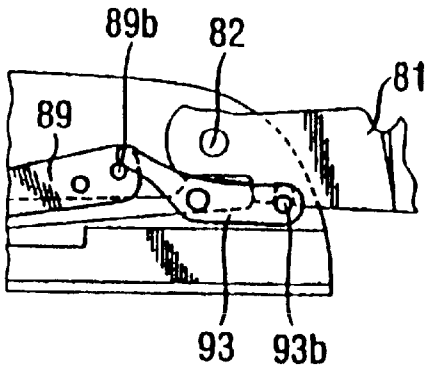
Figure 21C:
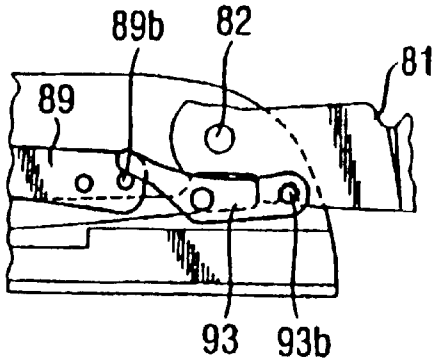
Figure 21B:
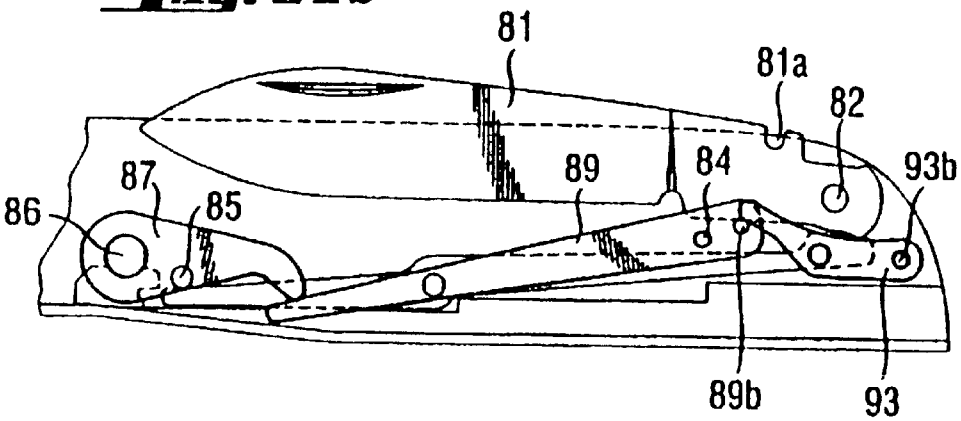
Figure 21A:
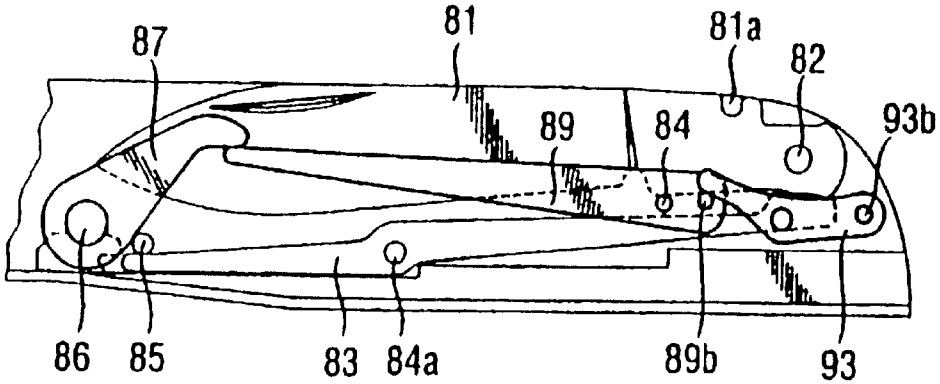

If the outer actuating levers 88, i.e. at least one of these levers, are now rotated (in the clockwise direction as seen in FIG. 19*b*), as a result the inner actuating levers 87, which can rotate with the spindle 86, are also rotated, with the result that their noses 87*a* pivot the unblocking lever 89 counter to the opening direction of the utensils 81. As a result, the lifting levers 90 are moved with them at their end adjacent to the actuating levers 87, and consequently the lifting plate 91 is moved towards the shanks of the utensils 81. As a result, the utensils 81 are pivoted out of the utensil module 65 through a certain angle, while at the same time the unblocking pin 89*b* holds the leaf springs 83 pressed out of engagement with the shanks of the utensils 81, so that the latter can easily be taken hold of and folded out from a lifted position, owing to the reduction in the spring preloading.

Advantageously, the individual utensils 81 are lifted by their shanks being acted on at different distances from the rotation pin 82 and/or by rest projections of the feet of the utensils which are at different heights being acted on, in particular by an obliquely arranged lifting plate 91. This ensures that the utensils 81 fan out with slight differences in height and can be gripped more easily, FIG. 19*e*.

The heads 88*k* of the leaf springs 83 can latch into corresponding latching recesses on the shanks of the utensils 81 and thus block the latter in the folded-out position.

When the utensils 81 have been fully folded out and the outer actuating levers 88 have been released, cf. FIG. 19*c*, the leaf springs 83 press the levers 90, 89, 87, 88 back into their starting position via the unblocking plate 91 and block the utensils 81 in the folded-out position.

To fold the utensils in, the outer actuating levers 88 have to be actuated again, so that the leaf springs 83 can in turn be disengaged from the shanks of the utensils 81 via the unblocking pin 89*b*, FIG. 19*d*, so that the blocking is released and the folded-out utensils 81 can be folded in.

The lifting mechanism may be used on its own or in combination with an unblocking mechanism for the utensils 81.

The spring force which acts on the utensils 81 in both their limit positions may act on the utensils 81 directly (as shown in the exemplary embodiment in accordance with FIGS. 19*a* to *d*) or via the lifting mechanism.

The lifting mechanism may press on the utensils 81 from below (as also shown in the exemplary embodiment in accordance with FIGS. 19*a* to *d*), may fold the utensils 81 out by rotation over the rotation pins 82 or may pull on the shank extension which projects beyond the rotation pin 82 at the end side.

Lifting of the utensils 81 by contact from below may take place over the entire length of the utensil 81. However, the area close to the rotation pin 82 is preferred.

The utensils 81 may be lifted directly or via a force-reducing mechanism (as also shown in the exemplary embodiment in accordance with FIGS. 19*a* to *d*).

The lifting and unblocking mechanism is preferably arranged on the outer sides of the utensil module 65 and (as shown in the exemplary embodiment of FIGS. 19*a* to *d*) connected by way of connecting elements which run transversely through the utensil module 65 beneath the utensils 81. Alternatively, however, the mechanism could also be arranged on the top side, opposite to the folding-out side, of the utensil module 65.

A mechanism which is arranged on both outer sides may act jointly on the utensils 81 or may also have different functions, for example a lifting mechanism on one side and a blocking mechanism on the other side. Conversely, it is also possible to have a mechanism for lifting and blocking the utensils 81 which is arranged on only one side face.

The mechanism may be restored by way of leaf springs 83 which act on the utensils 81 or by way of separate springs.

In the folded-in position, the utensils 81 and partition plates arranged between them substantially form a common plane which are [sic] set back slightly from the edges of the outer shell 66, so that the multipurpose handheld implement can be put down on a planar surface.

The lifting and unblocking mechanism can be used not only for a utensil module 65 but also, of course, for an integrated structure. Moreover, it may be provided for individual utensils 81 or for all utensils 81 or for utensils 81 which can be folded out about different rotation pins 82, and may be activated by means of a common actuating member or a plurality of separate actuating members. As an alternative to the rotatable outer actuating lever 88, it is also possible to provide other actuating members, for example slides, rotary buttons or push-buttons. Finally, such a lifting mechanism could also be used for other multipurpose handheld implements, such as pocket-knives or tools.

The actuating levers 88 may be arranged at ergonomically favourable locations which in particular may be positioned in such a way that the multipurpose handheld implement can be held at the location of its centre of gravity with one hand while the actuating levers 88 are being actuated, while the other hand is folding the utensils 81 in and out. The fingers are safe when the utensils 81 are being folded in. The actuating levers 88 are advantageously located on that side of the utensils 81 which is remote from the rotation pin 82, in which case their direction of movement is advantageously directed oppositely to the folding-out direction of the utensils 81.

The leaf springs 83 may also have their own pin which is independent of pin 84.

As shown in FIGS. 20*a, b*, the outer actuating lever 88 may be formed from a pin 88*a*, which is suitable to be press-fitted into the insertion spindle 86, and a clip 88*b*, which has an opening for riveting the pin 88*a* to the clip 88*b*, the clip 88*b* being surrounded with plastic by injection moulding and possibly having further openings for anchoring the plastic to the clip 88*b*.

The way in which the utensils 81 are blocked and unblocked may also take place differently from the way illustrated in FIGS. 19*a* to *d* and may, of course, also be independent of the lifting of the utensils 81, as illustrated, for example, in the corresponding FIGS. 21*a* to *d*. In this case, a two-armed, pivotable blocking lever 93 (usually a pair of such levers) is provided, one arm of which is in engagement with the unblocking pin 89*b* of the blocking lever 89, while its other arm bears a blocking pin 93*b* which, in the folded-out state, engages with a groove 81*a* in the shank of the utensil 81 and blocks the latter in this state, FIG. 21*c*. In the folded-in state, the utensil 81 is held by the associated leaf spring 83, FIG. 21*a*. As a result of the actuating lever 87 being actuated, the utensil 81 is lifted by way of the unblocking pin 89*b* which presses on the shank of the utensil 81, FIG. 21*b*.

The blocking and unblocking may also take place in accordance with FIGS. 22*a* to *c*, in that a longitudinally displaceable lever 94 is articulatedly mounted on the inner actuating lever 87, which lever 94, at its free end, has an extension 94*a* which, in the folded-in position of the utensil 81, is located in a dedicated recess 81*b* on the shank of the utensil 81, while the utensil 81 is held in its folded-in position by the preloading of the leaf spring 83, FIG. 22*a*. As a result of the inner actuating lever 87 being actuated, the lever 94 is displaced away from the rotation pin 82 and, in the process, lifts the utensil 81 accordingly, so that it can be taken hold of and folded out via the position illustrated in FIG. 22*b* into the position illustrated in FIG. 22*c*, in which the extension 94*a* latches into a recess 81*c* in the shank of the utensil 81 and blocks the utensil 81. In this case, of course, a slide which acts on the lever 94 could also be used as the actuating member instead of the actuating lever 87, 88.

According to the alternative lifting device shown in FIGS. 23*a, b*, one end of the substantially longitudinally moveable lever 94 is articulatedly mounted on the inner actuating lever 87 (to simplify the drawing, shown here and below as being integral with the outer actuating lever 88), while the other end of the longitudinally moveable lever 94 is articulatedly mounted on the diverter 89A which in this case is approximately triangular and can pivot about a peg 95. The lifting pin 89B serves to lift the utensil 81 counter to the force of the leaf spring 83.

FIG. 24 shows a further embodiment of an unblocking device. The diverter 89A is moved by means of the lever 94, the unblocking pin 89*a* lifting the leaf spring 83 off the shank of the corresponding utensil 81 when the actuating lever 88 is actuated, so that the utensil can fold out through a corresponding angle under the force of gravity or because of a corresponding thrusting movement.

FIG. 25 shows a combination of FIGS. 23*a, b* and FIG. 24. Both an unblocking pin 89*b*' and a lifting 89*b*" are arranged on the diverter 89A, one of which pins acts on the leaf spring(s) 83 and the other of which acts on the utensil(s) 81, thus combining the embodiments of FIGS. 23*a, b* and FIG. 24 with one another. When the actuating lever 88 is released, the utensils 81 which have not been folded out by the user are pressed back into the starting position by the leaf springs 83.

In accordance with FIGS. 26*a* to *c*, a longitudinally displaceable barrier bracket 96 is articulatedly mounted on the actuating lever 87, which bracket is guided in the longitudinal direction by way of a rivet 97 on the outer wall 80 and a slot 96*a* and, at its free end, has a barrier web 96*b* which, in the folded-in starting position, FIG. 26*a*, is located behind the head 88*k* of the leaf spring 83, on the side remote from the utensil 81, and prevents the leaf spring from deflecting. As a result of the actuating lever 87 being actuated, the barrier web 96*b* is displaced towards the free end of the head of the leaf spring 83, so that the utensil 81 can be folded out, since the leaf spring 83 initially moves clear of the shank of the utensil 81. When the utensil 81 has been folded out fully and the actuating lever 87 has been released, the head of the leaf spring 83 blocks the folding-in movement, since the barrier web 96*b* is again in its rest position and is blocking the leaf spring 83. This web allows the utensil to be folded in when the actuating lever 87 is actuated again.

In FIG. 27, the mechanism illustrated in FIGS. 26*a* to *c* is combined with that shown in FIG. 25 i.e. the diverter 89A and the lever 94 are additionally provided, by means of which, when the actuating lever 88 is actuated, the load on the leaf spring 83 is additionally relieved and the utensil 81 is lifted. For this purpose, the lever 94 and the barrier bracket 96 have to be articulatedly mounted together on the inner actuating lever 87.

The barrier web 96*b* may also act only for certain utensils 81, while in the area of other utensils 81 it has a recess, so that these utensils are not stopped from folding in by the barrier web 96*b*.

As an alternative to using one leaf spring 83 for each utensil, it is also possible to use a single, common leaf spring for a plurality of utensils 81, or the leaf springs 83 may be combined to form subassemblies. The unblocking mechanism may be used separately or in combination with a lifting mechanism for the utensils 81. The individual or combined functions described above may be activated jointly, by way of a pair of actuating levers arranged on both sides of the utensil module 65, or by way of two separately acting actuating levers; in the latter case, each of the two actuating levers is assigned to a specific group of utensils.

The actuating linkage is of distance-reducing and force-increasing design, in order to allow the actuating levers to operate easily. The actuating levers are located, with respect to the length of the overall implement, approximately in the centre and close to the free ends of the folded-in utensils, for example in the area of the inclined section of the bottom part 31. This is the most ergonomic position, partly in view of the fact that during actuation the actuating levers have to be moved in the opposite direction to the utensils 81.

As an alternative to the two jointly acting actuating levers of the exemplary embodiment, it is possible for the two levers to have different functions, for example for one lever to lift the utensils 81 while the other brings about unblocking. Conversely, a single actuating lever on only one side of the implement which activates all the functions would be sufficient.

In a preferred design, the entire lifting and unblocking mechanism is arranged on a separate utensil module 65 (FIGS. 4 to 7) which can be inserted into a multipurpose handheld implement and can be activated together by way of the actuating levers 88 arranged on the outer sides of the implement. To avoid excessive loads, the pivoting travels of the actuating levers 88 are preferably limited by stops, for example the outer shell 4.

As can be seen from FIGS. 3 and 8, the U-limbs of the bottom part 31 are recessed inwards with respect to the contour of the bottom outer shell 66, and the actuating levers project only slightly, or do not project at all, beyond the contour of the bottom outer shell 66.

If, as is the case in the exemplary embodiments, both actuating levers are actuated simultaneously, the actuating fingers are to some extent protected from injury by utensils 81 which are folding in by the projecting contour of the outer shell.

The linkage mechanism provided in the exemplary embodiments may, of course, also be of different design; the actuating member may be designed as a slide, a rotary button or in some other way.

While in the exemplary embodiment all the utensils 81 fold out about a single, common rotation pin 82, designs with a plurality of fold-out pins are also possible. The spring-removal, utensil-lifting and utensil-unblocking functions described may then be activated individually or together on all pins, by way of separate actuating members selectively on the various pins or only for the utensils of selected pins.

Generally, it should be ensured that the outer contour of the utensils 81 when they are in the folded-in position is substantially flush with the framework of the utensil module 65 and with other utensils, defining a planar resting surface at least in the central part of the multipurpose handheld implement.

FIG. 28 shows various utensils 81 which are lifted and fanned out by means of the lifting device, sufficiently far beyond the outer shell 66 for it to be possible to recognize the individual utensils 81 easily and take hold of and fold open a desired utensil 81 comfortably, while all the other utensils 81 fold back automatically when the actuating member 88 is released. In this case, a knife blade 81M is provided on one outer side with respect to the other utensils 81, the knife blade 81M being lifted into the lifted position by suitable interaction between, for example, the lifting plate 91 and the shank of the knife blade 81M in such a manner that the point of the knife blade 81M remains covered below the outer shell 66, so that there is no risk of injury for example when an adjacent utensil 81 is being folded out. The knife 81M is expediently arranged at an adjacent outer edge, so that it can be used to carry out even shallow cuts, for example in order to open letters.

On the opposite outer side from the knife 81M a pair of scissors 81S is arranged as a further utensil, the position of which scissors is likewise preferably on one of the outer sides, so that the paper can be guided away successfully allowing comfortable cutting without the paper becoming jammed anywhere. Preferably, the scissors are arranged on the outer side on which the cut material is diverted towards the other member 1 or 2 of the multipurpose handheld implement.

Next to the scissors 81S is a staple remover 81E, expediently in this case a relatively long staple remover 81E, so that it can be laid successfully and as flat as possible against paper from which a staple is to be removed despite the fact that it is at a distance from the outer shell 66. In order to be taken hold of from the side, the scissors 81S are expediently lifted higher than the staple remover 81E, which is taken hold of on the side which is remote from the scissors 81S and can be pulled upwards at a gripping edge 81Ea.

Furthermore, a magnifying lens 81L or a cutter 81C, arranged behind the staple remover 81E is pivoted out to approximately the same height as the scissors 81S in order to be gripped, so that it can be taken hold of at a protrusion 81Ca on the front side.

Between the magnifying lens 81L or cutter 81C and the knife blade 81M there is a folding ruler 81F, which is pivoted out relatively little in order to be gripped and is taken hold of at the front side, so that lateral access to the knife blade 81M is not impeded.

The folding ruler 81F advantageously extends over the entire length, and consequently it is always advantageous, if this ruler is provided, for it to be arranged next to the knife blade 81M in order to be at a relatively short distance from a base when it is laid down and measuring is being carried out. Cutter 81C or magnifying lens 81L may be of relatively short design and may be arranged in the area behind the covered head of the staple remover 81E.

Figure 29D:
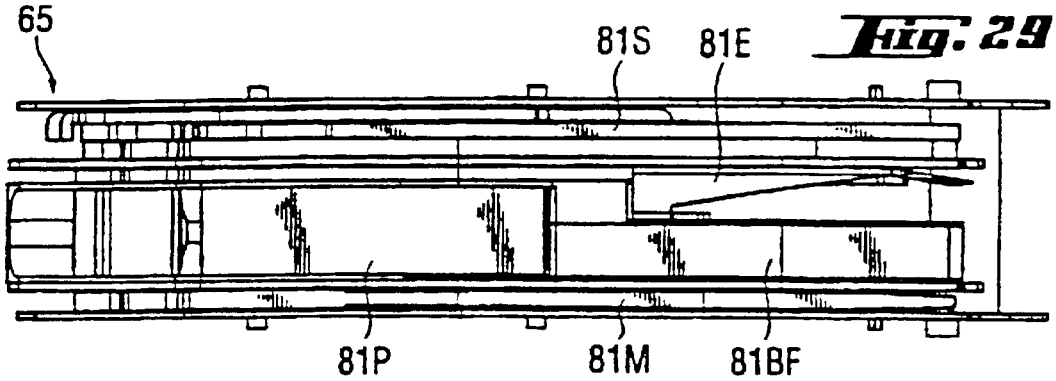
Figure 29C:
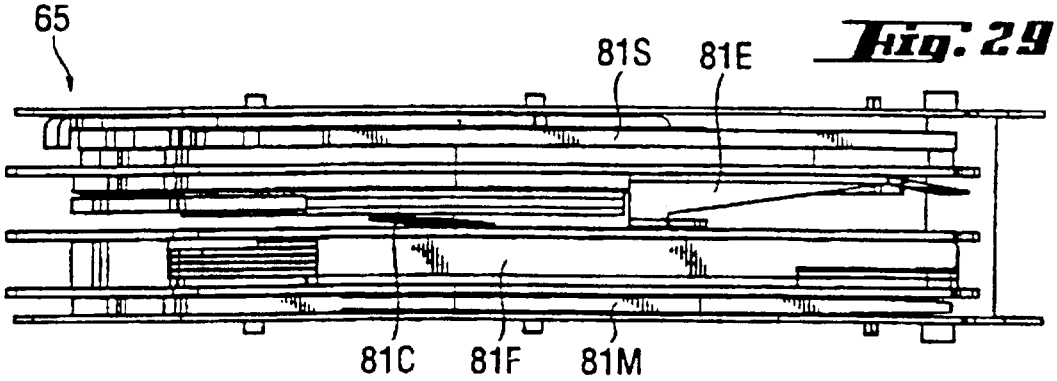
Figure 29B:
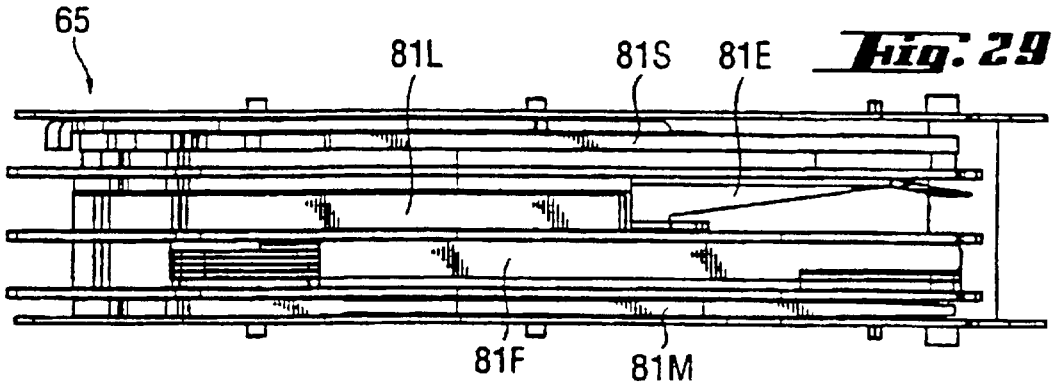
Figure 29A:
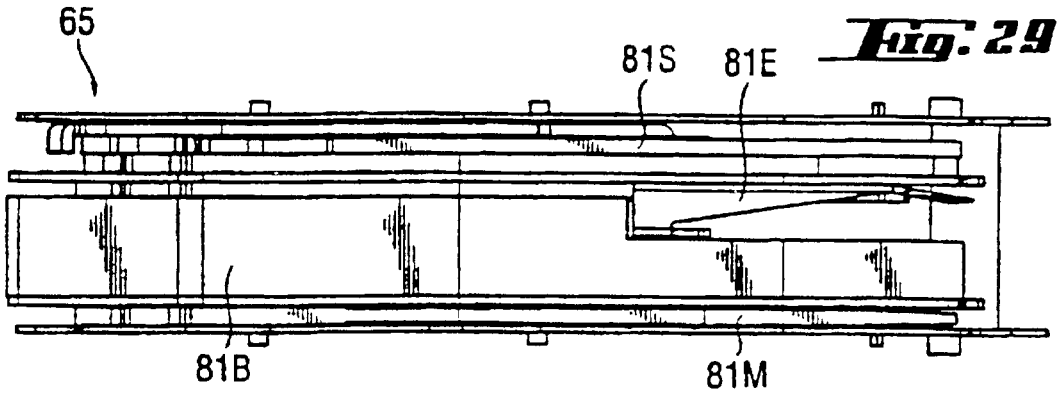

In accordance with FIG. 29*a*, a screen 81B is fitted instead of magnifying lens 81L or cutter 81C and folding ruler 81F. In accordance with FIG. 29*b*, the screen 81B is replaced by the magnifying lens 81L and the folding ruler 81F, and in FIG. 29*c*, the screen 81B is replaced by the cutter 81C and the folding ruler 81F. In accordance with FIG. 29*d*, the screen 81B is replaced by a laser pointer 81P and a battery compartment 81BF. In all four arrangements, the three basic utensils, i.e. knife blade 81M, staple remover 81E and scissors 81S, are arranged at the same location, so that the design variants can be produced imply by exchanging the screen 81B for the folding ruler 81F and the magnifying lens 81L or the cutter 91C [sic].

FIGS. 30*a* to 30*d* show a folding ruler which can be folded out. The basic element is a carrier 100 with a shank 101 corresponding to the width of the receiving space and a base 102, which is connected to the shank 101 and on which a support 103 is arranged. Shank 101, base 102 and support 103 are preferably integral. The shank 101 interacts with one of the leaf springs 83, as can be seen in the folded-out position shown in FIG. 30*b*. A number of measuring elements 104 can be folded in and out about links 105 and are connected to the base 102 in the vicinity of its free end. In the folded-together, folded-in position (FIGS. 30*c* and 30*d*), the support 103 engages beneath the measuring elements 104 and prevents them from being unfolded unintentionally. In the folded-together, folded-in state, a strip 106 which is provided on the support 103 holds the measuring elements tightly together, so that the folding ruler cannot become jammed in the folded-in position.

In accordance with FIGS. 31*a, b*, a link 105 may be formed between two measuring elements 104 by means of a rivet 107; latching lugs 108 are only pressed in after riveting, thus ensuring that they are congruent.

Figure 32A:
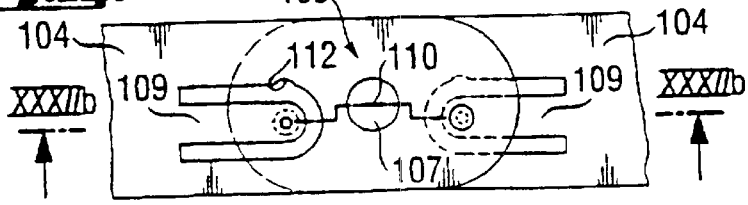
Figure 34B:
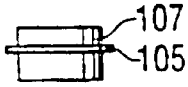

In accordance with FIGS. 32*a, b*, in contrast to the embodiment described above, no additional space in the thickness direction is required for the latching lugs 108 in the folded-in state. Tongues 109 are cut out of the measuring elements 104 connected to the rivet 107, which tongues are offset on one side with respect to the centre plane 110 and are provided with a latching lug 108 which latches in an associated aperture 111 in the other measuring element 104. The U-shaped cutout which delimits the tongues 109 has an additional bulge 112 which provides space for the latching lugs 108 when the measuring elements have been folded in.

To achieve the maximum possible elasticity, the latching elements 108 are preferably arranged as close as possible to or at the end-side edges of the measuring elements 104.

Figure 33A:
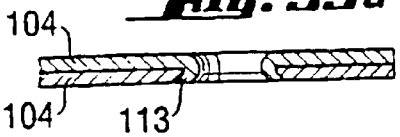

FIGS. 33*a, b* show the design of the link without an additional rivet, by producing a bead 113 or 114. The inner circumference of the aperture delimited by the bead in this case defines the axis.

Figure 34A:
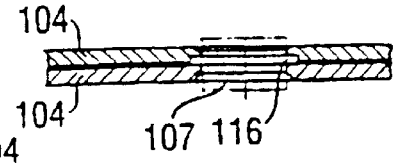

Finally, FIGS. 34*a, b* show a preferred form of the riveting. The rivet 107 is provided with an outer flange 115 which, together with a recess 116, defines a precision bearing, while the accuracy of the rivet heads is of secondary importance.

The latching arrangements shown in FIGS. 31*a, b* can be combined with any configuration of the link 105. It is also possible for the carrier 100, as indicated in FIG. 30*a*, to be provided with a measuring scale.

A further utensil is a cutting tool with an exchangeable blade and blade protector, which is usually referred to as a "cutter". Such a cutter is another utensil which can cause injury, for which reason the cutting edge and the point should be covered by a protective cap in particular when the utensil is being folded out.

This utensil comprises a dual-purpose trapezium-shaped blade 120 which can be exchanged, since its cutting edge becomes blunt relative quickly. The blade has a central hole 121, by means of which it can be fitted onto a peg 122 of a fold-out blade holder 123. The protective cap 124 can move relative to the blade 120. These reference numerals are used for all the embodiments, even if—apart from the blade, which is a standard bought-in part—they are of different designs.

Figure 35B:
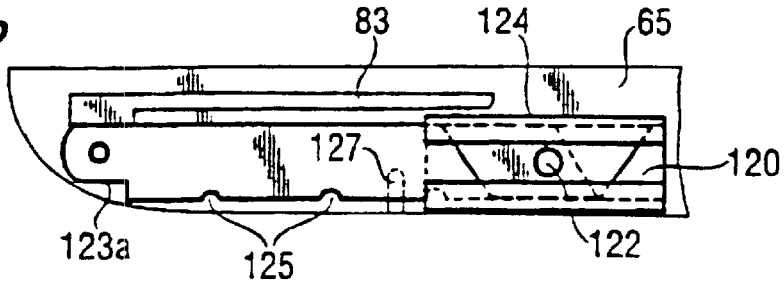

In the embodiment shown in FIGS. 35*a, b*, the blade holder 123 which is articulatedly mounted on the utensil module 65 has latching recesses 125, specifically three such recesses in its spine 126, which is remote from the cutting edge of the blade 120. The protective cap 124 is C-shaped in cross section and, on its inner side facing towards the spine 126, has a corresponding resilient catch (not shown). The protective cap 124 can be displaced out of the working position, so that the blade 120 can be removed freely from the blade holder 123 and can be turned or exchanged. FIG. 35*b* shows the folded-in position, in which the protective cap 124 is in its protective position and completely covers the blade 120. A protruding element e.g. a bead 127, is inserted into the passage which accommodates the cutter, preventing the cutter from folding in when the protective cap 124 is not in the position in which it covers the blade 120.

Figure 36A:
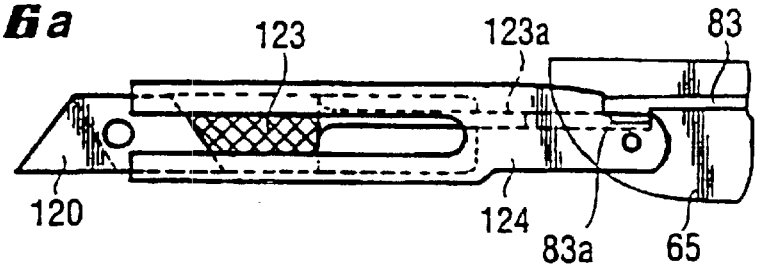
Figure 36B:
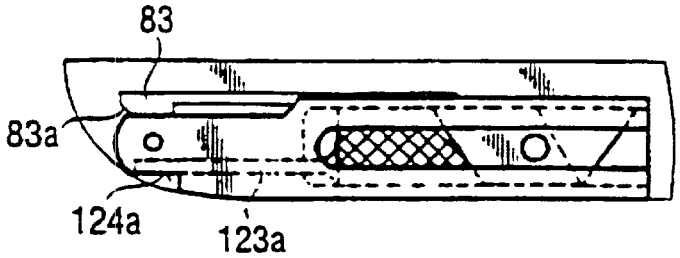

In the embodiment shown in FIGS. 36*a, b*, the protective cap 124 is articulatively mounted on the utensil module 65 and the blade holder 123 can be moved manually relative to the protective cap. In the folded-out state and with the blade holder 123 pushed out, the protective cap 124 is blocked so that it cannot fold in, as a result of the leaf spring 83 engaging in a latching hollow 124*a* in the protective cap 124. If the blade holder 123 is pushed into its protected position in the protective cap 124, the extension 123*a* formed integrally on the blade holder 123 lifts the leaf spring 83 by running onto an inclined surface 83*a* of the leaf spring 83, so that the protective cap 124 is unblocked and can be folded in. Alternatively, of course, the blade holder 123 could be blocked and could be unblocked by the protective cap being displaced into the protective position.

Figure 37A:
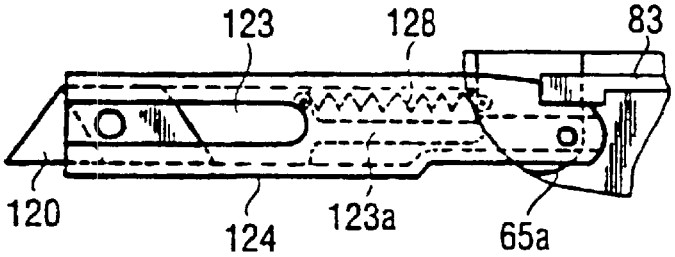
Figure 37B:
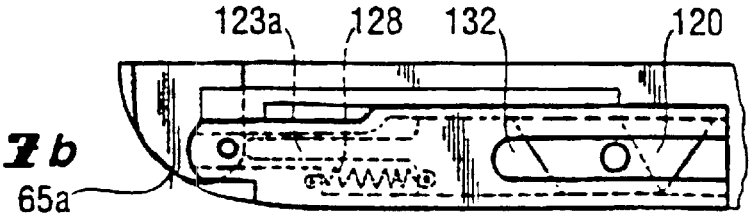

In the embodiment shown in FIGS. 37*a, b* as well, the protective cap 124 is articulatedly mounted on the module and the blade holder 123 can be displaced relative thereto. The blade holder 123 is preloaded into its protective position by a tension spring 128. It has an extension 123*a* which interacts with the free edge 65*a* of an outer or intermediate wall of the utensil module 65, as a cam track, in order to displace the blade holder 123 automatically into the working position during a folding-out movement.

Figure 38A:
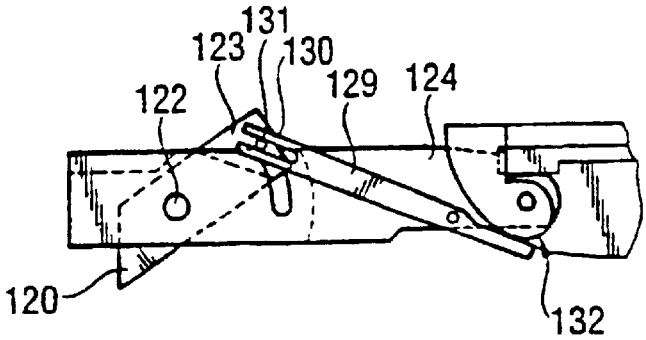
Figure 38B:
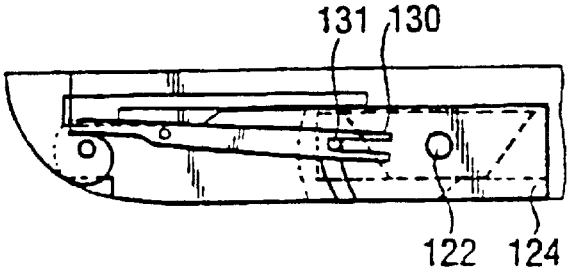

In the embodiment shown in FIGS. 38*a, b*, there is no longitudinal displacement between the protective cap 124 and blade holder 123, but rather the blade holder 123 is pivoted by means of a lever 129 which is articulatedly mounted on the protective cap 124, the peg 122 serving as a pivot pin. A fork 130 at the free end of the lever 129 interacts with a pin 131 when the other end of the lever is deflected by a projection 132 formed integrally on the utensil module 65.

Figure 39A:
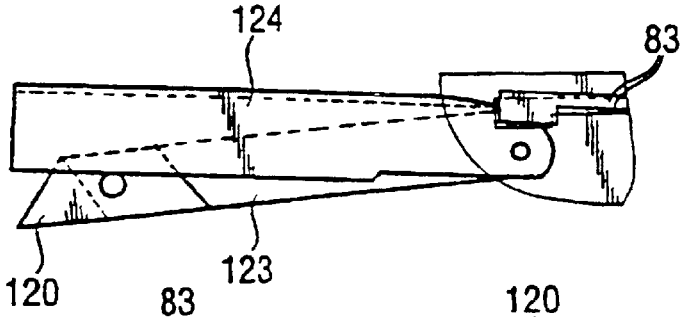
Figure 39B:
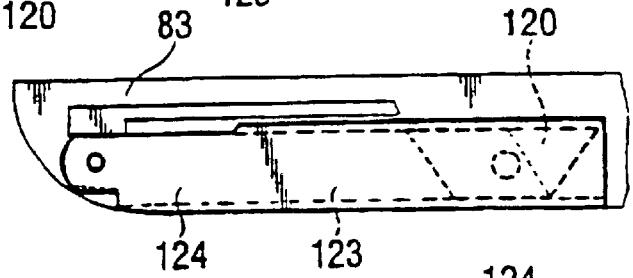

In the variant shown in FIGS. 39*a, b*, both the blade holder 123 and the protective cap 124, which is U-shaped in cross section, are articulatedly mounted on the utensil module 65 and are secured in the folded-out position by in each case one leaf spring 83, but in different angular positions, in such a manner that the blade holder 123 projects out of the protective cap 124. To fold the cutter in, only the protective cap 124 is accessible, and this cap then folds the blade holder 123 in with it.

Figure 40A:
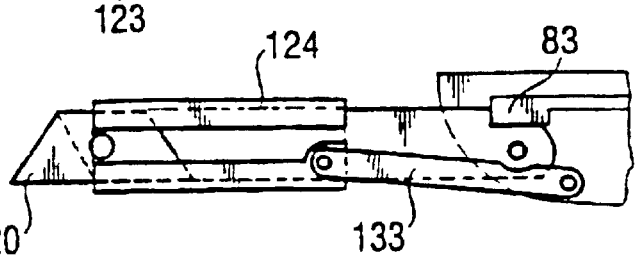
Figure 40C:
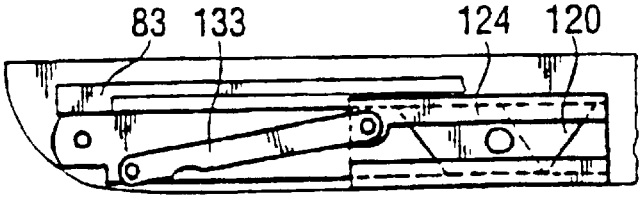

In the variant shown in FIGS. 40*a* to *c*, the blade holder 123 can be folded out and the protective cap 124 can be displaced thereon. The displacement is effected by means of a connecting rod 133, which is articulatedly mounted on the utensil module 65 with an axial offset with respect to the blade holder 123 and is coupled to the protective cap 124 via link 134. FIG. 40*b* shows an intermediate position between the folded-in position and the folded-out position.

Similarly, FIGS. 41*a* to *c* show the displacement of the blade holder 123 relative to the fold-out protective cap 124 by means of an articulatedly mounted connecting rod 133, which in this case is angled off so that it can be lowered fully into the utensil module 65.

Figure 42B:
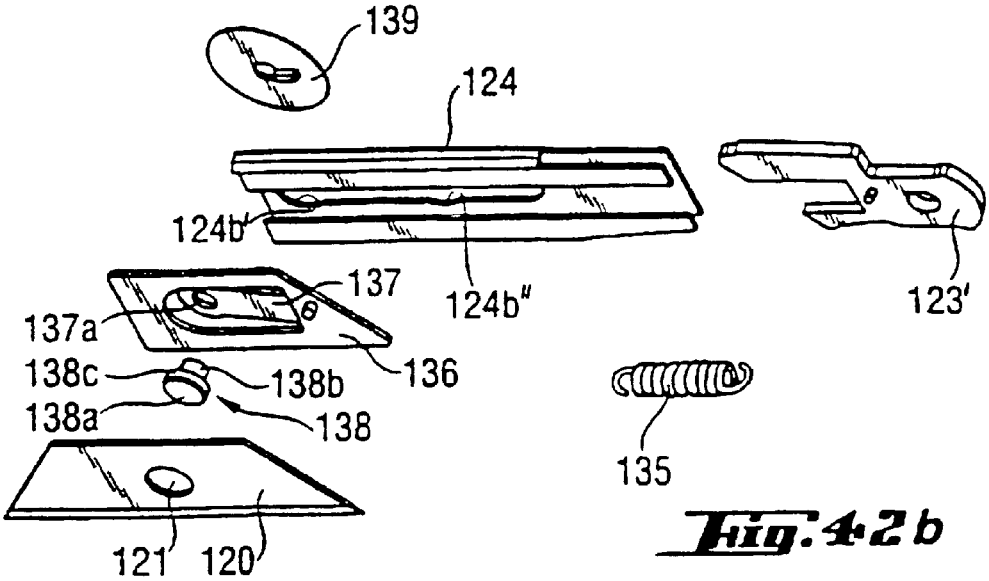
Figure 42C:
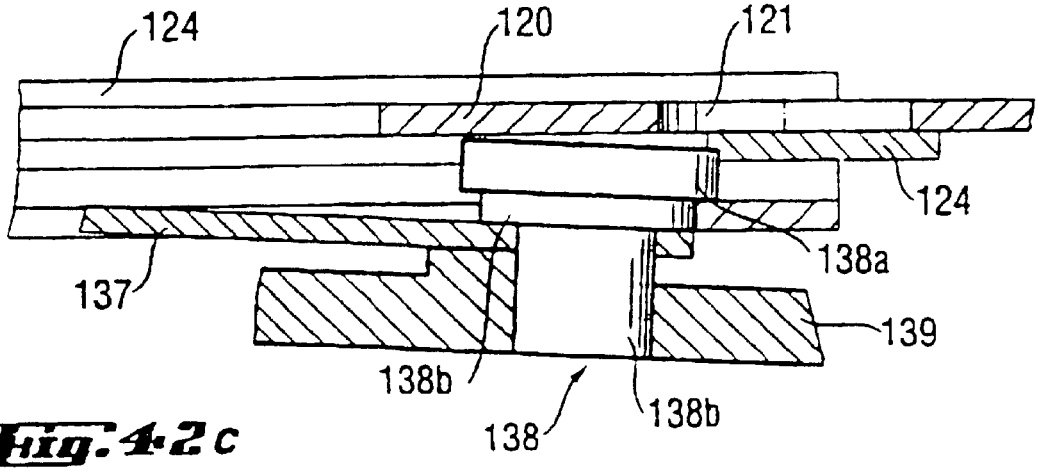
Figure 43A:
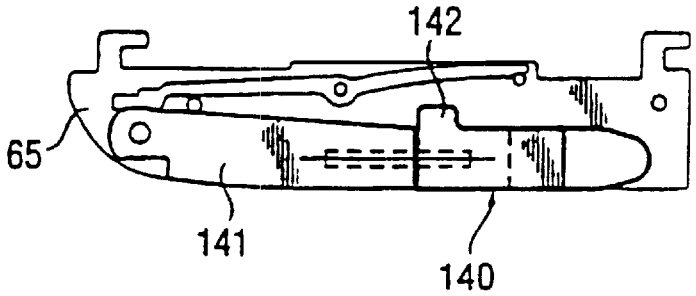
Figure 43B:
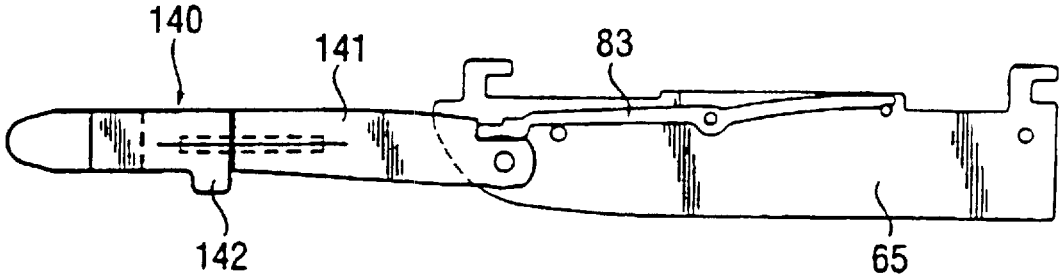
Figure 43C:
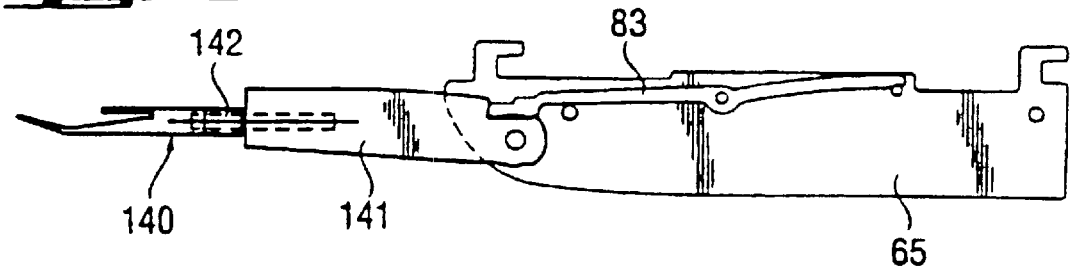
Figure 43D:
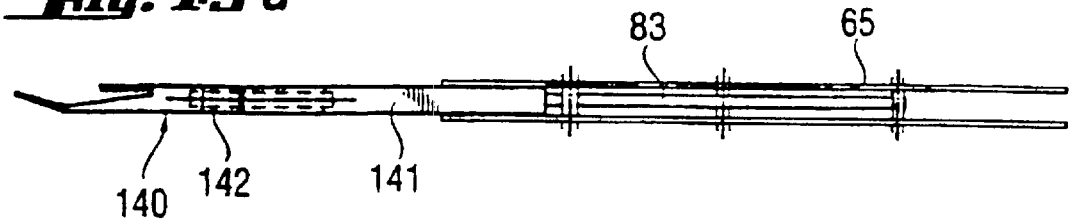
Figure 43E:
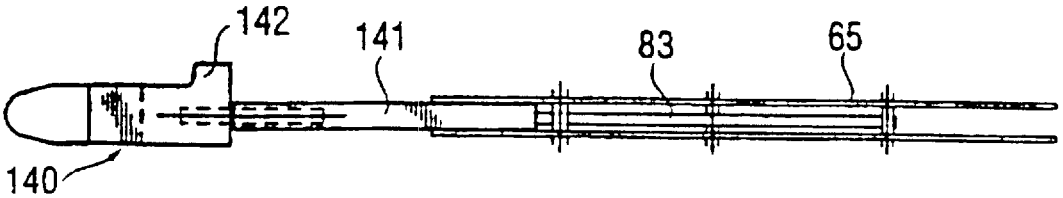
Figure 44A:
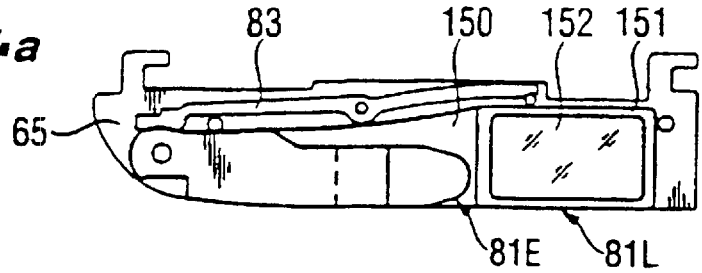
Figure 44B:
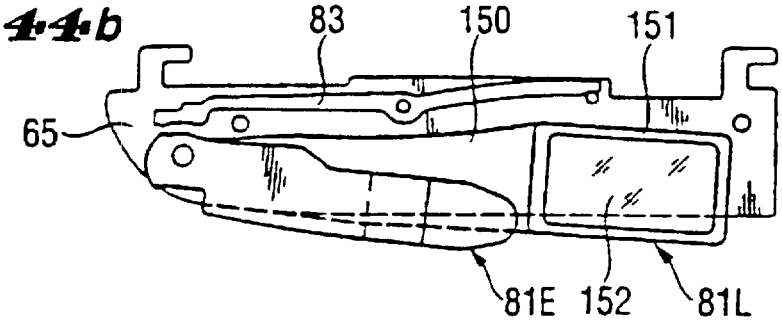
Figure 44C:
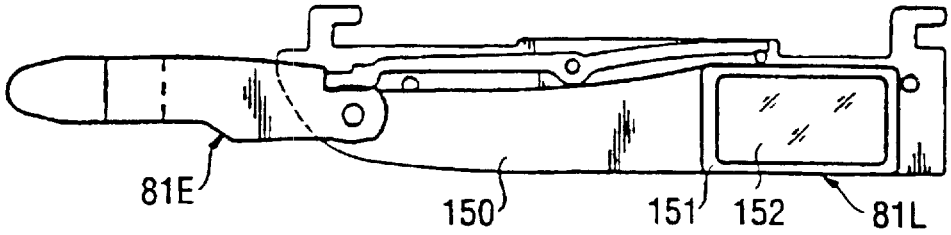
Figure 44D:
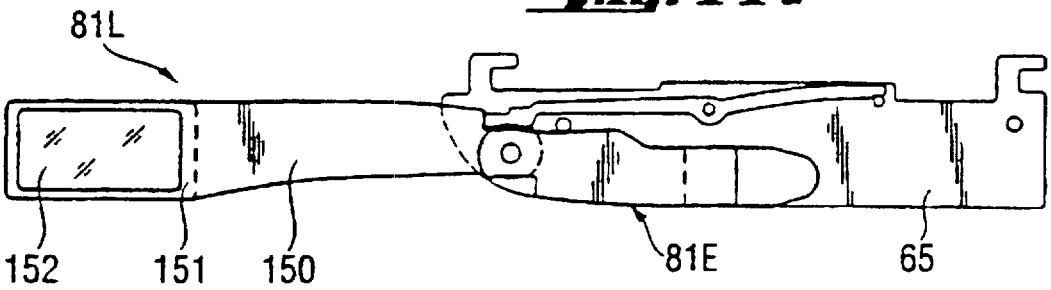
Figure 44E:
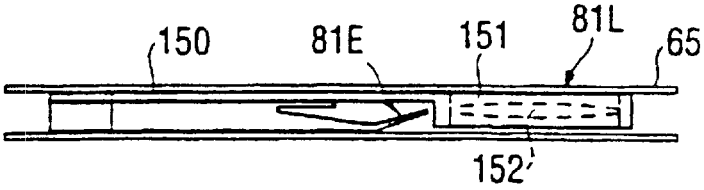
Figure 45A:
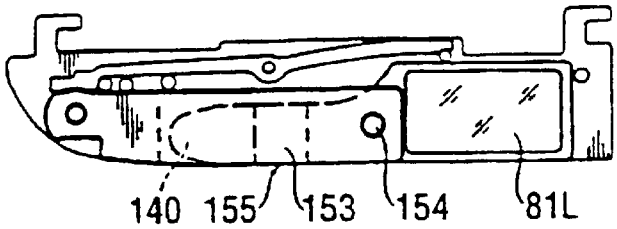
Figure 45B:
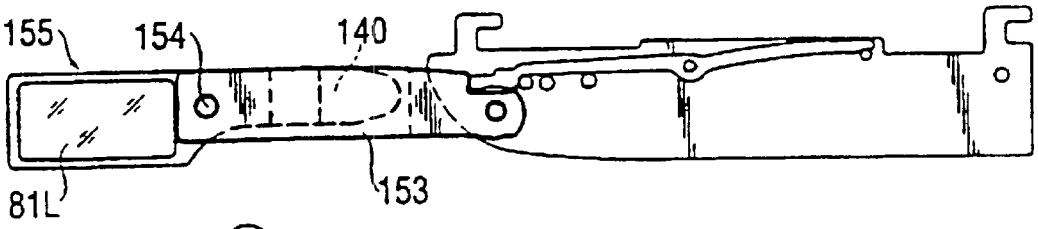
Figure 45C:
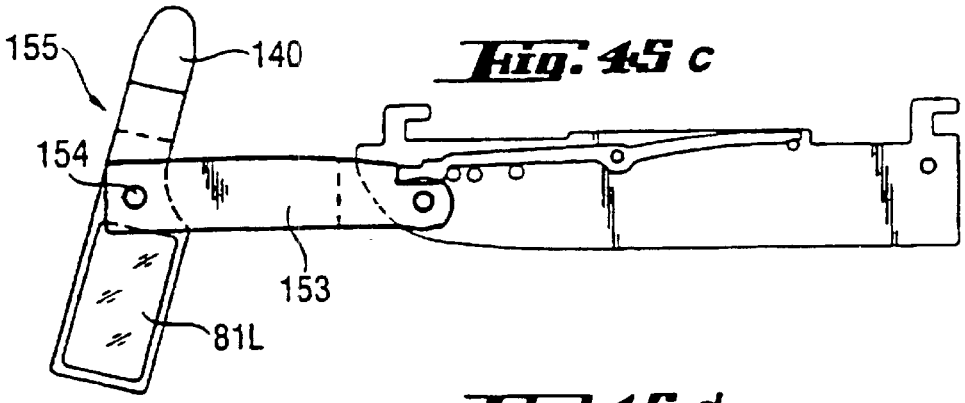
Figure 45D:
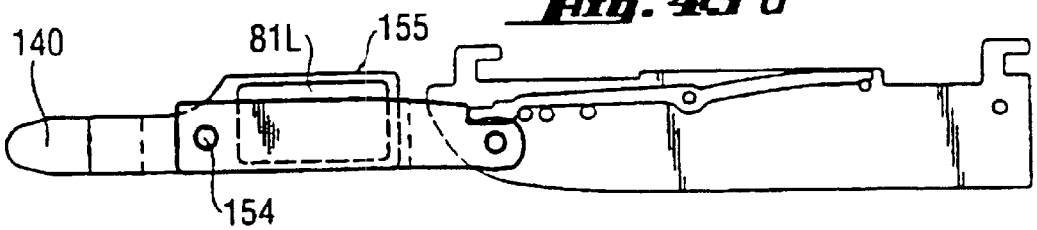
Figure 45E:
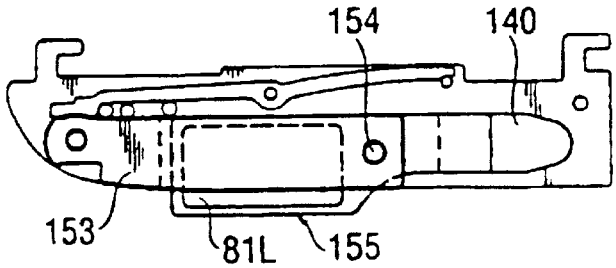
Figure 45F:
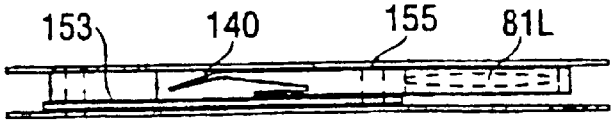

FIGS. 42*a* to *c* show an embodiment of a cutter 81C in which the shank 123', on which a leaf spring 83 acts, supports the blade protector 124, which on one wide side has a longitudinal slot running all the way through and on the other wide side has a slot 124*a* with two catches 124*b*' and 124*b*" which are at a distance from one another, one catch 124*b*' being arranged at that end of the slot 124*a* which is remote from the shank 123', while the other catch 124*b*" is at a distance from the first catch 124', in the direction towards the shank 123', which distance corresponds to the push-in length, in order for the blade 120 to be completely protected. The blade protector 124 accommodates a slide 136 which can be displaced therein, is connected to the shank 123' preferably by way of a tension spring 135, serves as a blade holder and has a leaf spring 137 which has been punched free and bent outwards. The blade 120 is held by way of a peg 138, the head 138*a* of which projects into the hole 121 in the blades 120. The extension 138*b* of the peg 138 extends through an opening 137*a* in the leaf spring 137 and is in fixed engagement with an actuating button 139 on the outer side of the blade protector 124. Moreover, a collar 138c is provided between the head 138*a* and the extension 138*b* of the peg 138, by means of which collar the peg 138 is supported against the leaf spring 137. In the latched-in state, the leaf spring 137 is located in the corresponding latching recess 124*b*' or 124*b*". In order for the blade 120 to be displaced, the actuating button 139 is pressed inwards counter to the force of the leaf spring 137, so that the leaf spring 137 becomes disengaged from the respective catch 124*b*' or 124*b*" and therefore the blade 120 can be displaced inside the blade protector 124 until, after the actuating button 139 has been released, the leaf spring 137 moves back into engagement with one of the catches 124*b*' or 124*b*". To turn round or exchange the blade 120, the actuating head 139 is pulled outwards, so that the head 138*a* is disengaged from the hole 121 and consequently the blade 120 is no longer held and can be removed.

A common feature of all the cutter variants shown is that they can be folded in with the blade 120 protected. It is possible for either the blade holder 123 or the protective cap 124 as desired, to be articulatively mounted on the utensil module 65, while the other element can be displaced relative to the first. The displacement movements may be activated manually or using springs and/or forcibly by means of the folding-out/folding-in movements of the utensil 81C.

The staple remover 81E is described broadly in WO 98/32570.

To improve handling further, in accordance with FIGS. 43*a* to *e*, the staple remover 140 can be rotated 90° out of the folding plane relative to a fold-out holder 141. Catches (not shown) ensure that both the position of use and the folded-in position are stable. A button 142 facilitates rotation. This rotational principle may, of course, also be applied to other utensils.

Depending on the type of the utensils 81, it is possible to accommodate two utensils 81 one behind the other in a common receiving space or compartment, in the direction of the longitudinal extent of the utensil module 65.

FIGS. 44*a* to *e* illustrate this on the basis of the example of a staple remover 81E and a magnifying lens 81L. The magnifying lens 81L has a thin shank 150, on the foot of which the leaf spring 83, which is in this case a common leaf spring, acts, while at its free end there is a widened frame 151 in which the lens 152 is positioned. The staple remover 81E does not require much space and can be located next to the shank 150 and behind the wide frame 151.

Of course, as shown in FIGS. 29*b, c*, such an arrangement could also be reversed, with a staple-removing head which is arranged on a thin shank 150 and a magnifying lens 81L or cutter 81C arranged behind the staple-removing head and next to the thin shank 150.

A further embodiment is illustrated in FIGS. 45*a* to *f*. A link 154 is arranged at the free end of a relatively thin holder 153, about which link a member 155 can rotate. The member 155 comprises a staple remover 140 on one side of the link 154, a magnifying lens 81L on the other side of the link 154. The user turns the member 155 into the position which is suitable for using the utensil 81. Catch devices for the limit positions (not shown) facilitate handling.

Naturally, with such an embodiment it would also be possible to arrange any utensils or tools at the ends of the member 155.

Figure 46A:
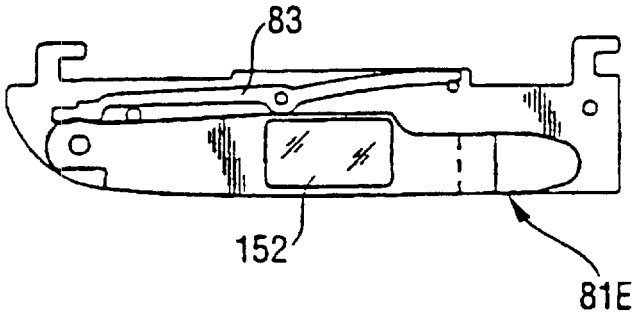
Figure 46B:
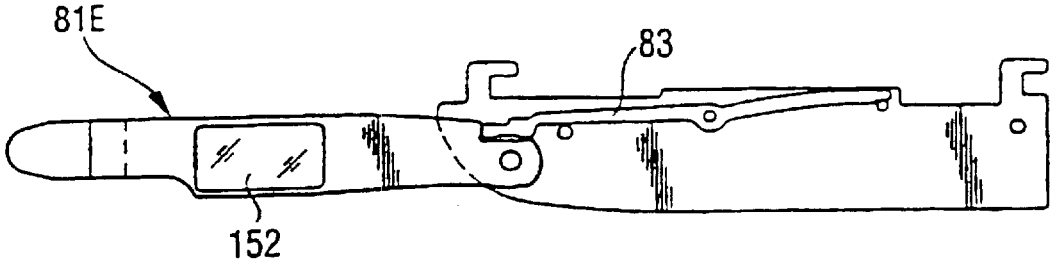

FIGS. 46*a, b* show a further possibility. In this case, the staple remover 81E is at the same time designed as a frame for the lens 152.

FIG. 47 shows an exploded, perspective view of a first form of scissors. A fold-out fixed scissor blade 200 is articulatedly mounted on the utensil module 65 at 201 and is connected to a pivotably moveable scissor blade 203 by way of rivet 202; furthermore, there is a stamped deformation 203*a* which serves as a stop and driver for a handle part 204 when the latter has been pivoted about the rivet 202' to bear against the deformation 203*a*. In the exploded view, the parts are oriented in the position in which they are pivoted into the associated storage space. It can be seen that the elements 200, 203 and 204 then lie next to one another. A leaf spring 205 preloads the scissor blades 200, 203 into the open position.

In the illustration of further designs of scissors, the working position of the elements after cutting is shown at the top in each case, the working position prior to cutting is shown in the middle in each case and the folded-together, folded-in position is shown at the bottom in each case.

Figure 47A:
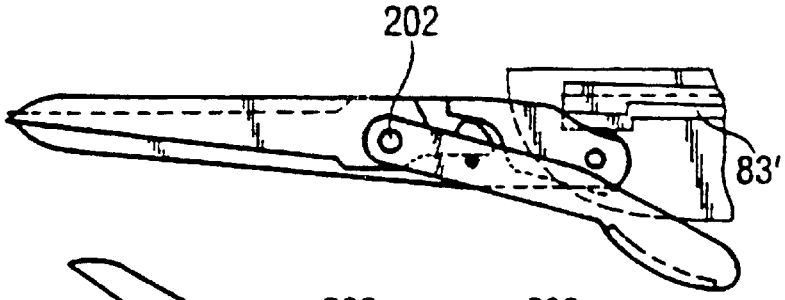
Figure 47B:
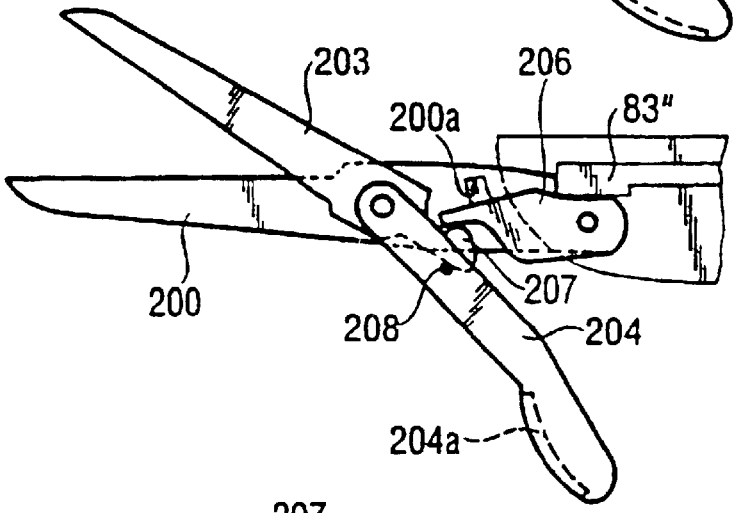
Figure 47C:
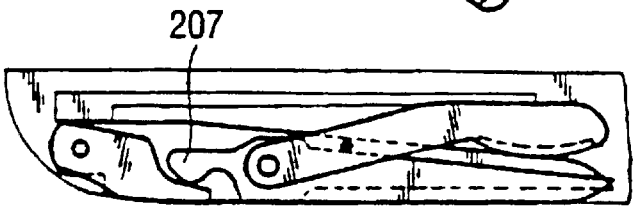

In the embodiment shown in FIGS. 47*a* to *c*, a first leaf spring 83' which preloads the fixed scissor blade 200 into the folded-out and folded-in position holds [sic], while the second leaf spring 83" acts on a transmission lever 206 which presses onto an extension 207 on the moveable scissor blade 203 and preloads it in the opening direction (FIG. 47*b*). The handle part 204 interacts with the moveable scissor blade 203, in that the movements of the handle part are transmitted to the moveable scissor blade 203 by means of rivet stub 208. The three parts 200, 203 and 204 are held together in a rotationally moveable manner by the rivet 202. The handle part 204 has a thumb rest 204*a*, in order to provide a larger contact surface for the fingers actuating the scissors. The transmission lever 206 projects by means of an extension (not shown) into an aperture 200*a* in the fixed scissor blade 200, so that the transmission lever 206 is entrained when the scissors are being folded in and out but can move relative to the fixed scissor blade 200 between the positions shown in FIGS. 47*a* and *b*. To fold the scissors in, the handle part 204 is pivoted forwards about rivet 202.

Figure 48A:
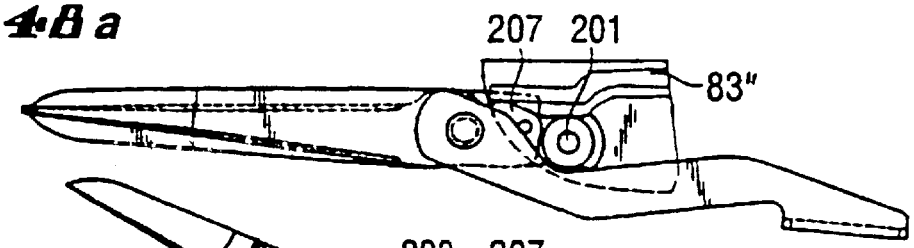
Figure 48B:
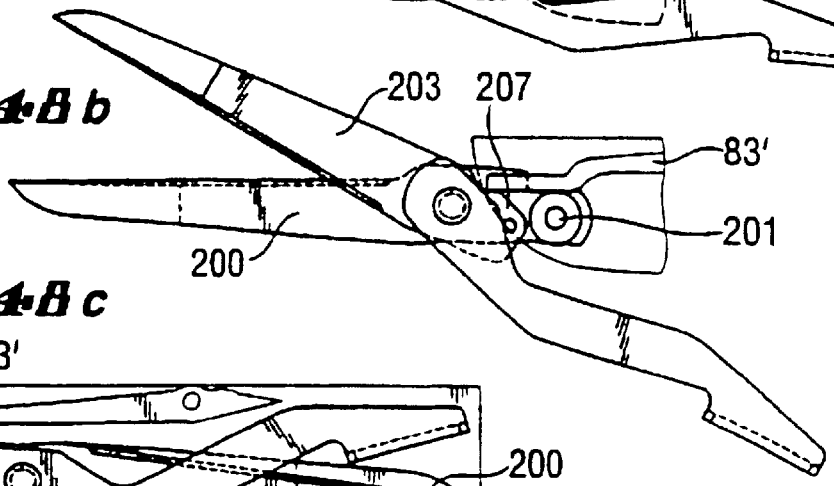
Figure 48C:
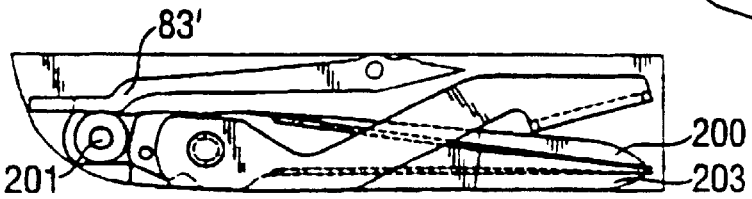

The exemplary embodiment shown in FIGS. 48*a* to c differs from that described above in that the transmission lever 206 is omitted and the leaf spring 83" acts directly on the extension 207, with the result that the scissor link can be placed closer to the fold-out pin 201 of the scissors, allowing the scissor blades 200, 203 to be lengthened.

Figure 49A:
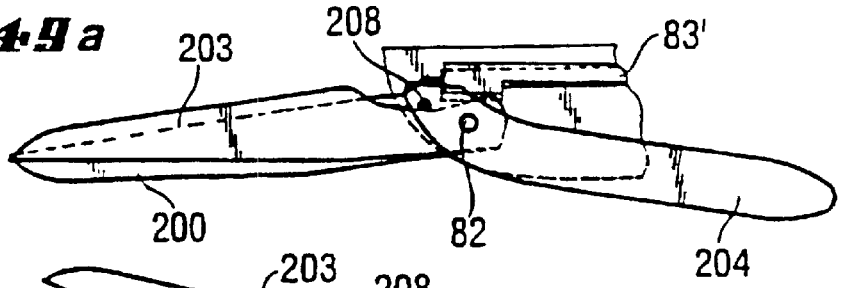
Figure 49B:
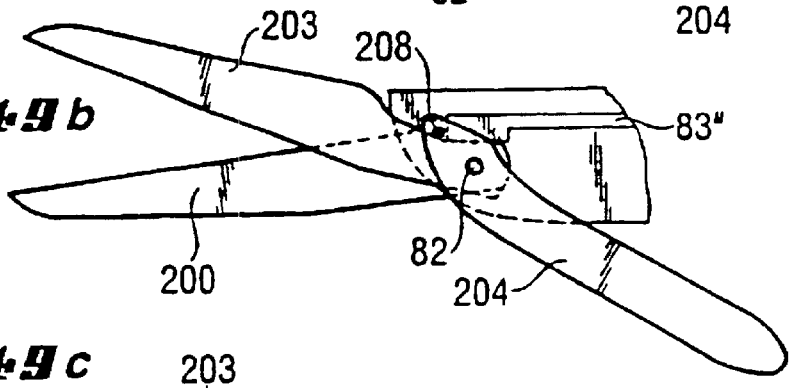
Figure 49C:
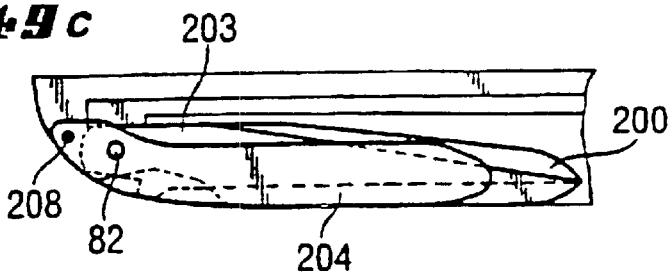

In the embodiment shown in FIGS. 49*a* to *c*, scissor blade 200, scissor blade 203 and handle part 204 can rotate together about the rotation pin 82. A first leaf spring 83' retains the scissor blade 200 in a slightly inclined position when folded out, and a second leaf spring 83" holds the scissor blade 203 in the open position when folded out. The handle part 204 acts on the scissor blade 203 by way of the rivet stub 208.

Figure 50A:
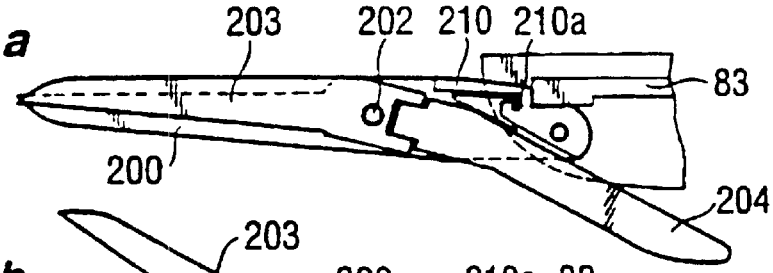
Figure 50B:
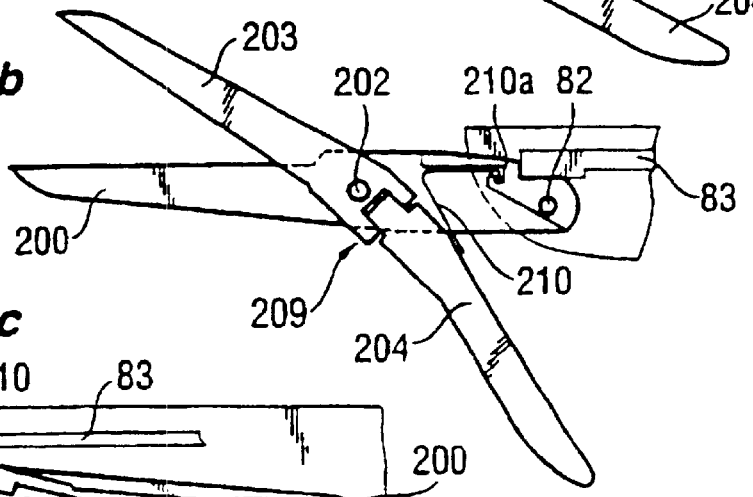
Figure 50C:
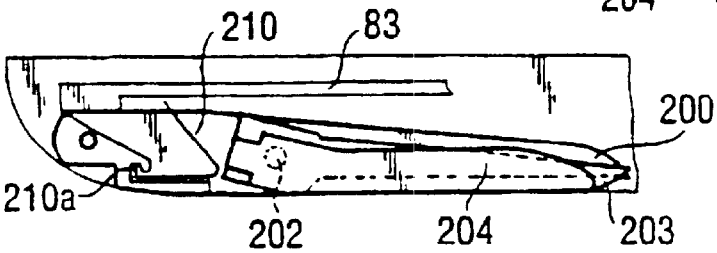
Figures 52A, 52B, 52C, 52D, 52E:
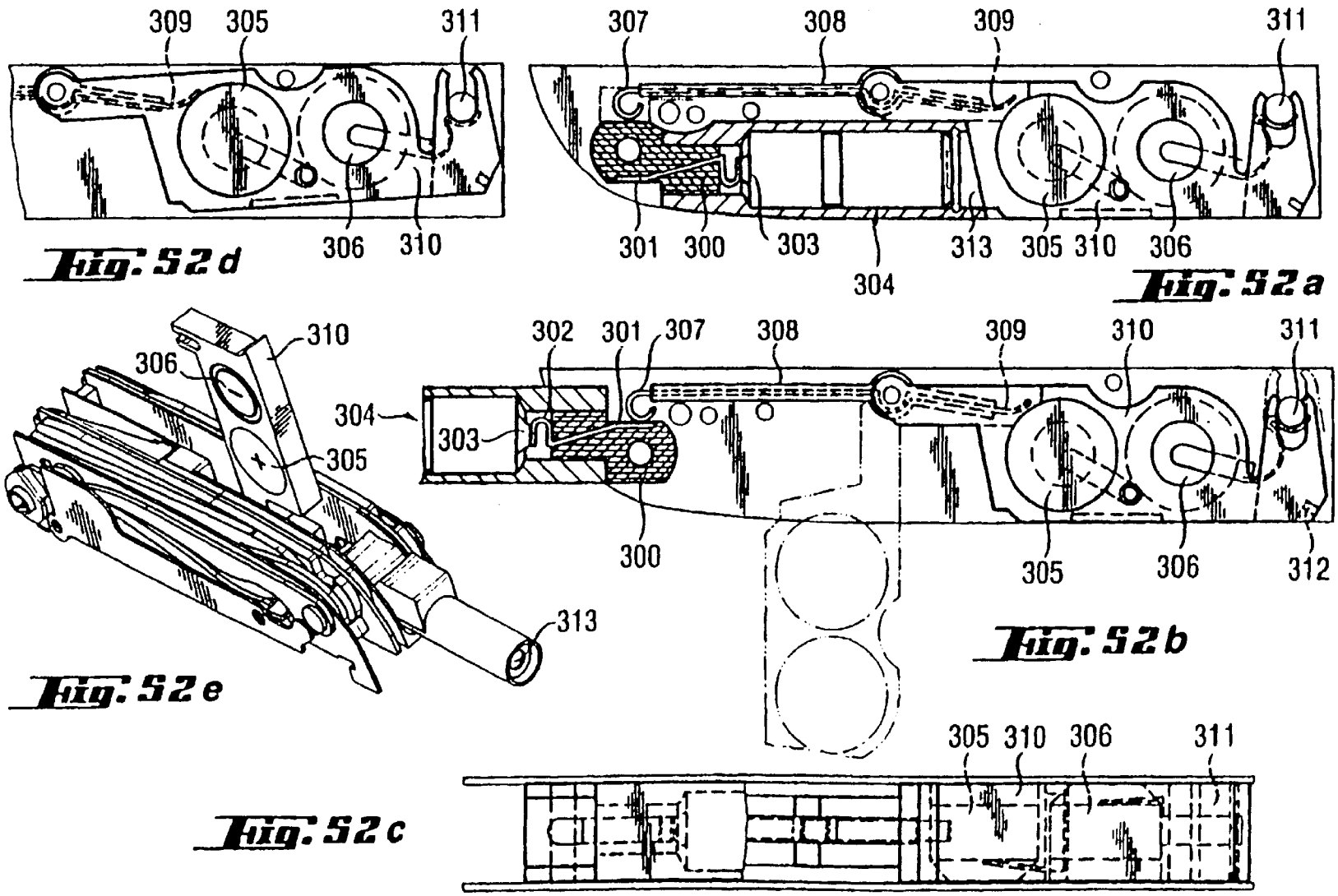

In the embodiment shown in FIGS. 50*a* to *c*, the moveable scissor blade 203 is articulatedly mounted on the fixed scissor blade 200 by way of rivet 202 and is connected to the handle part 204 by way of a hinge 209, the axis of which runs parallel to the fold-out plane. A leaf spring 210 is supported on the fixed scissor blade 200 on one side and on the handle part 204 on the other side and is held in a recess 200*a* in the fixed scissor blade 200 by way of an angled-off section 210*a*.

A further embodiment of a pair of scissors in accordance with FIGS. 51*a* to *d* likewise comprises a scissor blade 200 which is fixed and blocked in the folded-out position and a scissor blade 203 which can pivot with respect to the blade 200 about the rivet 202, by means of which the two scissor blades 200, 203 are moveably connected to one another. In this case, the fixed scissor blade 200, which interacts with the leaf spring 83', has a rivet 211 which interacts with a slot 212 in the moveable scissor blade 203, in order to limit its movement path and therefore also the opening movement of the scissors. The moveable scissor blade 203 is moved by the handle part 204, which is mounted on the rotation pin 214, with the interposition of the movement-diverting piece 213 which is also mounted on the rotation pin 214, can be pivoted together with the handle part 204 and has an extension 213*a* which is in the form of a sector of a circle and engages in a corresponding recess 203*a*' at the foot of the scissor blade 203, so that in the event of the handle part 204 being actuated the moveable scissor blade 203 pivots; the moveable scissor blade 203 is advantageously arranged on the same side, with respect to the fixed scissor blade 200, as the grip part 204. The multipurpose handheld implement, for example if it comprises the members 1, 2, can be picked up with the members 1, 2 closed and advantageously locked, and the handle part 204 can be actuated in the manner of a pair of pliers. Handle part 204, scissor blade 203 and scissor blade 200 lie in parallel planes one above the other. On its extension 204', which projects beyond the rotation pin 214, the handle part 204 is provided with a driver 215 which is curved through 900 and is supported on the movement-diverting piece 213, in order for the latter to be rotated at the same time when the handle part 204 is pivoted in order to actuate the scissors, and thus in order to pivot the moveable scissor blade 203. The movement-diverting piece 213 is in engagement with the head of the leaf spring 83", so that the scissors are actuated and deflect the leaf spring 83" and, when the handle part 204 is released, the leaf spring returns the scissors to the open position.

After the blocking which holds the fixed scissor blade 200 in the extended position has been released, this blade can be folded in. Therefore, the moveable scissor blade 203 is also folded in by way of the rivet 211, and in turn the movement-diverting piece 213 is folded in via the moveable scissor blade. In the process, the two scissor blades 200, 203 come into contact with the thumb rest 204*a* which projects into their movement path and on which the handle part 204 is also folded in and, in the storage position, is held beneath the two scissor blades 200, 203 (FIG. 51*b*).

The fixed scissor blade 200 is preloaded into the storage position by means of the leaf spring 83'. The moveable scissor blade 203 and therefore the handle part 204 lying below it are also held in the folded-in position by means of the rivet 211.

When the scissors are being folded out, the moveable scissor blade 203 is folded out into its open position of use by the movement-diverting piece 213 running onto the leaf spring 83" and the handle part 204 is folded out into its open position of use automatically by means of the driver 215, FIG. 51*c*. This preferred embodiment thus enables the scissors to be folded from the storage position into the open position of use or back out of the position of use into the storage position in a single action.

To prevent the fixed scissor blade, such as scissor blade 200, from being deflected or even folding in during use of the scissors, the fixed scissor blade 200 is blocked by means of a suitable device in the folded-out position of use of the scissors and is unblocked in order for the scissors to be folded in. This preferably also applies to the scissor designs which have been shown and described above.

In order to be accommodated stably, the scissors are preferably supported between two immediately adjoining small plates in the utensil module 65. To reduce the friction, the movement-diverting piece 213 and the handle part 204 may be mounted on a spacer sleeve which supports the fixed scissor blade 200 and the small plate bearing against the handle section 204 counter to the rivet force of the rotation pin 214.

A further utensil, namely a so-called laser pointer, is shown in FIGS. 52*a* to *e*.

The laser pointer comprises a fold-out base 300 made from insulating material, in which a conductor track 301 is embedded. A resilient end piece 302 of the conductor track projects out of the base 300 and is in contact with a corresponding connection 303 of a laser unit 304 which is fitted onto the base 300. The circuit leading from power-supply batteries 305, 306 to the laser unit 304 can only be closed in the folded-out state shown in FIGS. 52*b, d* since only then does a connecting conductor 307 come into contact with the conductor track 301. With appropriate insulation 308, this leads to a free resilient end which serves as a contact 309. The batteries 305, 306 are accommodated in a holder 310 which can be folded out in order to change the battery (as shown in dot-dashed lines in FIG. 52*b*). In the folded-in position, the battery holder 310 is held against a pin 311 with latching arms.

The two batteries 305, 306 are connected in series and one end of the series circuit is connected to earth via the pin 311. The holder 310 serves as a switch: when it is depressed (FIG. 52*d*), the other end of the battery series circuit touches the contact 309 and closes the circuit. Alternatively, the circuit may also be broken in the area of the latching arms. Naturally, the activation could also be effected by means of a separate microswitch. For the (infrequent) operation of changing the battery, an engagement member 312 is provided on the holder 310, which member can be acted on using a tool in order to eliminate the latching effect. The holder 310 can then be folded open and the two batteries 305, 306 can be changed by extracting them sideways.

To simplify the drawing, the return conductor from the laser unit 304 is not shown. It can be seen that, when the laser unit 304 is folded in, the unit cannot be activated unintentionally and perhaps even unnoticed, for example when actuating the stapler or the hole puncher. Furthermore, folding in the laser unit 304 when it is not in use protects the outlet opening 313 from damage and dirt. The line between battery 306 and pin 311 is angled off and is supported resiliently on the pin 311, so that the holder 310 is pressed into its latching position when released.

What is claimed is:

1. A multipurpose handheld implement comprising:

a plurality of fold-out utensils rotatable out of a folded-in storage position into a folded-out working position about a rotation axis running transversely to the folding direction;

the utensils, in their storage position, being substantially accommodated by the multipurpose handheld implement; and a common lifting device acting on at least two of the fold-out utensils and actuatable by at least one actuating member, the utensils being liftable by the lifting device into a predetermined position in which the utensils project part-way out of the multipurpose handheld implement so that they can be manually grasped and, decoupled from the lifting device, moved into the folded-out working position, wherein the lifting height of the lifting device is limited to the range of a restoring spring force biasing the utensils into the folded-in storage position, so that the utensils not folded out into the working position fold back into their storage position when the actuating member is released.

2. The implement of claim 1, wherein each utensil is biased into the storage position by a leaf spring.

3. The implement of claim 1, wherein the lifting device is operative to push the utensils in the folding-out direction.

4. The implement of claim 1, wherein the lifting device is operative to act on the shank portions of the utensils.

5. The implement of claim 1, wherein by actuation of the lifting device, the utensils are staggered with respect to their height.

6. The implement of claim 1, wherein the lifting device is acting directly on the utensils.

7. The implement of claim 1, wherein on one lateral side of the utensils, a mechanism of the lifting device which comprises a lifting element is provided, the lifting element and the actuating member being connected by means of connecting members.

8. The implement of claim 1, wherein the lifting device is acting via a force-reducing transmission on the utensils.

9. The implement of claim 1, wherein the actuating member is a pivotable lever.

10. The implement of claim 9, wherein the lever is pivotable about a separate axis and provided at a lateral surface of the implement, the lever being pivotable over an angle which is determined by the lifting height of the lifting device.

11. The implement of claim 1, wherein the plurality of utensils are rotatable about a common rotation axis.

12. The implement of claim 1, wherein two actuating members which act in the same way, one on either lateral side of the multipurpose handheld implement, are provided in a symmetrical arrangement.

13. The implement of claim 1, wherein two lifting devices, one in each lateral interspace between the utensils and the lateral side of the multipurpose handheld implement, are provided in a symmetrical arrangement.

14. The implement of claim 1, wherein two actuating members which act in the same way and two lifting devices, a respective one of each in a corresponding lateral interspace between the utensils and the lateral side of the multipurpose handheld implement, are provided in a symmetrical arrangement.

15. The implement of claim 12, wherein the actuating members are connected to one another via connecting members.

16. The implement of claim 13, wherein the corresponding parts of the lifting devices are connected to one another via connecting members.

17. The implement of claim 14, wherein the actuating members and the corresponding parts of the lifting devices are connected to one another via respective connecting members.

18. The implement of claim 1, wherein the common lifting device comprises a lifting plate.

19. The implement of claim 18, wherein the lifting plate is inclined with respect to projections on the shanks of the utensils, the projections being staggered in the longitudinal direction of the utensils.

20. The implement of claim 1, wherein the utensils are arranged in a utensil module.

21. The implement of claim 20, wherein on one lateral side of the utensil module, a mechanism of the lifting device comprising a lifting element, the lifting element and the actuating member being connected by means of connecting members, is provided.

22. The implement of claim 20, wherein on both lateral sides of the utensil module a mechanism of the lifting device comprising lifting elements is provided, the lifting elements as well as the actuating members being connected with one another by means of connecting members.

23. The implement of claim 1, wherein the lifting device and the actuating member are reset by the spring force which biases the utensils into the folded-in storage position.

24. The implement of claim 1, wherein the lifting device and the actuating member are reset by means of separate springs which biases the utensils into the folded-in storage position.

25. The implement of claim 1, wherein the at least one actuating member is positioned so that holding the implement near its center of gravity position and actuating the at least one actuating member can be accomplished by one hand.

26. The implement of claim 1, wherein the at least one actuating member is positioned near the end portion of the utensils opposite to the rotation axis.

27. The implement of claim 1, wherein the direction of movement of the at least one actuating member is directed oppositely to the fold-out direction of the utensils.

28. The implement of claim 1, wherein locking means for locking at least one utensil in its working position is provided, the deactivation of the locking means and the activation of the lifting device being accomplished simultaneously by the at least one actuating member.

29. The implement of claim 1, wherein spring-relief means for the relief of the spring bias of at least one utensil into its storage position is provided, the activation of the spring-relief means and the activation of the lifting device being accomplished simultaneously by the at least one actuating member.

30. The implement of claim 12, wherein the actuating members are actuating levers connected to a common spindle.

31. The implement of claim 14, wherein the actuating members are actuating levers connected to a common spindle.

32. The implement of claim 30, wherein the spindle is mounted in a utensil module.

33. The implement of claim 31, wherein the spindle is mounted in a utensil module.

34. The implement of claim 30, wherein the spindle is a hollow spindle into which the actuating levers are press-fitted.

35. The implement of claim 31, wherein the spindle is a hollow spindle into which the actuating levers are press-fitted.

36. The implement of claim 30, wherein the spindle is provided with an inner actuating lever activating the lifting device and rotating with the spindle.

37. The implement of claim 31, wherein the spindle is provided with an inner actuating lever activating the lifting device and rotating with the spindle.

38. The implement of claim 31, wherein the spindle is provided with two inner actuating levers which rotate with the spindle.

39. The implement of claim 1, wherein the actuating member is a rotatable actuating lever which is formed from a pin and a tongue which is connected thereto, extends perpendicularly to its axis and is surrounded with plastic by injection molding.

40. A multipurpose handheld implement comprising:

a plurality of fold-out utensils rotatable out of a folded-in storage position into a folded-out working position about a rotation axis running transversely to the folding direction;

the utensils, in their storage position, being substantially accommodated by the multipurpose handheld implement; and a common lifting device acting on at least two of the fold-out utensils and actuatable by at least one actuating member, the lifting device having a lifting height at the end of which the utensils project part-way out of the multipurpose handheld implement in a staggered manner with respect to their height so that they can be manually grasped and decoupled from the lifting device, moved into the folded-out working position.

41. The implement of claim 40, wherein the utensils are biased into the folded-in storage position by a restoring spring force and the lifting height of the lifting device is limited to the range of the restoring spring force, so that the utensils not folded out into the working position fold back into their storage position when the actuating member is released.

42. The implement of claim 40, wherein each utensil is biased into the storage position by a leaf spring.

43. The implement of claim 40, wherein the lifting device is operative to push the utensils in the folding-out direction.

44. The implement of claim 40, wherein the lifting device is operative to act on the shank portions of the utensils.

45. The implement of claim 40, wherein the lifting device is acting directly on the utensils.

46. The implement of claim 40, wherein on one lateral side of the utensils, a mechanism of the lifting device which comprises a lifting element is provided, the lifting element and the actuating member being connected by means of a connecting member.

47. The implement of claim 40, wherein the lifting device is acting via a force-reducing transmission on the utensils.

48. The implement of claim 40, wherein the actuating member is a pivotable lever.

49. The implement of claim 48, wherein the lever is pivotable about a separate axis and provided at a lateral surface of the implement, the lever being pivotable over an angle which is determined by the lifting height of the lifting device.

50. The implement of claim 40, wherein the plurality of utensils are rotatable about a common rotation axis.

51. The implement of claim 40, wherein two actuating members which act in the same way, one on either lateral side of the multipurpose handheld implement, are provided in a symmetrical arrangement.

52. The implement of claim 40, wherein two lifting devices, one in each lateral interspace between the utensils and the lateral side of the multipurpose handheld implement, are provided in a symmetrical arrangement.

53. The implement of claim 40, wherein two actuating members which act in the same way and lifting devices, a respective one of each in a corresponding lateral interspace between the utensils and the lateral side of the multipurpose handheld implement, are provided in a symmetrical arrangement.

54. The implement of claim 51, wherein the actuating members are connected to one another via connecting members.

55. The implement of claim 52, wherein the corresponding parts of the lifting devices are connected to one another via connecting members.

56. The implement of claim 53, wherein the actuating members and the corresponding parts of the lifting devices are connected to one another via respective connecting members.

57. The implement of claim 40, wherein the common lifting device comprises a lifting plate.

58. The implement of claim 57, wherein the lifting plate is inclined with respect to projections on the shanks of the utensils, the projections being staggered in the longitudinal direction of the utensils.

59. The implement of claim 40, wherein the utensils are arranged in a utensil module.

60. The implement of claim 59, wherein on one lateral side of the utensil module a mechanism of the lifting device comprising a lifting element, the lifting element and the actuating member being connected by means of connecting members, is provided.

61. The implement of claim 59, wherein on both lateral sides of the utensil module a mechanism of the lifting device comprising lifting elements is provided, the lifting elements as well as the actuating members being with one another connected by means of connecting members.

62. The implement of claim 40, wherein the lifting device and the actuating member are reset by the spring force which biases the utensils into the folded-in storage position.

63. The implement of claim 40, wherein the lifting device and the actuating member are reset by means of separate springs which biases the utensils into the folded-in storage position.

64. The implement of claim 40, wherein the at least one actuating member is positioned so that holding the implement near its center of gravity position and actuating the at least one actuating member can be accomplished by one hand.

65. The implement of claim 40, wherein the at least one actuating member is positioned near the end portion of the utensils opposite to the rotation axis.

66. The implement of claim 40, wherein the direction of movement of the at least one actuating member is directed oppositely to the fold-out direction of the utensils.

67. The implement of claim 40, wherein locking means for locking at least one utensil in its working position is provided, the activation of the locking means and the activation of the lifting device being accomplished simultaneously by the at least one actuating member.

68. The implement of claim 40, wherein spring-relief means for the relief of the spring bias of at least one utensil into its storage position is provided, the activation of the spring-relief means and the activation of the lifting device being accomplished simultaneously by the at least one actuating member.

69. The implement of claim 51, wherein the actuating members are actuating levers connected to a common spindle.

70. The implement of claim 53, wherein the actuating members are actuating levers connected to a common spindle.

71. The implement of claim 72, wherein the spindle is mounted in a utensil module.

72. The implement of claim 70, wherein the spindle is mounted in a utensil module.

73. The implement of claim 72, wherein the spindle is a hollow spindle into which the actuating levers are press-fitted.

74. The implement of claim 70, wherein the spindle is a hollow spindle into which the actuating levers are press-fitted.

75. The implement of claim 72, wherein the spindle is provided with an actuating lever activating the lifting device and rotating with the spindle.

76. The implement of claim 70, wherein the spindle is provided with an actuating lever activating the lifting device and rotating with the spindle.

77. The implement of claim 40, wherein the actuating member is a rotatable actuating lever which is formed from a pin and a tongue which is connected thereto, extends perpendicularly to its axis and is surrounded with plastic by injection molding.

78. A multipurpose handheld implement comprising:

at least one fold-out utensil rotatable out of a folded-in storage position into a folded-out working position about a rotation axis running transversely to the folding direction;

the at least one utensil, in its storage position, being substantially accommodated by the multipurpose handheld implement; and a lifting device acting on the at least one utensil and actuatable by at least one actuating member, the lifting device having a lifting height at the end of which the at least one utensil projects part-way out of the multipurpose handheld implement so that it can be manually grasped and, decoupled from the lifting device, moved into the folded-out working position;

wherein the actuating member is a lever pivotable about a separate axis and being provided at a lateral surface of the multipurpose handheld implement, the lever being pivotable over an angle predetermined by the lifting height of the lifting device.

79. The implement of claim 78, wherein the at least one utensil is biased into the folded-in storage position by a restoring spring force and the lifting height of the lifting device is limited to the range of the restoring spring force, so that the at least one utensil not folded out into the working position folds back into its storage position when the actuating member is released.

80. The implement of claim 78, wherein the at least one utensil is biased into the storage position by a leaf spring.

81. The implement of claim 78, wherein the lifting device is operative to push at least one utensils in the folding-out direction.

82. The implement of claim 78, wherein the at least one utensil comprises a plurality of fold-out utensils, each of the plurality of utensils being staggered with respect to their height upon actuation of the lifting device.

83. The implement of claim 78, wherein the lifting device is operative to act on the shank portions of the at least one utensil.

84. The implement of claim 78, wherein the lifting device is acting directly on the at least one utensil.

85. The implement of claim 78, wherein on one lateral side of the utensils, a mechanism of the lifting device which comprises a lifting element is provided, the lifting element and the actuating member being connected by means of connecting members.

86. The implement of claim 78, wherein the lifting device is acting via a force-reducing transmission on the at least one utensil.

87. The implement of claim 78, wherein the at least one utensil comprises a plurality of utensils rotatable about a common rotation axis.

88. The implement of claim 78, wherein two actuating members which act in the same way, one on either lateral side of the multipurpose handheld implement, are provided in a symmetrical arrangement.

89. The implement of claim 78, wherein lifting devices, one in each lateral interspace between the utensils and the lateral side of the multipurpose handheld implement, are provided in a symmetrical arrangement.

90. The implement of claim 78, wherein two actuating members which act in the same way and lifting devices, a respective one of each in a corresponding lateral interspace between the utensils and the lateral side of the multipurpose handheld implement, are provided in a symmetrical arrangement.

91. The implement of claim 88, wherein the actuating members are connected to one another via connecting members.

92. The implement of claim 89, wherein the corresponding parts of the lifting devices are connected to one another via connecting members.

93. The implement of claim 90, wherein the actuating members and corresponding parts of the lifting devices are connected to one another via respective connecting members.

94. The implement of claim 78, wherein, when several utensils are provided, the lifting device comprises a common lifting element for lifting the utensils.

95. The implement of claim 94, wherein the common lifting element comprises a lifting plate.

96. The implement of claim 95, wherein the lifting plate is inclined with respect to projections on the shanks of the utensils, the projections being staggered in the longitudinal direction of the utensils.

97. The implement of claim 78, wherein several utensils are arranged in a utensil module.

98. The implement of claim 97, wherein on one lateral side of the utensil module a mechanism of the lifting device comprising a lifting element, the lifting element and the actuating member being connected by means of connecting members, is provided.

99. The implement of claim 97, wherein on both lateral sides of the utensil module a mechanism of the lifting device comprising lifting elements is provided, the lifting elements as well as the actuating members being connected with one another by means of connecting members.

100. The implement of claim 78, wherein the lifting device and the actuating member are reset by the spring force which biases the at least one utensil into the folded-in storage position.

101. The implement of claim 78, wherein the lifting device and the actuating member are reset by means of separate springs which biases the at least one utensil into the folded-in storage position.

102. The implement of claim 78, wherein the at least one actuating member is positioned so that holding the implement near its center of gravity position and actuating the at least one actuating member can be accomplished by one hand.

103. The implement of claim 78, wherein the at least one actuating member is positioned near the end portion of the at least one utensil opposite to the rotation axis.

104. The implement of claim 78, wherein the direction of movement of the at least one actuating member is directed oppositely to the fold-out direction of the at least one utensil.

105. The implement of claim 78, wherein locking means for locking the at least one utensil in its working position is provided, the deactivation of the locking means and the activation of the lifting device being accomplished simultaneously by the at least one actuating member.

106. The implement of claim 78, wherein spring-relief means for the relief of the spring bias of the at least one utensil into its storage position is provided, the activation of the spring-relief means and the activation of the lifting device being accomplished simultaneously by the at least one actuating member.

107. The implement of claim 88, wherein the actuating members are actuating levers connected to a common spindle.

108. The implement of claim 90, wherein the actuating members are actuating levers connected to a common spindle.

109. The implement of claim 107, wherein the spindle is mounted in a utensil module.

110. The implement of claim 108, wherein the spindle is mounted in a utensil module.

111. The implement of claim 107, wherein the spindle is a hollow spindle into which the actuating levers are press-fitted.

112. The implement of claim 108, wherein the spindle is a hollow spindle into which the actuating levers are press-fitted.

113. The implement of claim 107, wherein the spindle is provided with an inner actuating lever activating the lifting device and rotating with the spindle.

114. The implement of claim 108, wherein the spindle is provided with an inner actuating lever activating the lifting device and rotating with the spindle.

115. The implement of claim 78, wherein the actuating member is a rotatable actuating lever which is formed from a pin and a tongue which is connected thereto, extends perpendicularly to its axis and is surrounded with plastic by injection molding.

* * * * *

UNITED STATES PATENT AND TRADEMARK OFFICE

CERTIFICATE OF CORRECTION

PATENT NO. : 6,460,433 B1
DATED : October 8, 2002
INVENTOR(S) : Peter Ackeret et al.

It is certified that error appears in the above-identified patent and that said Letters Patent is hereby corrected as shown below:

Title page,
Item [73], delete "C-Tech AG," and substitute -- CTECH AG, -- in its place.
Item [30], Foreign Application Priority Data, delete "197 45 799" and substitute -- 197 45 799.1 -- in its place.
Item [56], References Cited, FOREIGN PATENT DOCUMENTS, delete "P.A. 190352-3458", and substitute -- P.A. 190350-3458 -- in its place.

Column 9,
Lines 6 and 7, delete "88*k*" and substitute -- 83*k* -- in its place.

Column 10,
Line 5, delete "88*k*" and substitute -- 83*k* -- in its place.

Column 12,
Line 23, delete "88*k*" and substitute -- 83*k* -- in its place.

Column 14,
Line 38, delete "imply" and substitute -- simply -- in its place.

Column 19,
Line 15, delete "900" and substitute -- 90º -- in its place.

Column 22,
Line 66, immediately after "grasped and" insert -- , -- (comma).

Column 24,
Line 25, delete "activation" and substitute -- deactivation -- in its place.
Lines 39, 43 and 49,, delete "claim 72," and substitute -- claim 69, -- in its place.

UNITED STATES PATENT AND TRADEMARK OFFICE

CERTIFICATE OF CORRECTION

PATENT NO. : 6,460,433 B1
DATED : October 8, 2002
INVENTOR(S) : Peter Ackeret et al.

It is certified that error appears in the above-identified patent and that said Letters Patent is hereby corrected as shown below:

Column 25,
Line 21, after "to push" insert -- the --.

Signed and Sealed this

Twenty-third Day of March, 2004

JON W. DUDAS
*Acting Director of the United States Patent and Trademark Office*